US010066892B1

(12) United States Patent
Dacier et al.

(10) Patent No.: US 10,066,892 B1
(45) Date of Patent: Sep. 4, 2018

(54) MODULAR AUTOMATED MORTAR WEAPON FOR MOBILE APPLICATIONS

(71) Applicant: The United States of America as Represented by the Secretary of the Army, Washington, DC (US)

(72) Inventors: Timothy Dacier, Newton, NJ (US); Thomas Tighe, Morristown, NJ (US); Joshua Stapp, Mount Bethel, PA (US); William Bartell, Hackettstown, NJ (US); Matthew Tomik, Easton, PA (US); Gary Mammolo, Parsippany, NJ (US); Noah Gordon, Metuchen, NJ (US); Edward Yuhas, Hamburg, NJ (US); Philip Floroff, Long Valley, NJ (US); William Hughes, Hardwick, NJ (US); Philip Wetzel, Great Meadows, NJ (US); Jesus Quinones, East Stroudsberg, PA (US); Anthony Franchino, Neshanic Station, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/484,571

(22) Filed: Apr. 11, 2017

Related U.S. Application Data

(63) Continuation-in-part of application No. 14/596,422, filed on Jan. 14, 2015, now Pat. No. 9,470,476, and a (Continued)

(51) Int. Cl.
*F41A 25/14* (2006.01)
*F41A 25/12* (2006.01)
*F41A 31/00* (2006.01)

(52) U.S. Cl.
CPC ..... *F41A 25/12* (2013.01); *F41A 31/00* (2013.01); *F41A 25/14* (2013.01)

(58) Field of Classification Search
CPC ..... F41A 25/00; F41A 25/02; F41A 25/04; F41A 25/06; F41A 25/08; F41A 25/10; (Continued)

(56) References Cited

U.S. PATENT DOCUMENTS 681,109 A 8/1901 Dawson
2,089,671 A 8/1937 Stecke
(Continued)

*Primary Examiner* — John Cooper
(74) *Attorney, Agent, or Firm* — John P. DiScala

(57) ABSTRACT

An automated weapon system comprising an active recoil control system, a bi-directional recoil containment and double strike prevention system and a mortar retention system. The active recoil control system uses multiple sensors in combination with a solenoid controlled multi-disc brake to adjust the weapon recoil. Using outputs from the sensors, a controller predicts and reacts to a recoiling mass performance and applies the required braking force, in order to compensate for anticipated or actual variations. Feedback from the sensors allows the active recoil control system to adjust braking during the recoil strokes and counter-recoil strokes in order to optimize the weapon operation and performance in extreme firing conditions.

4 Claims, 67 Drawing Sheets

Related U.S. Application Data continuation-in-part of application No. 14/596,662, filed on Jan. 14, 2015, now Pat. No. 9,546,840, and a continuation-in-part of application No. 14/596,573, filed on Jan. 14, 2015, now Pat. No. 9,435,602.

(60) Provisional application No. 62/320,702, filed on Apr. 11, 2016.

(58) Field of Classification Search

CPC ..... F41A 25/12; F41A 25/14; F41A 25/16; F41A 25/18; F41A 25/20; F41A 25/22; F41A 25/24; F41A 31/00

USPC ..... 89/44.02, 44.01, 42.01, 42.02, 42.03, 89/43.01, 43.02

See application file for complete search history.

(56) References Cited

U.S. PATENT DOCUMENTS

| | | | | |
|---|---|---|---|---|
| 2,167,672 | A | 8/1939 | Nomar | |
| 2,399,432 | A | 4/1946 | Gazda | |
| 2,413,703 | A | 1/1947 | Fischer | |
| 2,484,053 | A | 10/1949 | Rosenkratz | |
| 2,503,309 | A | 4/1950 | Weiss | |
| 2,512,014 | A | 6/1950 | Eglin | |
| 3,017,807 | A | 1/1962 | Grover | |
| 3,795,998 | A | 3/1974 | Kuhl | |
| 4,046,056 | A | 9/1977 | Carrie | |
| 4,072,082 | A * | 2/1978 | Bates | F41A 9/51 89/162 |
| 4,860,633 | A | 8/1989 | Wiethoff | |
| 4,924,752 | A | 5/1990 | Tassie | |
| 5,127,309 | A * | 7/1992 | Menges | F41A 7/08 89/11 |
| 5,152,724 | A * | 10/1992 | Scheiber | B60T 1/062 188/264 E |
| 8,297,174 | B1 * | 10/2012 | Russell | F41A 25/12 89/37.14 |
| 9,404,718 | B1 * | 8/2016 | Shaver | F41B 9/0046 |
| 9,435,602 | B1 * | 9/2016 | Tomik | F41A 25/10 |
| 2004/0107620 | A1 | 6/2004 | Haefeli | |
| 2006/0011188 | A1 | 1/2006 | Jones | |
| 2010/0269679 | A1 * | 10/2010 | Fisk | F41A 25/08 89/37.11 |
| 2013/0039655 | A1 | 2/2013 | Monks | |
| 2013/0180147 | A1 | 7/2013 | Lupher | |
| 2015/0000169 | A1 | 1/2015 | Righi | |

* cited by examiner

MODULAR AUTOMATED MORTAR WEAPON FOR MOBILE APPLICATIONS

CROSS-REFERENCE TO RELATED APPLICATIONS

This application claims the benefit of under 35 USC § 119(e) of U.S. provisional patent application 62/320,702 filed on Apr. 11, 2016 and is a continuation-in-part of: U.S. patent application Ser. No. 14/596,573 filed on Jan. 14, 2015 and now U.S. Pat. No. 9,435,602; U.S. patent application Ser. No. 14/596,422 filed on Jan. 14, 2015 and now U.S. Pat. No. 9,470,476; and U.S. patent application Ser. No. 14/596,662 filed on Jan. 14, 2015 and now U.S. Pat. No. 9,546,840.

STATEMENT OF GOVERNMENT INTEREST

The inventions described herein may be manufactured, used and licensed by or for the United States Government.

BACKGROUND OF THE INVENTION

The invention relates in general to weapons and in particular to automated mortar and artillery weapons for use in a mobile application.

The ability to engage the enemy and provide effective fired in remote, difficult to access and/or mountainous terrain is increasingly important to armed forces. Many of the existing weapon systems, especially large caliber direct and indirect weapons, lack the mobility and maneuverability to function in areas with limited access.

Additionally, many of the existing large caliber weapon systems require gun crews of between four and six soldiers, who must perform tasks such as preparing ammunition loading, aiming, adjusting and firing the weapon. Generally, while performing these tasks, they are exposed to enemy counterfire. Rough terrain conditions compound the problem of soldier exposure as the ability "shoot and scoot" is greatly diminished.

Current large caliber weapon systems also typically have physical limitations that affect responsiveness. For instance, towed artillery and most mounted and dismounted mortars have very limited firing azimuths and require time-consuming adjustments to engage targets outside these boundaries. Mortar systems are currently designed to engage targets while firing at high angles (above 45°), resulting in longer time of flight and more time required to fire adjusted rounds on target. During this adjustment period, the enemy can flee the immediate area thereby making additional adjustments necessary.

The effectiveness of the weapon's recoil system may help in enhancing the platform mobility, by permitting larger weapons to be mounted on lighter platforms. Traditional hydro-pneumatic recoiling systems are effective in reducing recoil forces by approximately only seventy five percent which permits smaller 155 mm howitzers and 120 mm mortars to be mounted in Stryker vehicles; however, these Stryker vehicles may have limited mobility and maneuverability in confined areas.

Another approach to this problem involves the application of spades or dismounting the weapon. This method effectively transmits the recoiling forces directly to the ground, rather than through the vehicle. The disadvantage of this approach is the added time required to position and lower the weapon.

A need exists for a large caliber weapon which is compatible with light, maneuverable mobile platforms. Additionally, the automation of routine, physically demanding function must be fully exploited, resulting in faster engagements, more accurate fires, less soldier exposure to enemy fire, smaller crew size, and improved shoot-and-scoot capabilities.

SUMMARY OF INVENTION

One aspect of the invention is a method for operating a weapon system with an active recoil control system. The method comprises the steps of: configuring the weapon system; loading the weapon system by loading ammunition of a given type into a magazine comprising ammunition cells; preparing the weapon system for operation by releasing a recoil control brake of the active recoil control system and cocking the active recoil control system for firing; aiming the weapon system by adjusting the azimuth and elevation; and firing the weapon system with a mechanical roller and cam arrangement of the active recoil control system.

A second aspect of the invention involves a weapon system with an active recoil control system for adjusting a weapon recoil. The weapon system is provided a recoiling mass which includes a multi-disc brake, a solenoid, a rack gear, a recoiling mass position encoder and a weapon control unit. The multi-disc brake generates a braking load and further includes a brake shaft and a disc assembly. The disc assembly further comprises stators and rotors. As the disc assembly is subjected to an axial load, a torque is applied on the brake shaft, and a spring that applies a force to a pressure plate. The pressure plate selectively transmits the spring force to the disc assembly, causing the brake to apply a damping force to the recoiling mass. A solenoid controls the operation of the multi-disc brake for adjusting the weapon recoil wherein the solenoid selectively opposes the spring force via the pressure plate, to relieve the spring force transmitted to the disc assembly, in order to allow the brake shaft to spin freely. The rack gear is mounted on the recoiling mass, to permit the braking load to be transmitted to be transmitted to the recoiling mass. The recoiling mass position encoder provides a measured position of the recoiling mass to a weapon control unit. The weapon control unit determines a velocity of the recoiling mass based on the measured position of the recoiling mass, compares the measured position of the recoiling mass and the determined velocity of the recoiling mass with a predicted position and a predicted velocity and selectively provides a power signal to the solenoid based on the difference between the measured position and determined velocity of the recoiling mass and the predicted position and predicted velocity.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 24 includes FIGS. 24A and 24B, wherein FIG. 24A is an enlarged, cross-sectional view of the firing pin locking assembly of FIG. 23 shown in an unlocked state, and wherein

FIG. 25 includes FIGS. 25A and 25B, wherein FIG. 25A is an enlarged, cross-sectional view of the firing pin locking assembly of FIG. 23 shown in a locked state, and wherein

30, illustrating the retention system of the present invention, in accordance with an illustrative embodiment.

Figure 31:
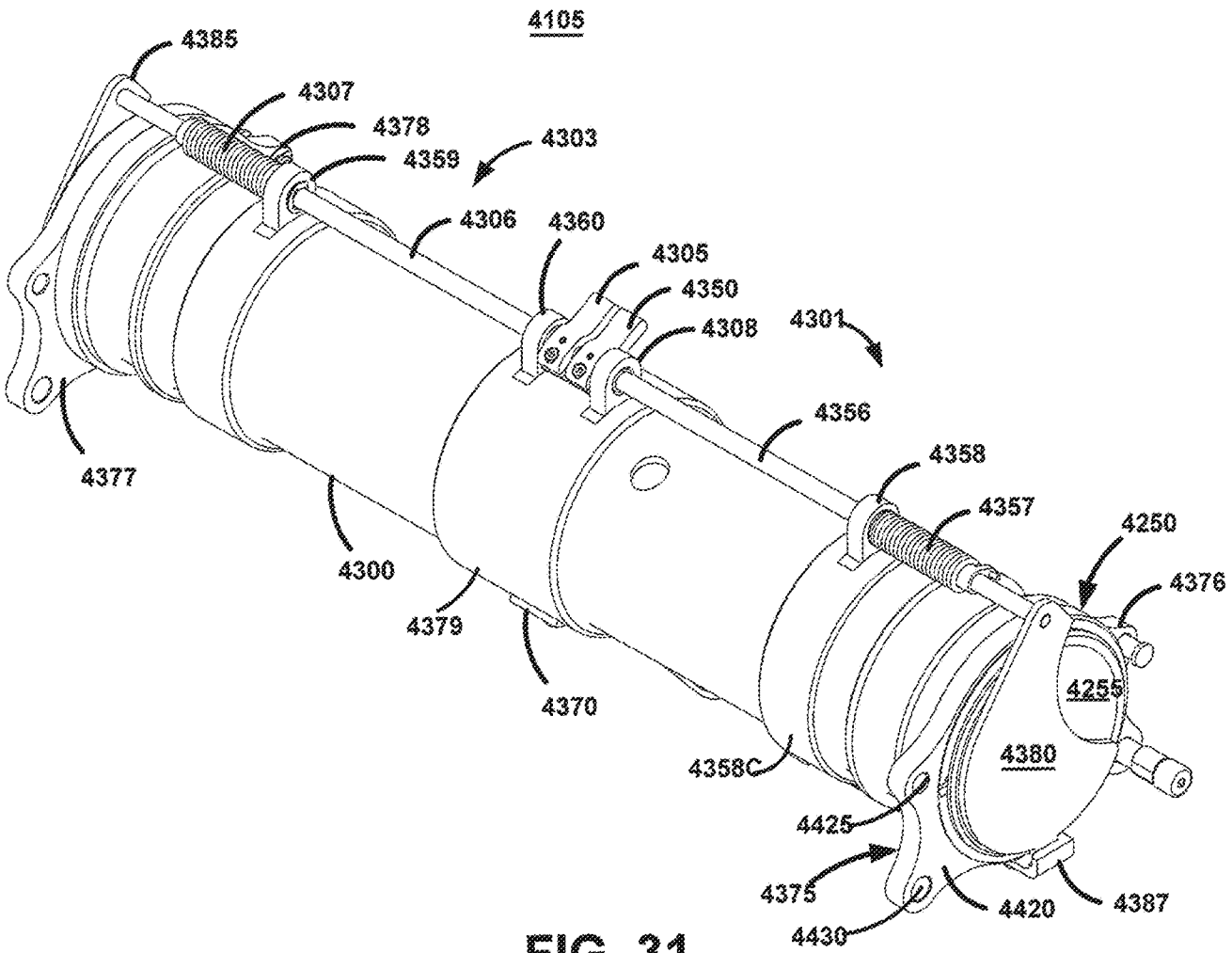

FIG. 31 is an isometric perspective view of the assembled storage cell of FIG. 31, showing a front and rear rotating doors closed, in accordance with an illustrative embodiment.

FIG. 32 includes FIGS. 32A, 32B, 32C, 32D, and 32E, and represents various views of the storage cell of FIG. 31, in accordance with an illustrative embodiment.

Figure 32A:
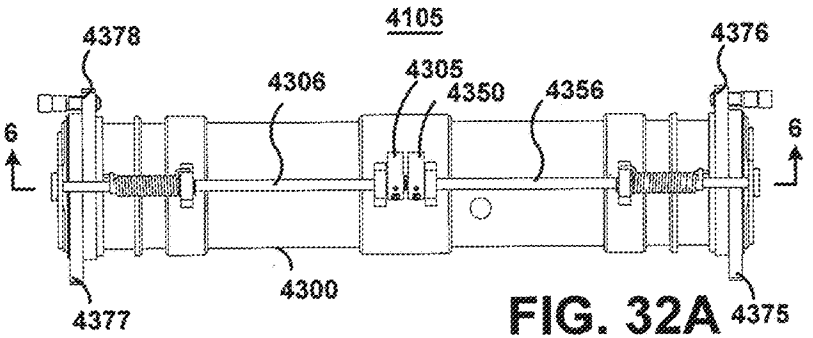
Figure 32B:
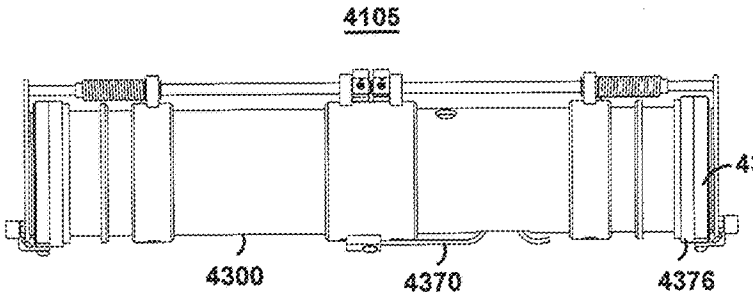
Figure 32C:
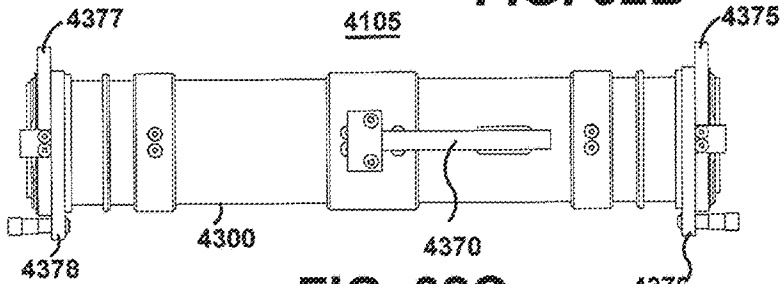
Figure 33:
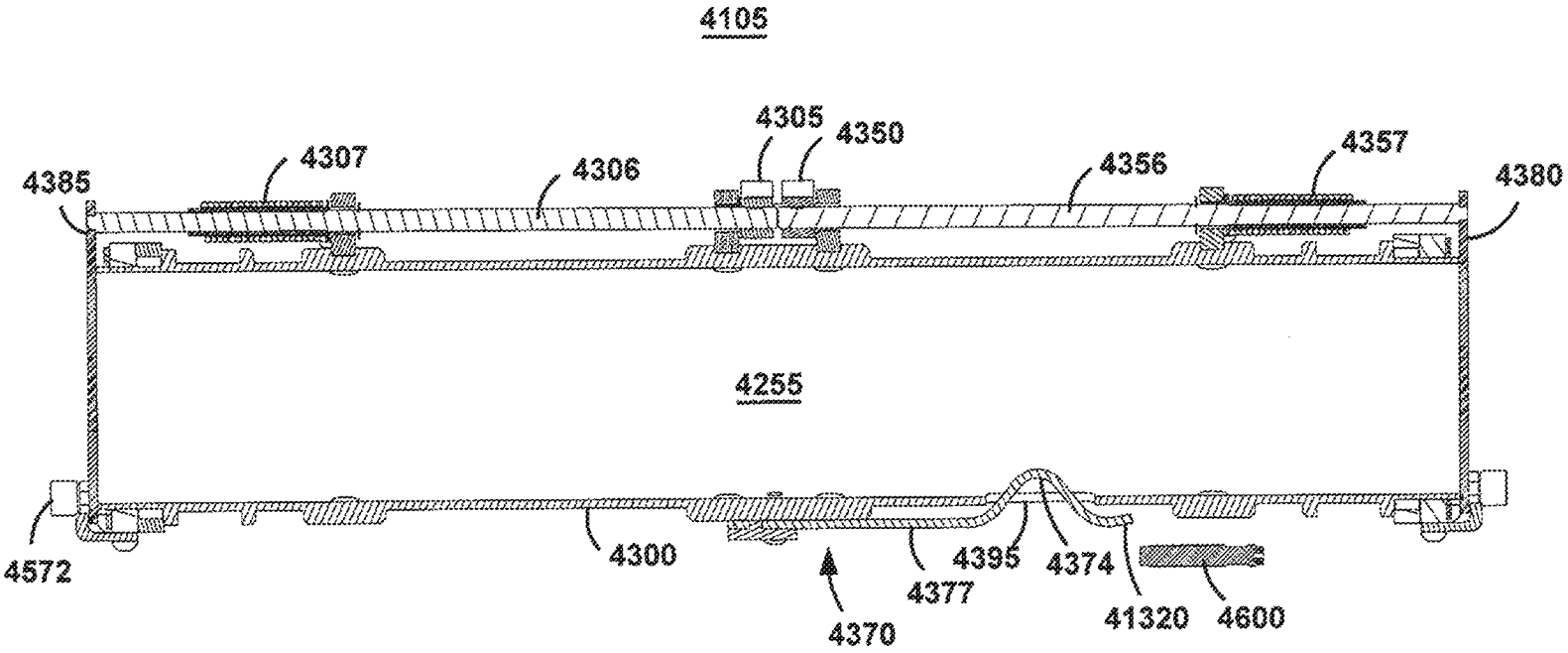

FIG. 33 is an enlarged, cross-sectional view of the storage cell of FIG. 32A, taken along line 6-6 thereof, in accordance with an illustrative embodiment.

Figure 30:
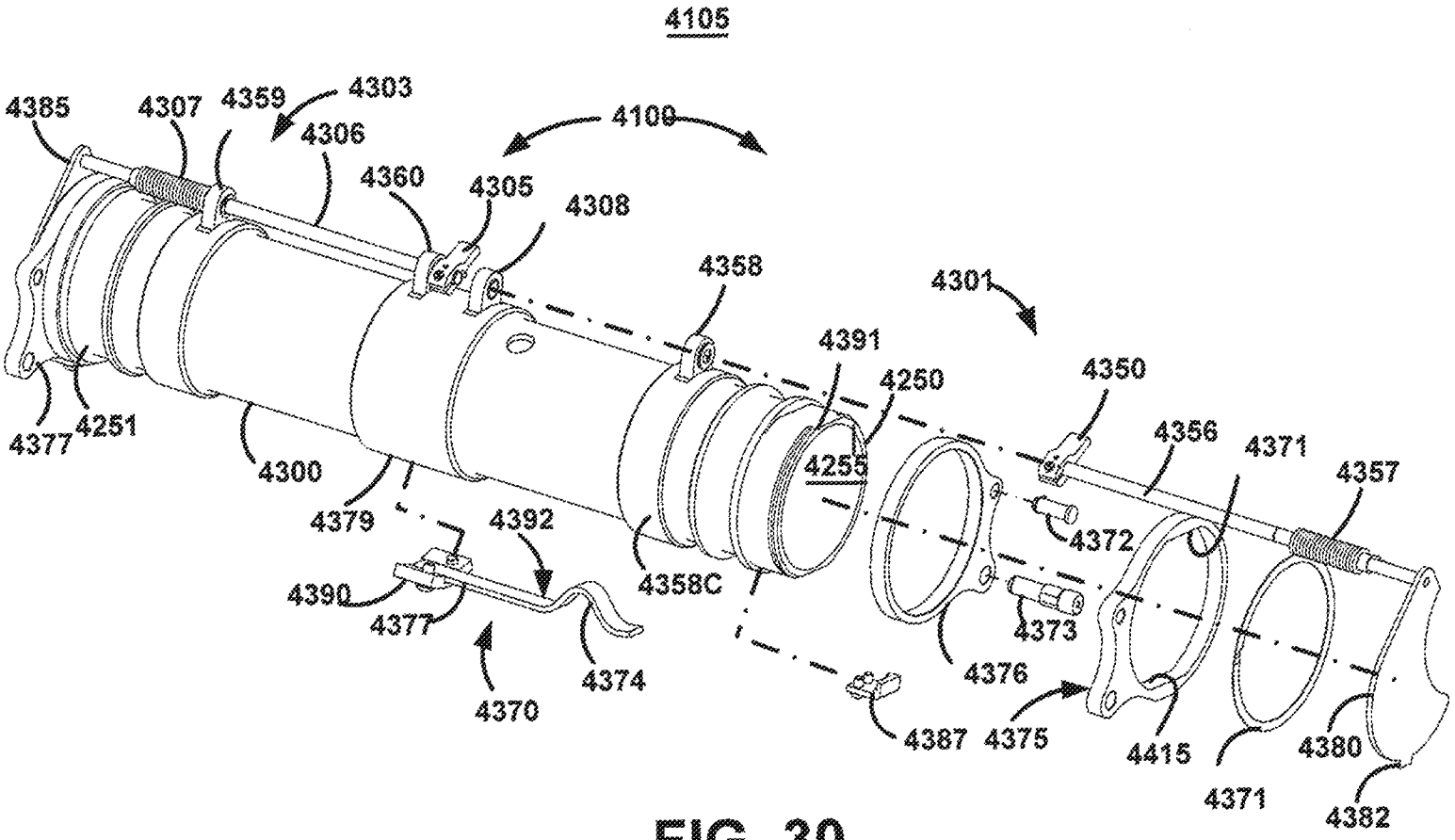
FIG. 30 is a partly exploded view of a storage cell that forms part of the ammunition feeding mechanism of FIG.
Figure 34:
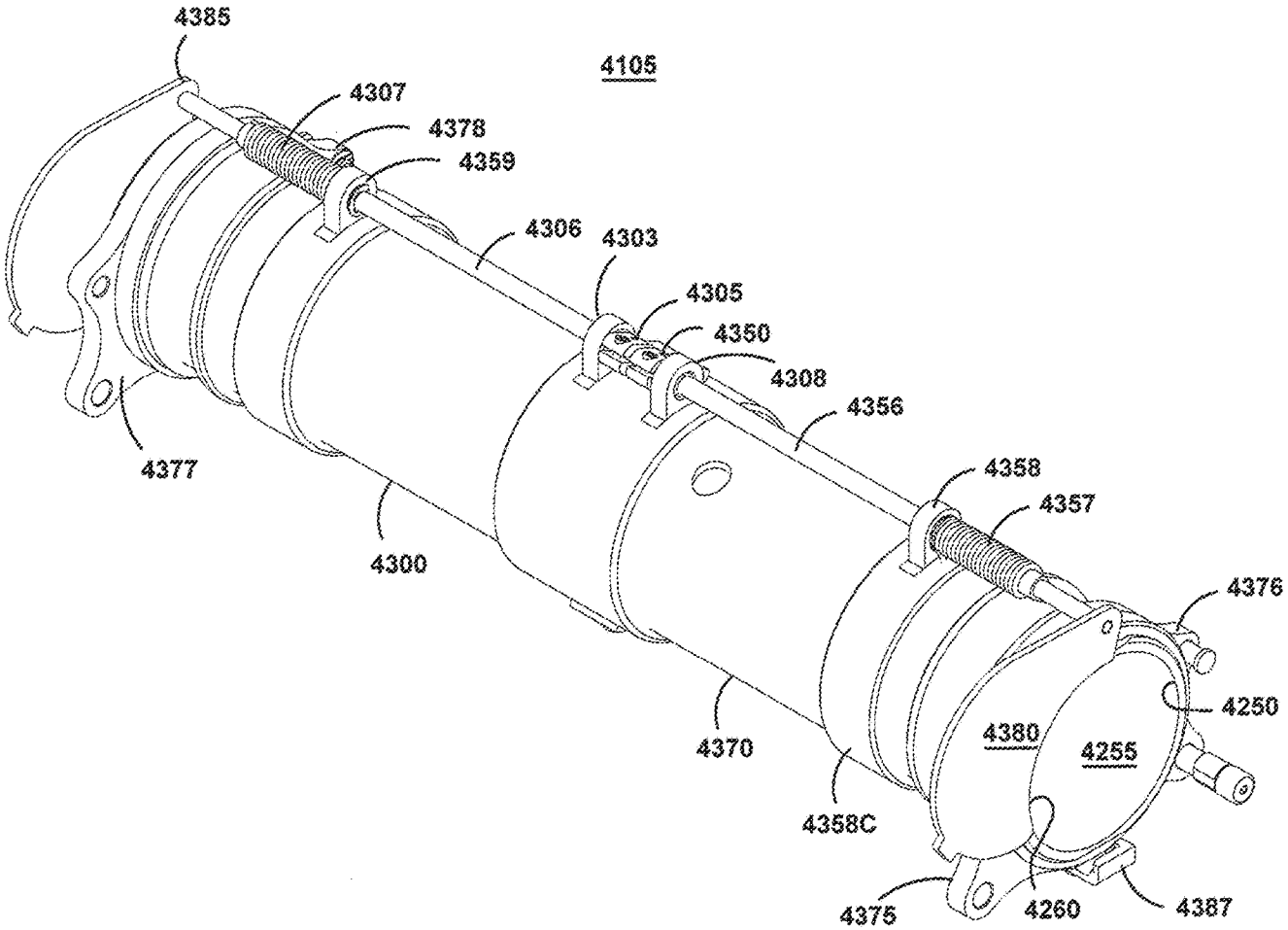

FIG. 34 is an isometric perspective view of the storage cell of FIG. 30, showing the front and rear rotating doors open, in accordance with an illustrative embodiment.

FIG. 35 includes FIGS. 35A, 35B, 35C, 35D, and 35E, and represents various views of the storage cell of FIG. 34, in accordance with an illustrative embodiment.

Figure 36:
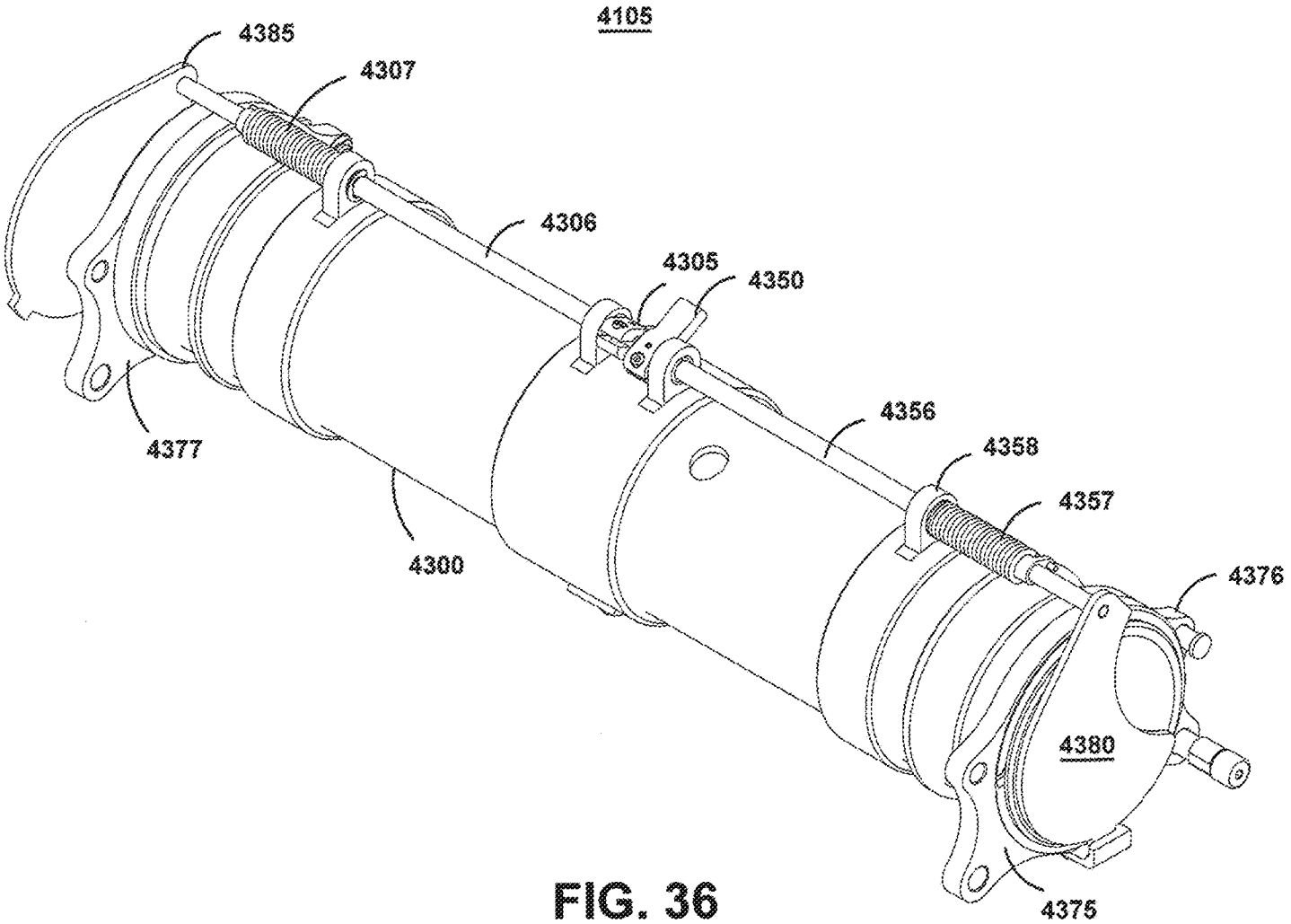
Figure 37A:
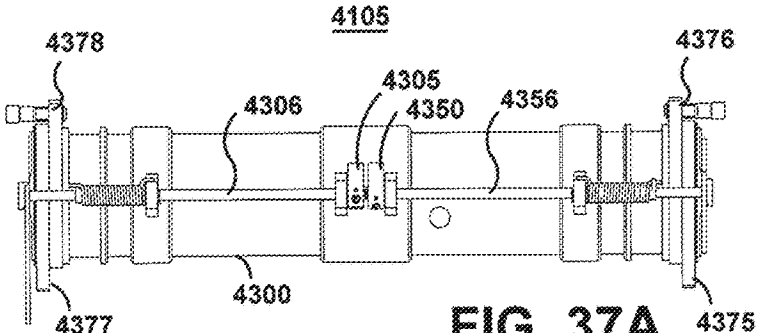
Figure 37B:
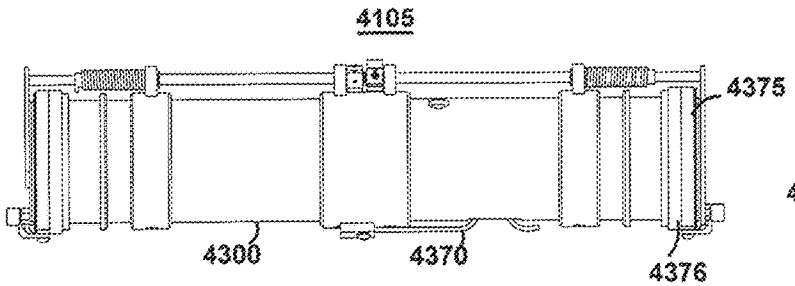
Figure 37C:
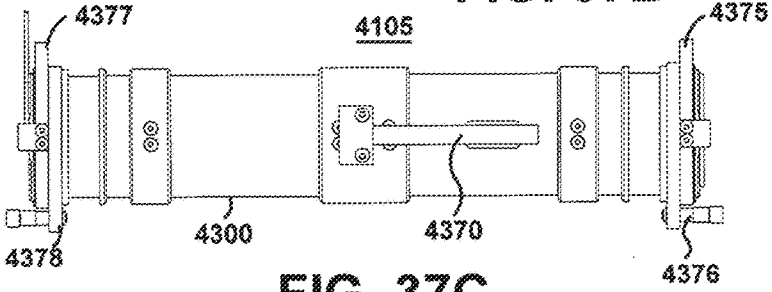
Figure 37D:
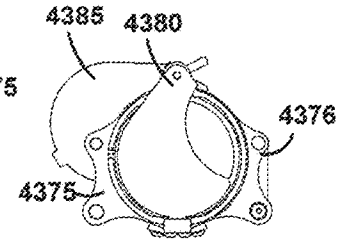
Figure 37E:
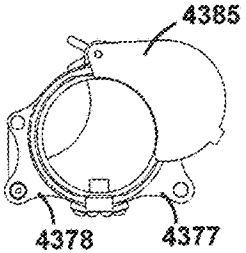

FIG. 36 is an isometric perspective view of the storage cell of FIG. 30, showing the front rotating closed and the rear rotating door open, in accordance with an illustrative embodiment.

FIG. 37 includes FIGS. 37A, 37B, 37C, 37D, and 37E, and represents various views of the storage cell of FIG. 36, in accordance with an illustrative embodiment.

Figure 38:
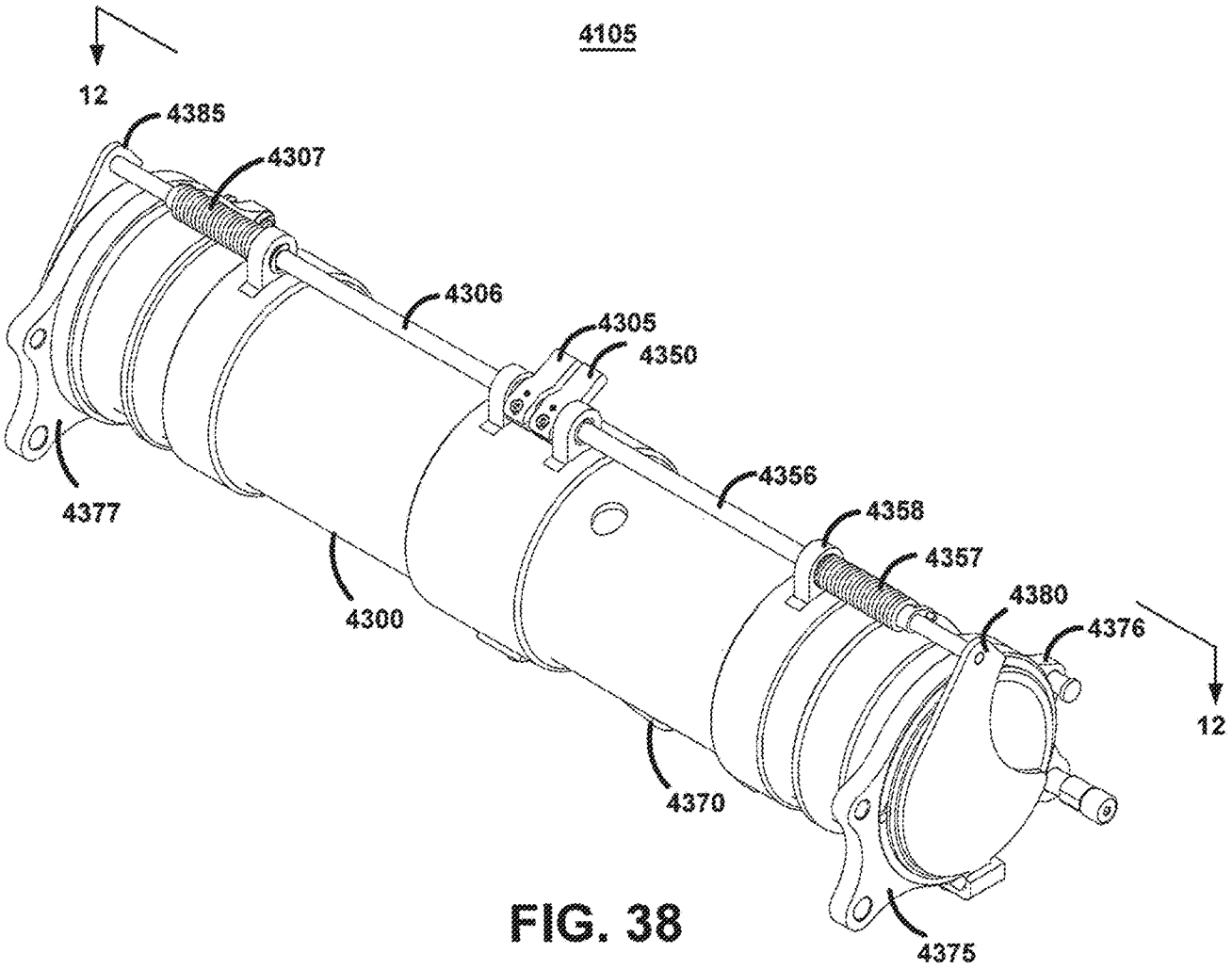

FIG. 38 is an isometric perspective view of the storage cell of FIG. 30, shown in a loaded state, with both the front and rear rotating doors closed, in accordance with an illustrative embodiment.

Figure 39A:
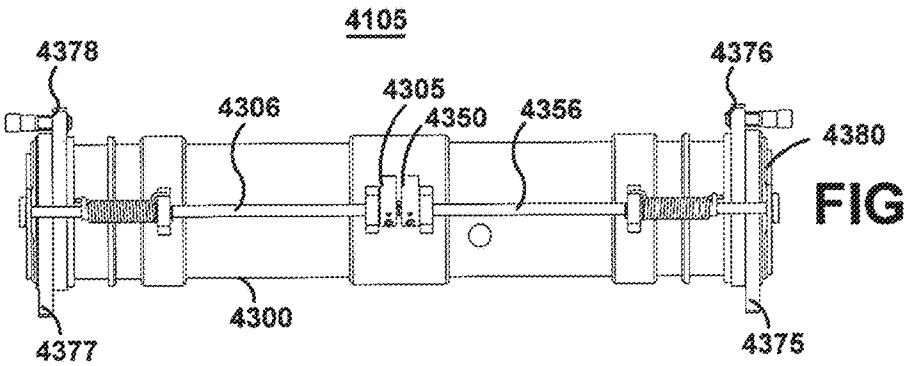
Figure 39B:
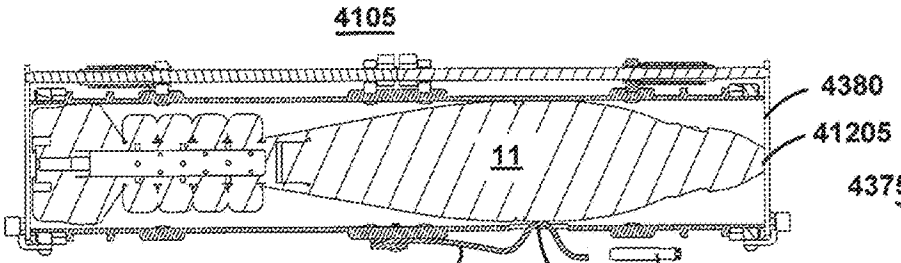
Figure 39D:
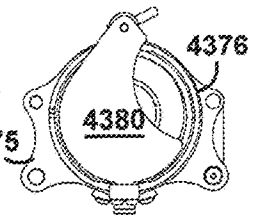
Figure 39C:
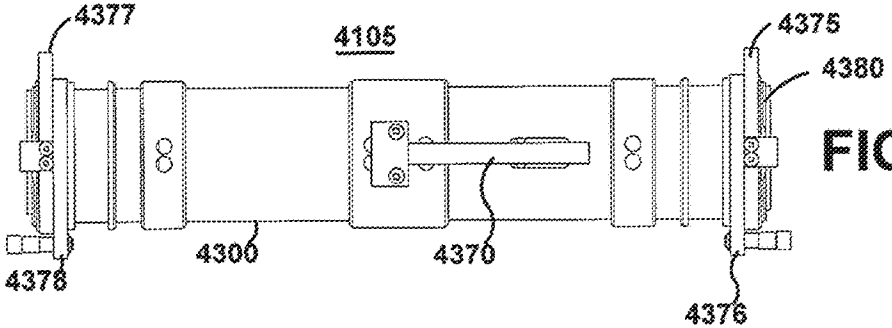
Figure 39E:
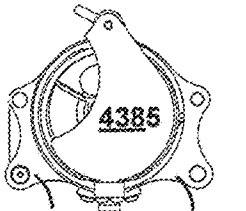

FIG. 39 includes FIGS. 39A, 39B, 39C, 39D, and 39E, and represents various views of the storage cell of FIG. 38, with FIG. 39B being a cross-sectional view of the storage cell of FIG. 38, taken along line 12-12 thereof, in accordance with an illustrative embodiment.

Figure 40:
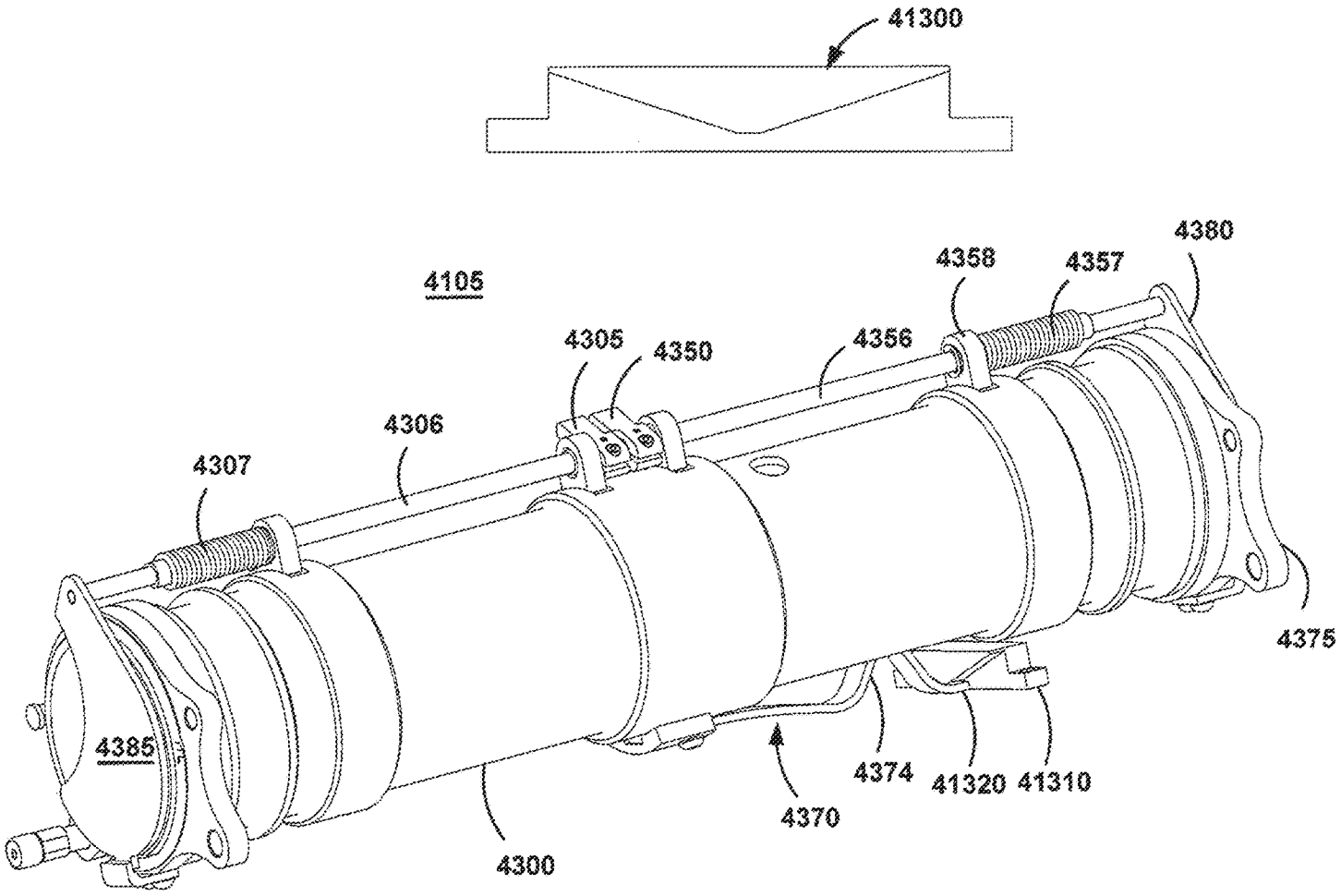

FIG. 40 is an isometric perspective view of the storage cell of FIG. 31, further illustrating the retraction of the clamping spring by the cam, in accordance with an illustrative embodiment.

Figure 41:
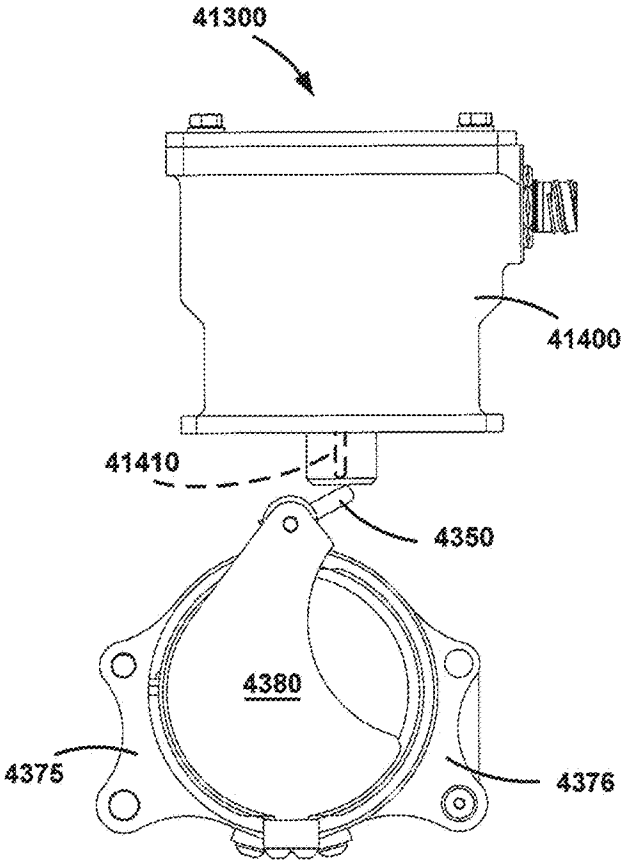

FIG. 41 is a front view of the storage cell of FIG. 40, illustrating a plunger of a firing solenoid actuator in a retracted position, with the front rotating door closed, in accordance with an illustrative embodiment.

Figure 42:
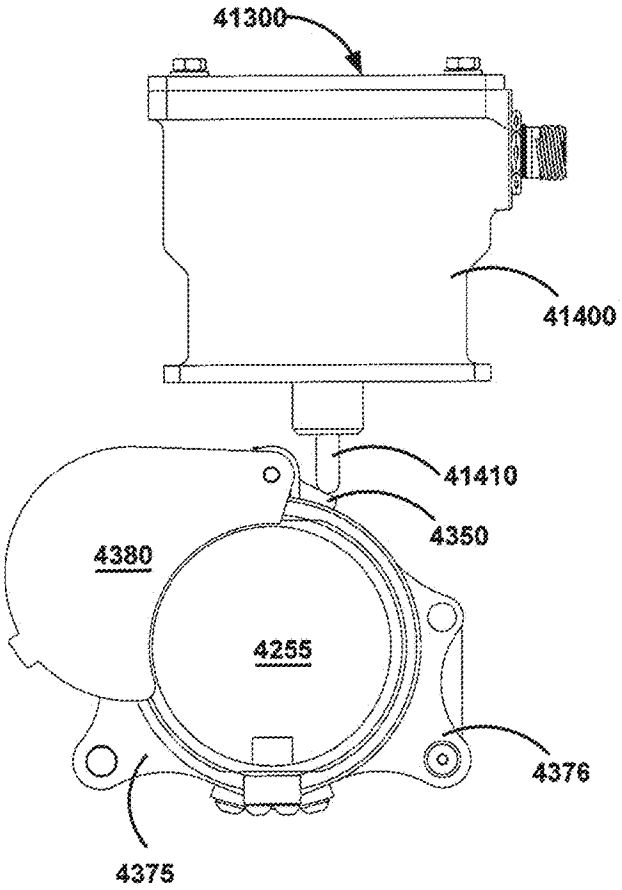

FIG. 42 is a front view of the storage cell of FIG. 41, illustrating the plunger of the firing solenoid actuator of FIG. 41 in an extended (or deployed) position, causing the front and rear rotating doors to open, in accordance with an illustrative embodiment.

Figure 29:
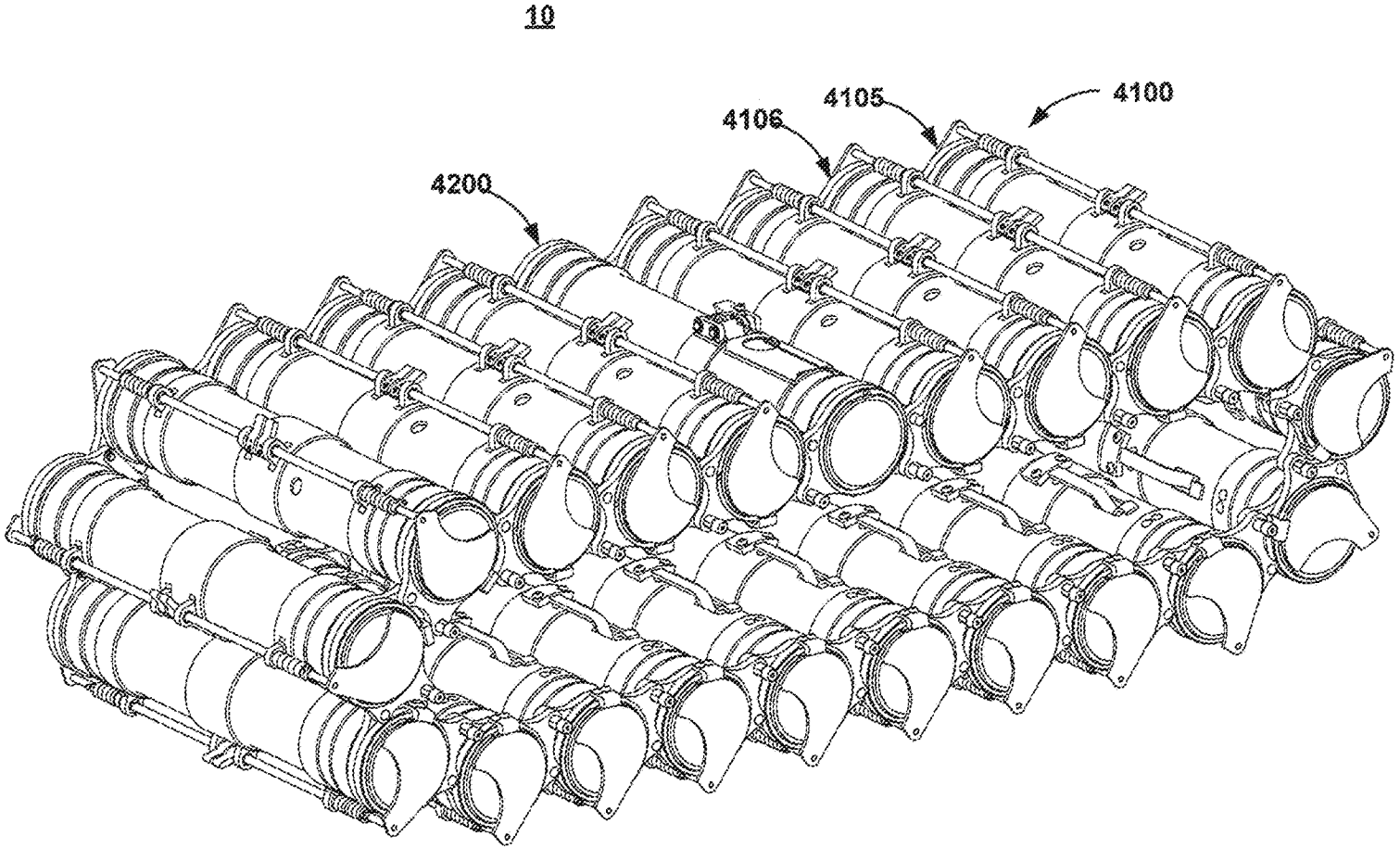
FIG. 29 is an isometric perspective view of the ammunition feeding mechanism shown in FIG. 1, such as a rotating, continuous belt-type magazine of the automated weapon, wherein the ammunition feeding mechanism is formed of a plurality of interconnected storage cells, each of which embodies a retention system according to an embodiment of the present invention, and one gun tube clearance cell which ensures that that the gun tube of the automated weapon is clear and unobstructed, in accordance with an illustrative embodiment.
Figure 43:
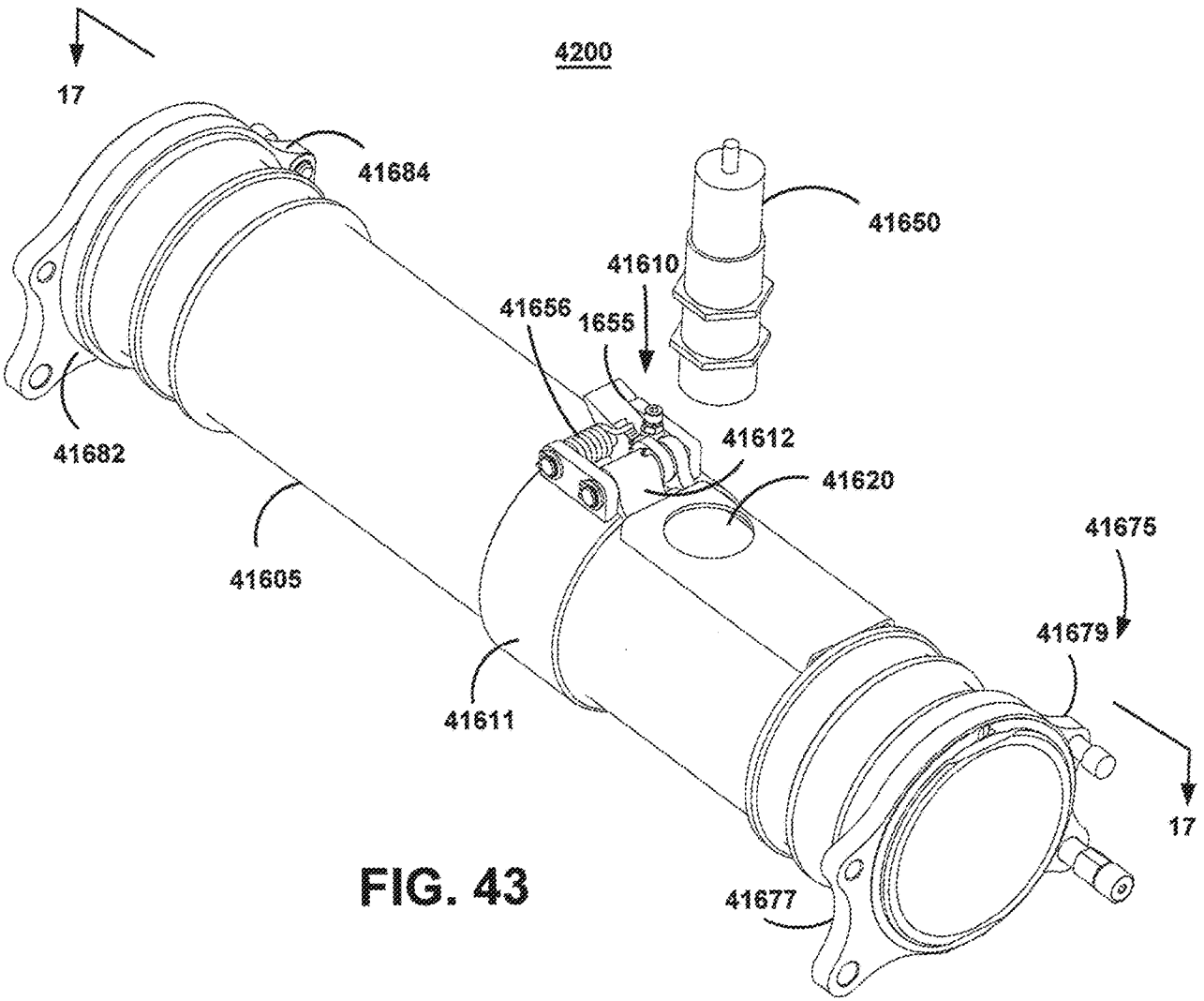

FIG. 43 is an isometric perspective view of the gun tube clearance cell of FIG. 29, further illustrating an ultrasonic source in a deactivated state, in accordance with an illustrative embodiment.

Figure 44:
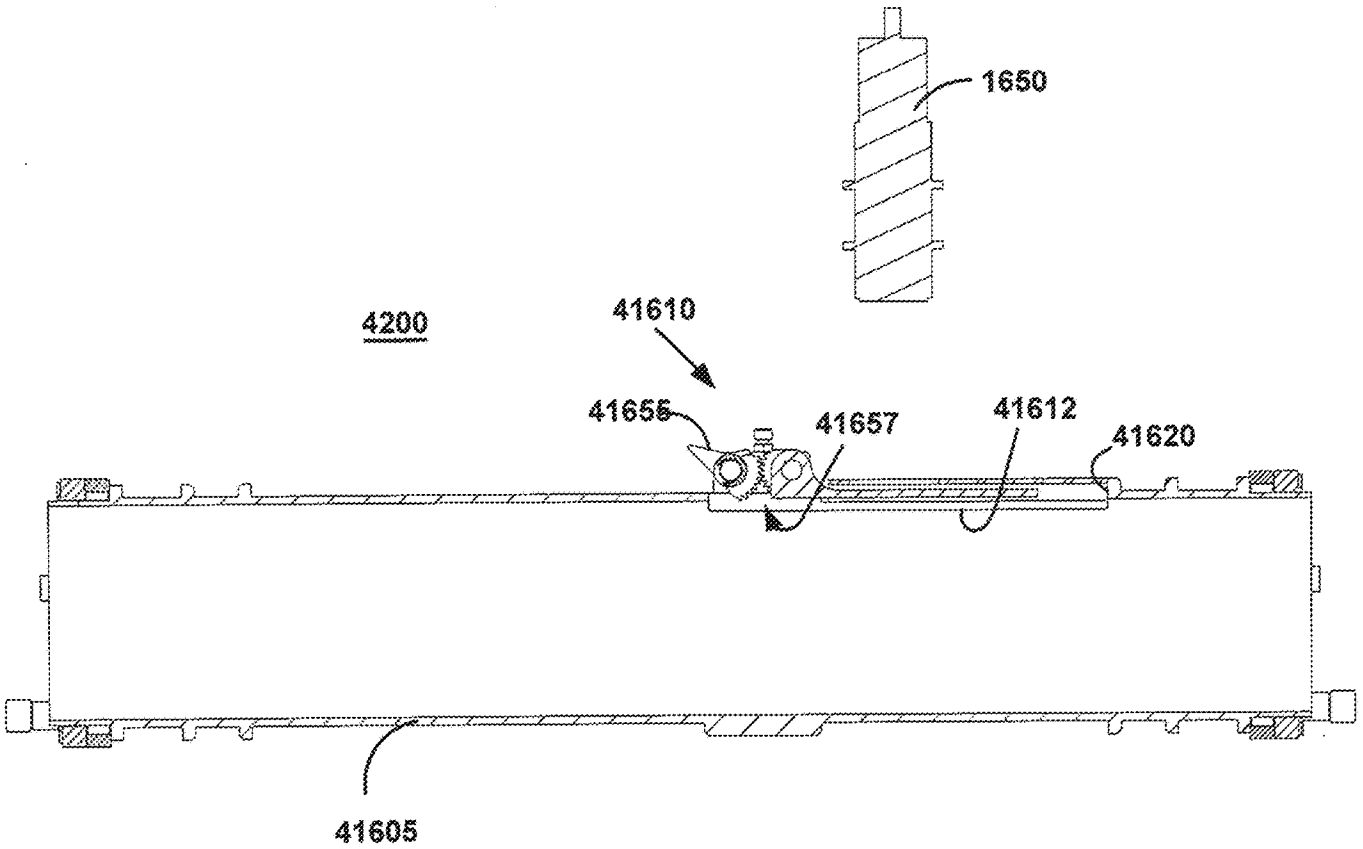

FIG. 44 is a cross-sectional, side view of the gun tube clearance cell and the ultrasonic source of FIG. 43, taken along line 17-17 thereof, in accordance with an illustrative embodiment.

Figure 45:
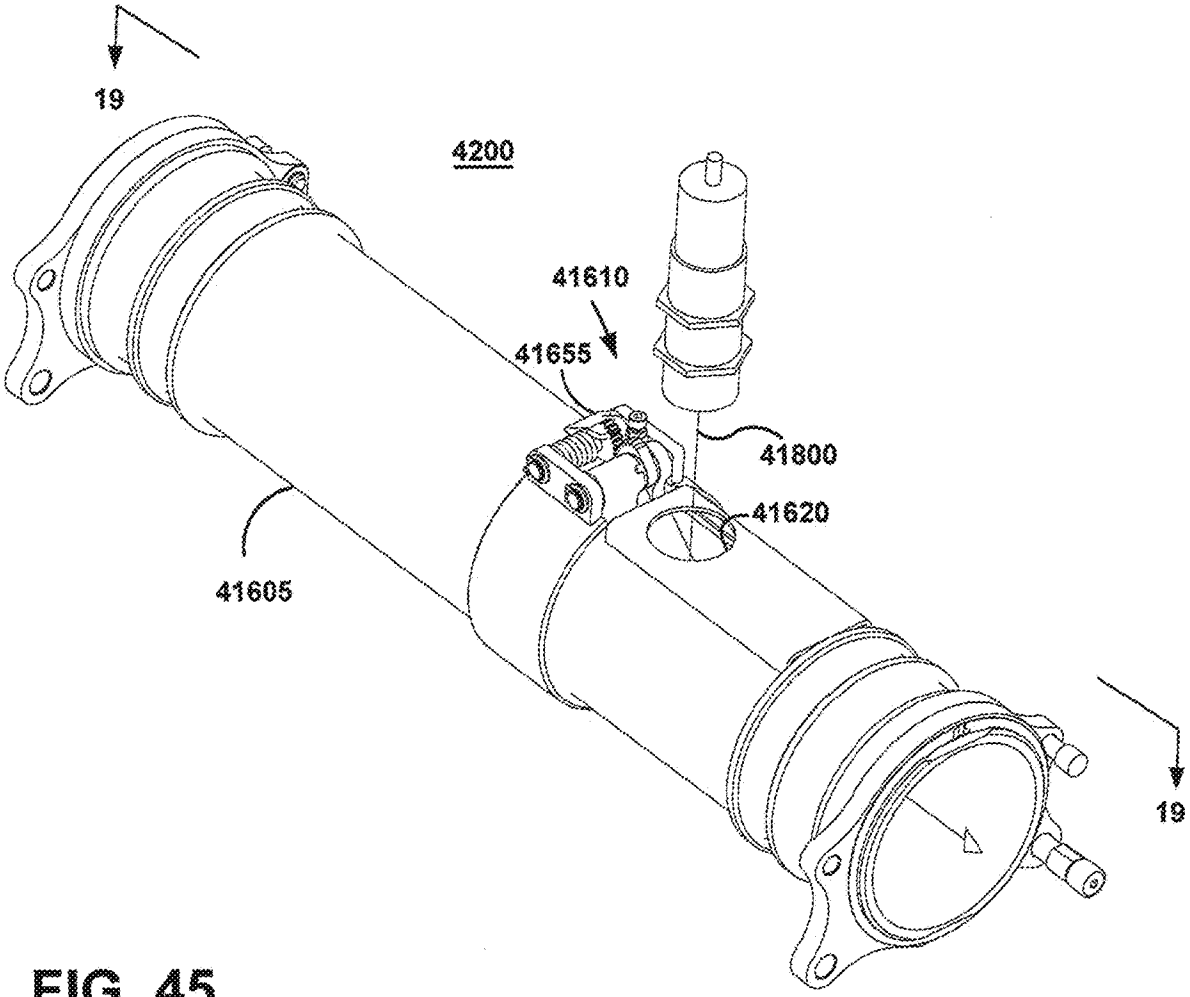

FIG. 45 is an isometric perspective view of the gun tube clearance cell of FIGS. 43 and 44, further illustrating the ultrasonic source in an activated state, in accordance with an illustrative embodiment.

Figure 46:
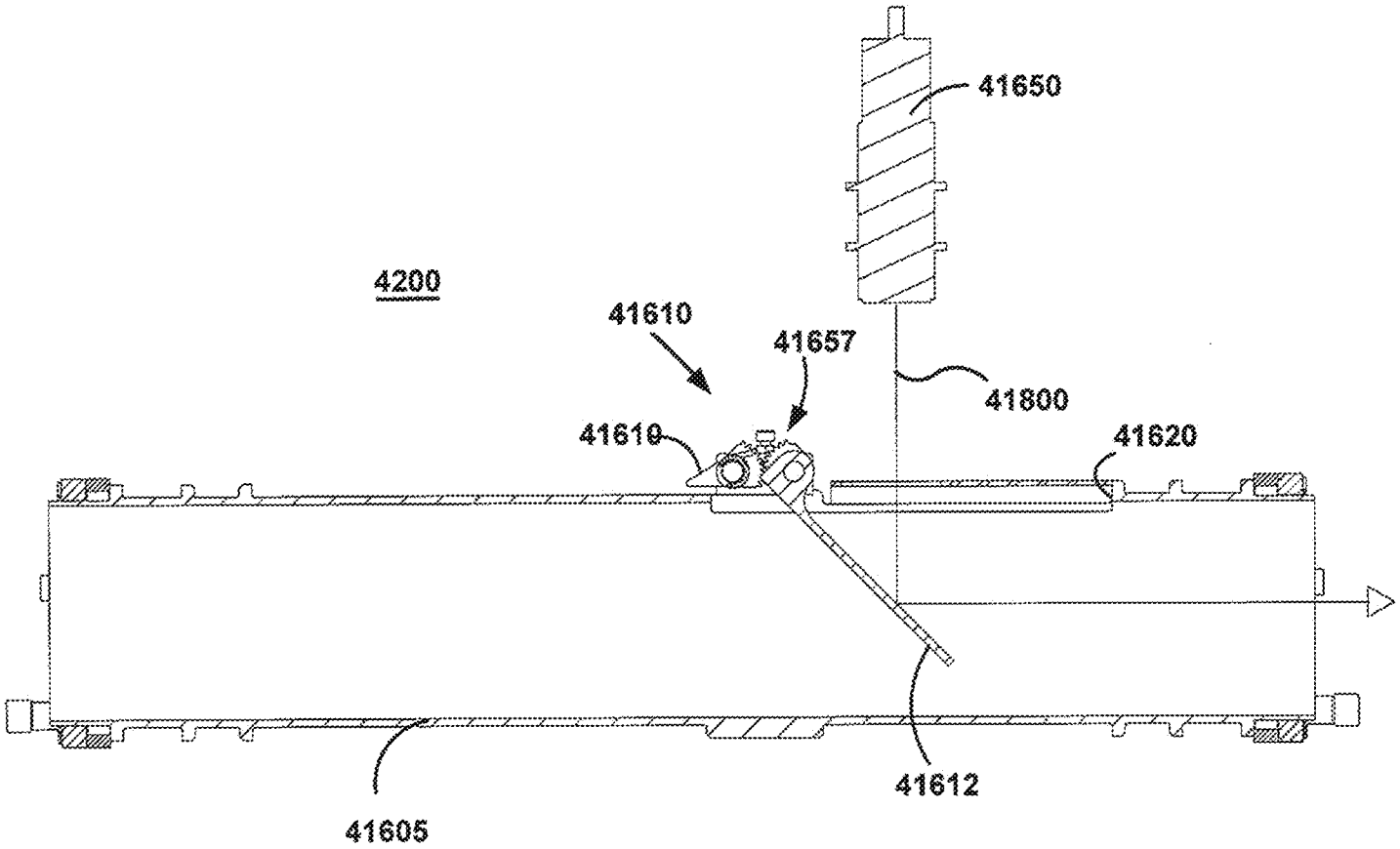

FIG. 46 is a cross-sectional, side view of the gun tube clearance cell and the ultrasonic source of FIG. 45, taken along line 19-19 thereof, in accordance with an illustrative embodiment.

Figure 47:
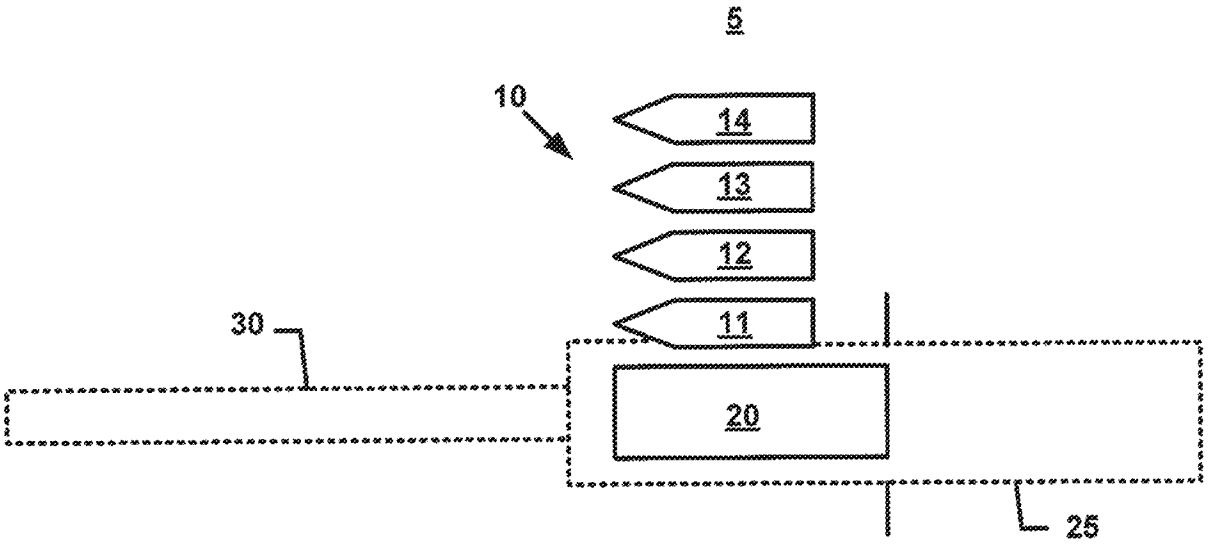

FIG. 47 is a schematic view of the automated weapon of FIG. 1, showing the recoiling mass of the automated weapon stowed inside the gun tube clearance cell of FIGS. 42 through 46, in accordance with an illustrative embodiment.

Figure 2:
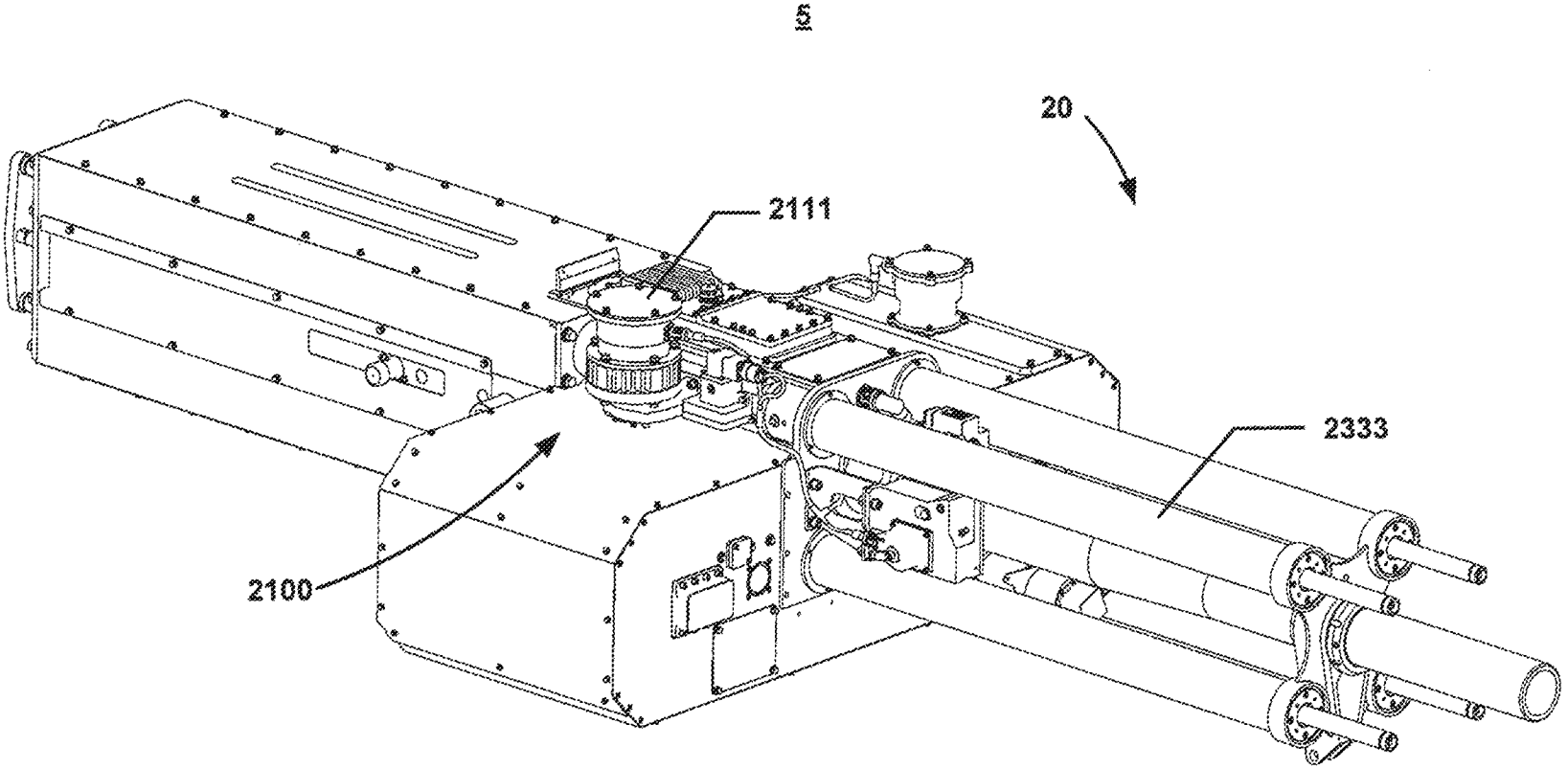
FIG. 2 is an isometric perspective view of an automated weapon system, illustrating the active recoil control system mounted thereon, for adjusting the damping force of a recoil brake during recoil and counter-recoil strokes, in accordance with an illustrative embodiment of the invention.
Figure 3:
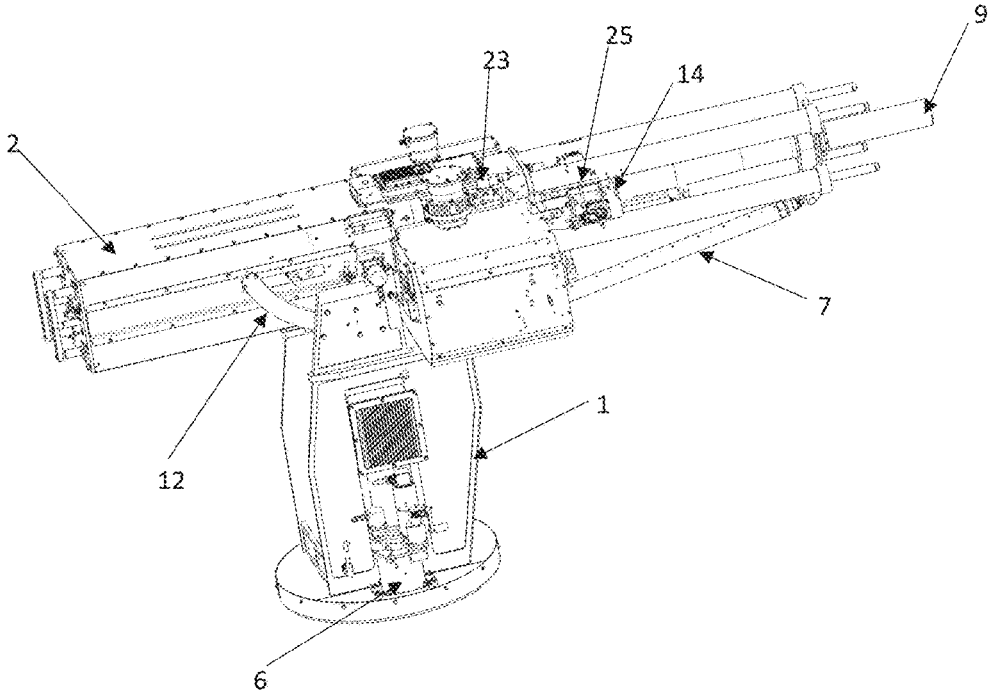
FIG. 3 is a left side perspective view of an automated weapon system, in accordance with an illustrative embodiment.
Figure 4:
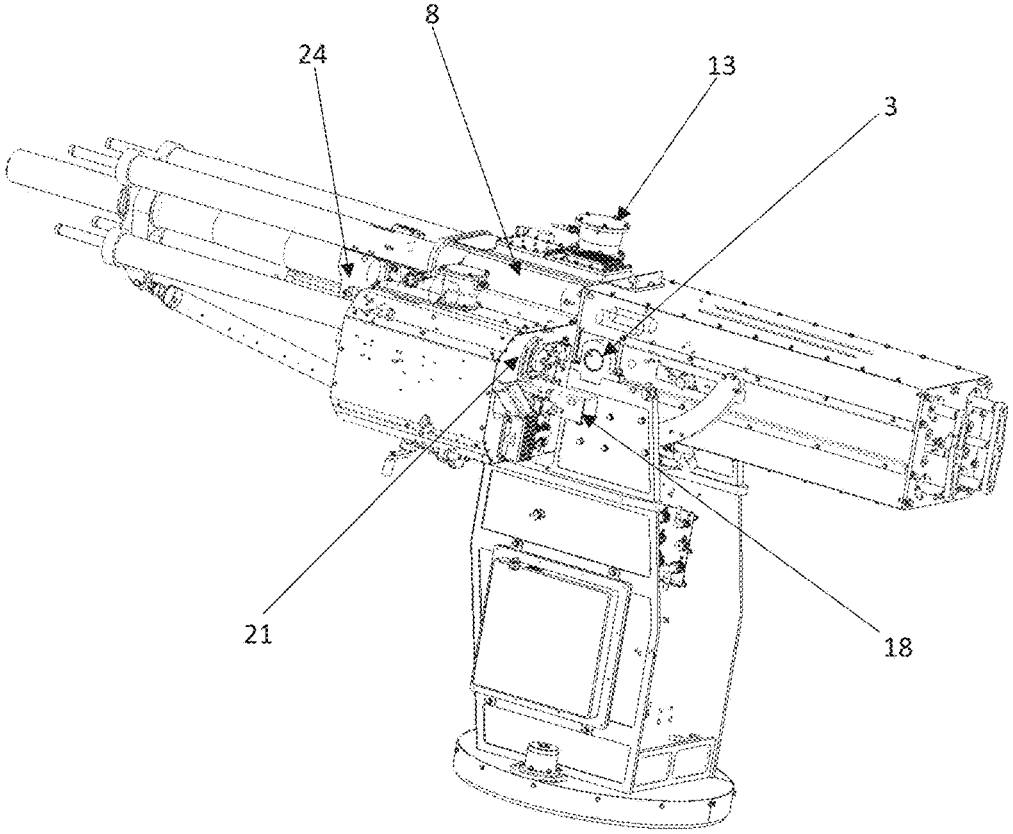
FIG. 4 is a right side perspective view of an automated weapon system, in accordance with an illustrative embodiment.
Figure 5:
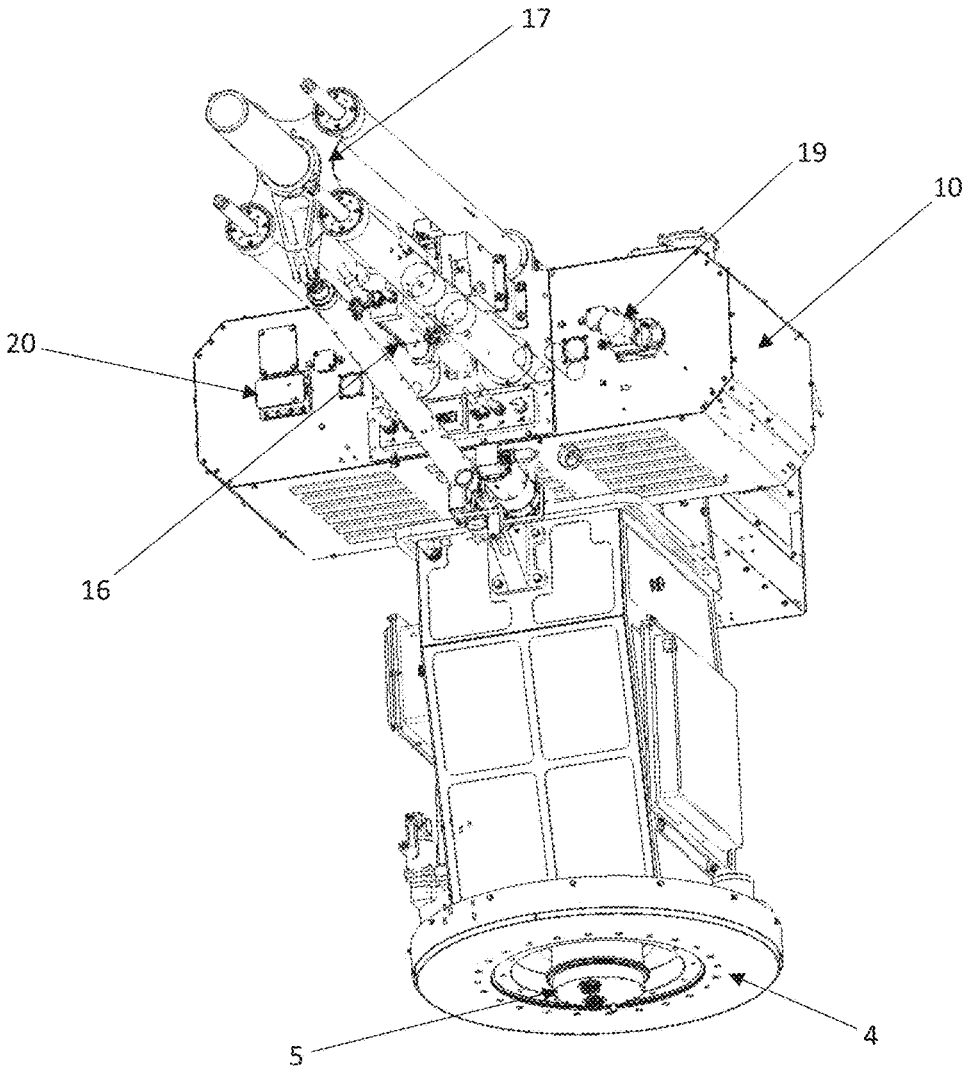
FIG. 5 is a front perspective view of an automated weapon system, in accordance with an illustrative embodiment of the invention.
Figure 6:
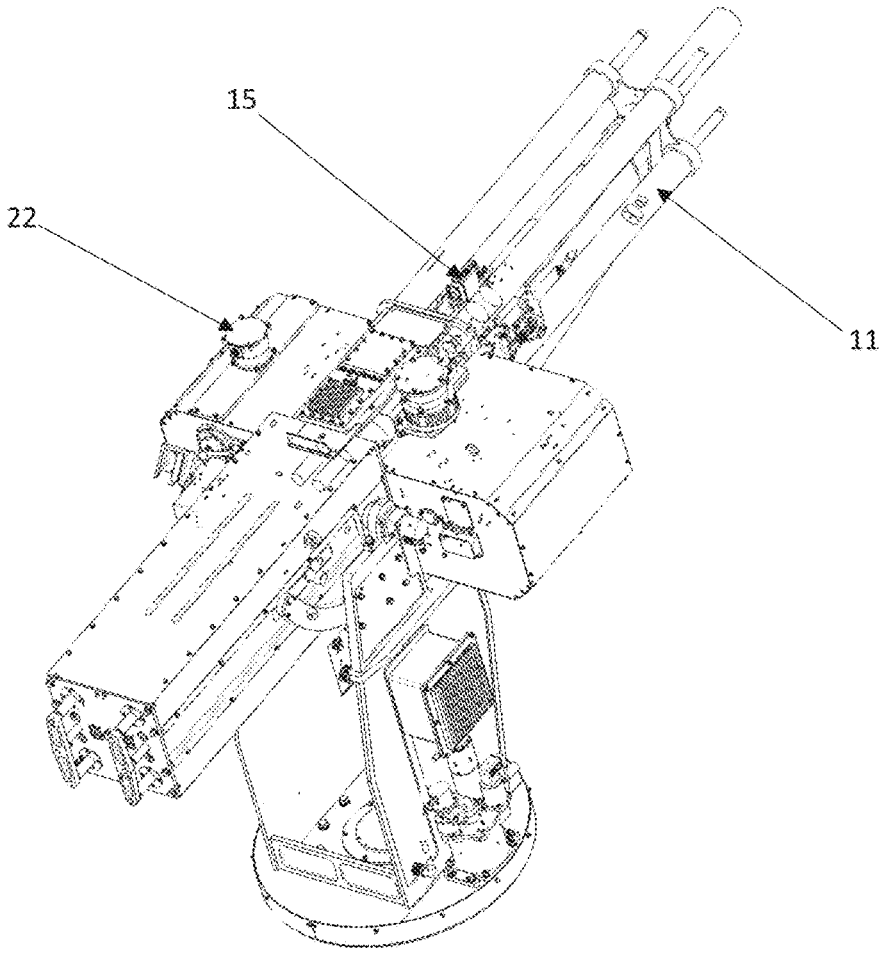
FIG. 6 is a back perspective view of an automated weapon system, in accordance with an illustrative embodiment of the invention.
Figure 48A:
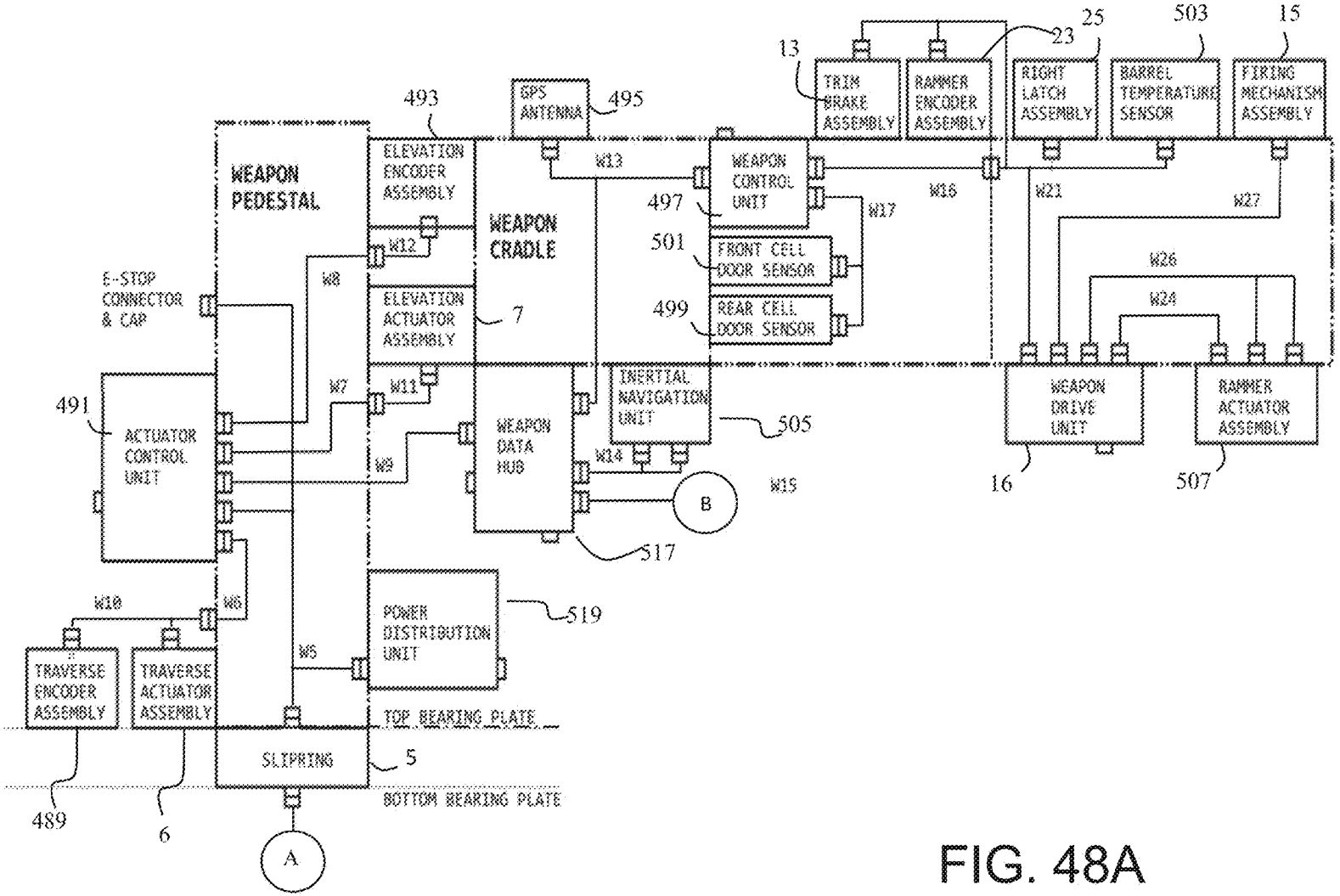
Figure 48B:
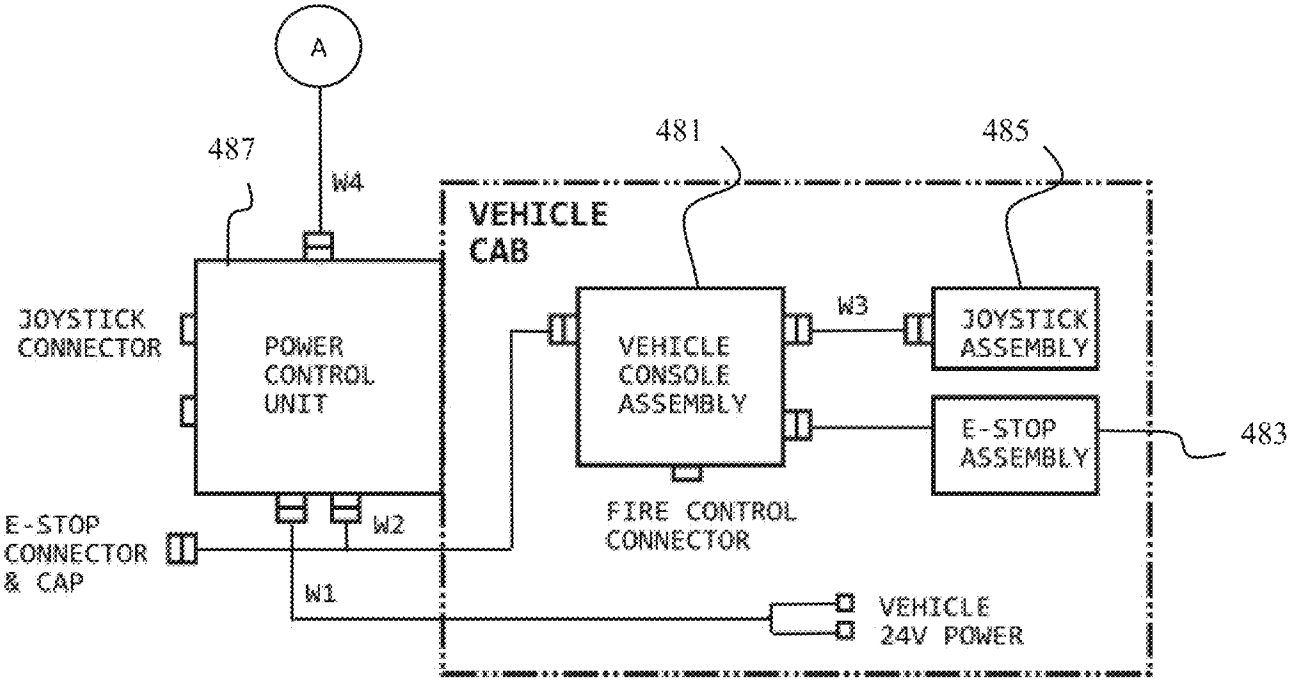
Figure 48C:
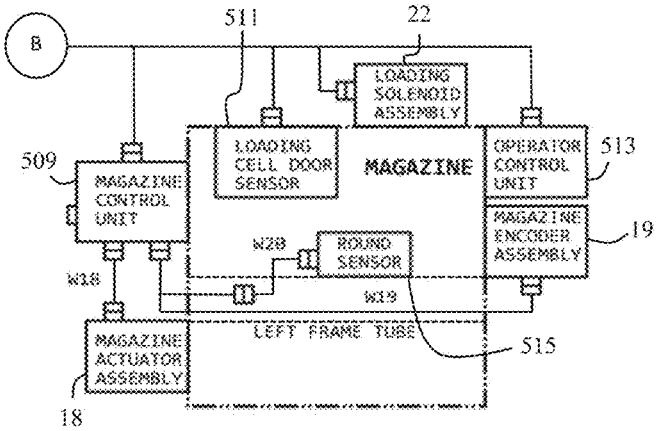

FIG. 48 includes FIGS. 48A, 48B, and 48C and is an interconnect diagram representing the actuator control system of the automated weapon of FIG. 2, in accordance with an illustrative embodiment.

Figure 49:
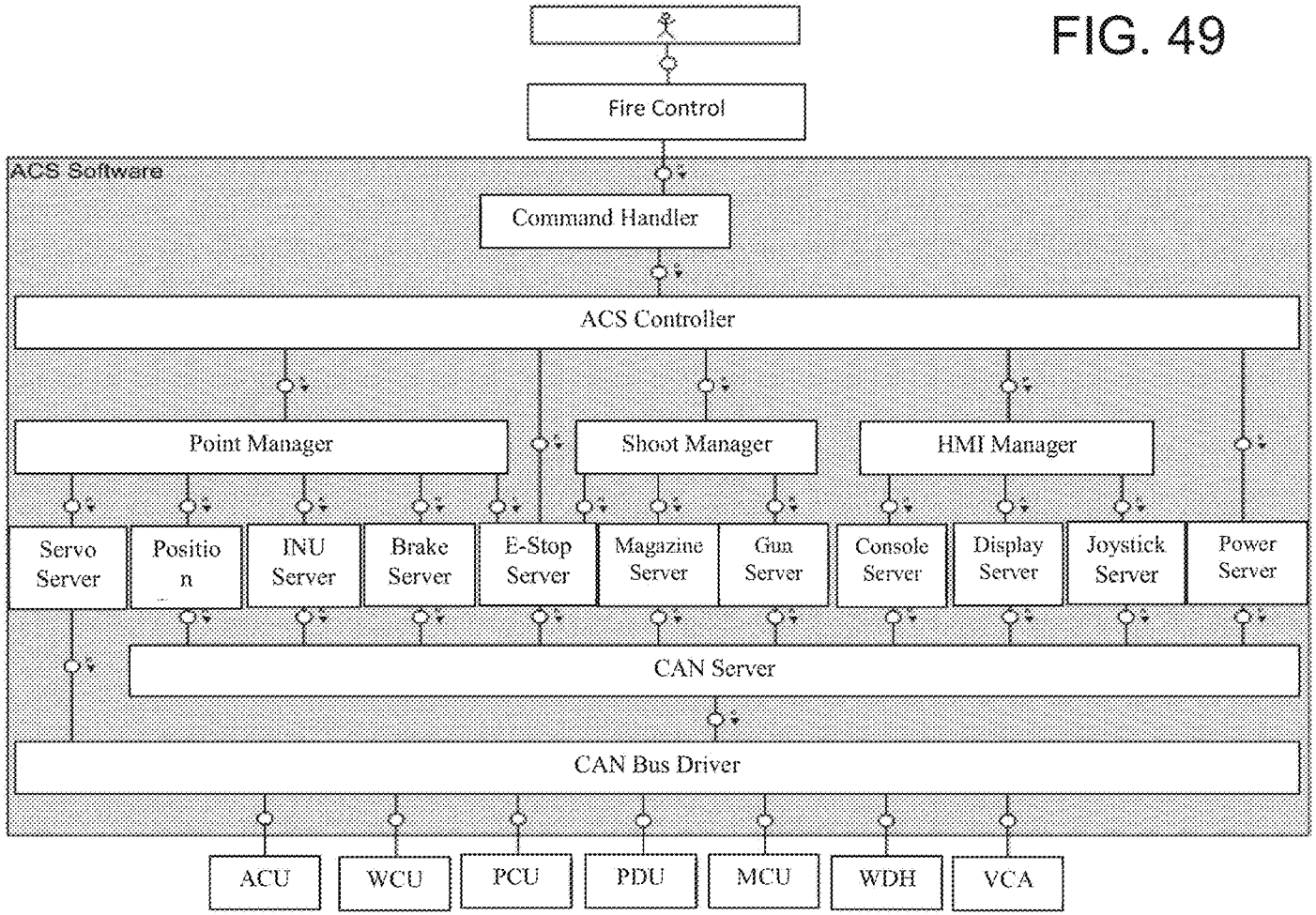

FIG. 49 is a data flow diagram representing the flow of data among the software components of the automated weapon system of FIG. 2, in accordance with an illustrative embodiment.

Figure 50:
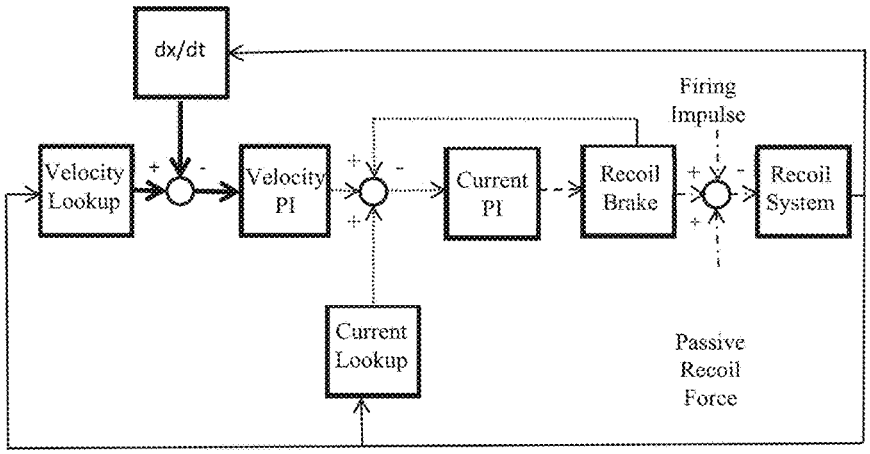
Figure 50:
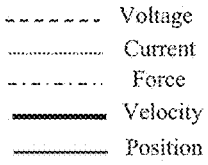

FIG. 50 is a block diagram illustrating a control loop of the active recoil control system, in accordance with an illustrative embodiment of the invention.

Figure 51:
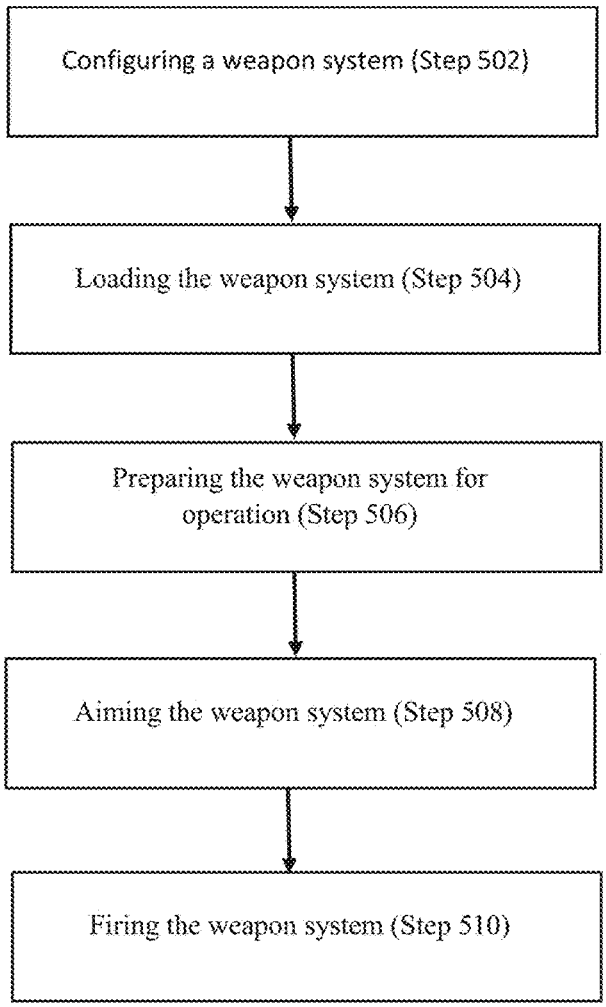

FIG. 51 is a flowchart illustrating a method for operating the automated weapon system of FIG. 2, in accordance with an illustrative embodiment.

Figure 52:
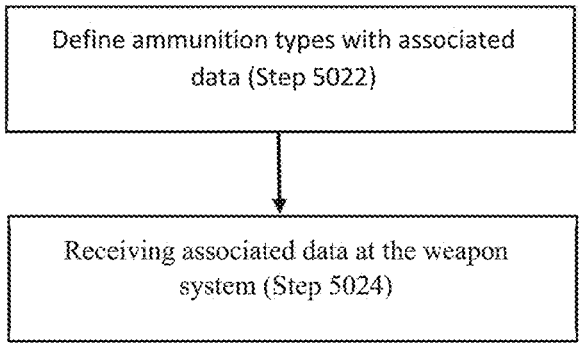

FIG. 52 is a flowchart illustrating a method for configuring the automated weapon system of FIG. 2, in accordance with an illustrative embodiment.

Figure 53:
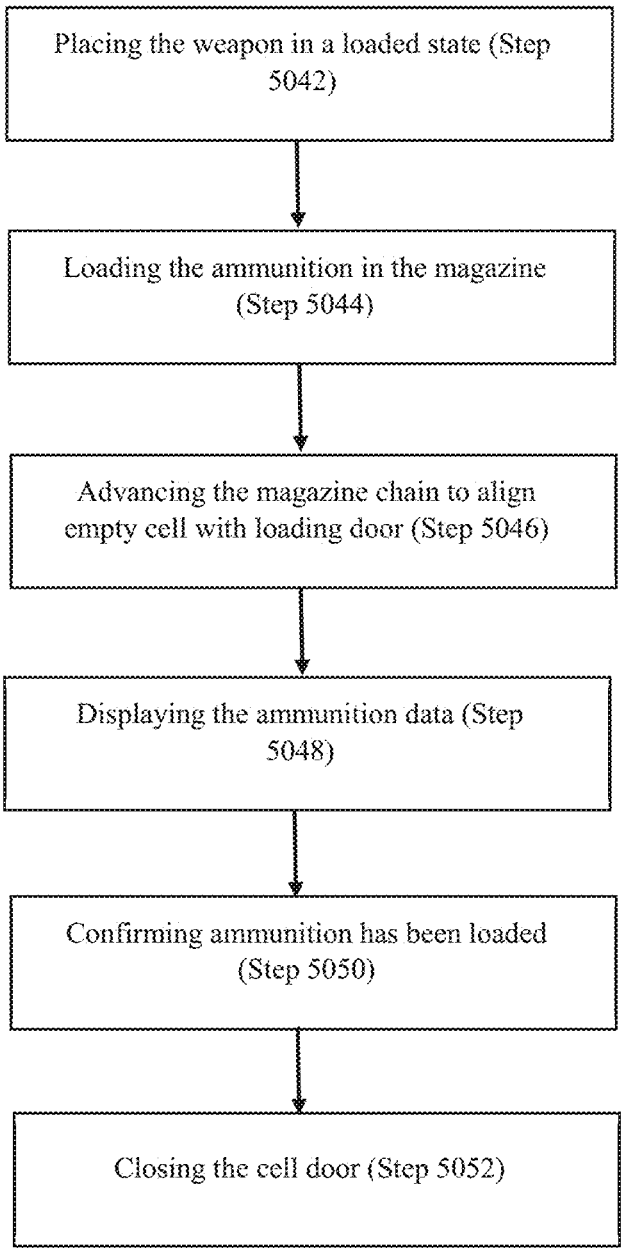

FIG. 53 is a flowchart illustrating a method for loading the automated weapon system of FIG. 2, in accordance with an illustrative embodiment.

Figure 54:
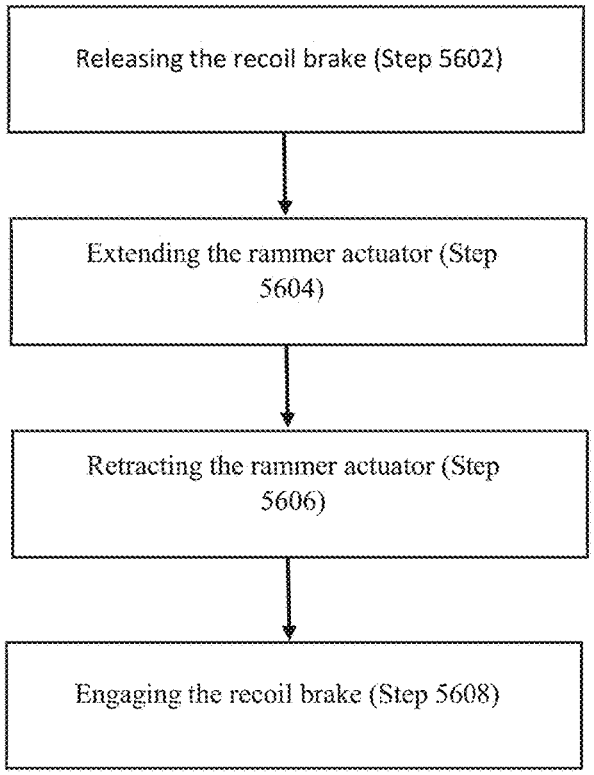

FIG. 54 and is a flowchart illustrating a method for preparing the automated weapon system of FIG. 2, in accordance with an illustrative embodiment.

Figure 55:
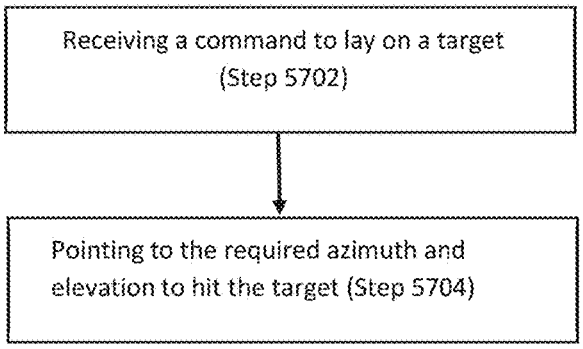

FIG. 55 is a flowchart illustrating a method for aiming the automated weapon system of FIG. 2, in accordance with an illustrative embodiment.

Figure 56A:
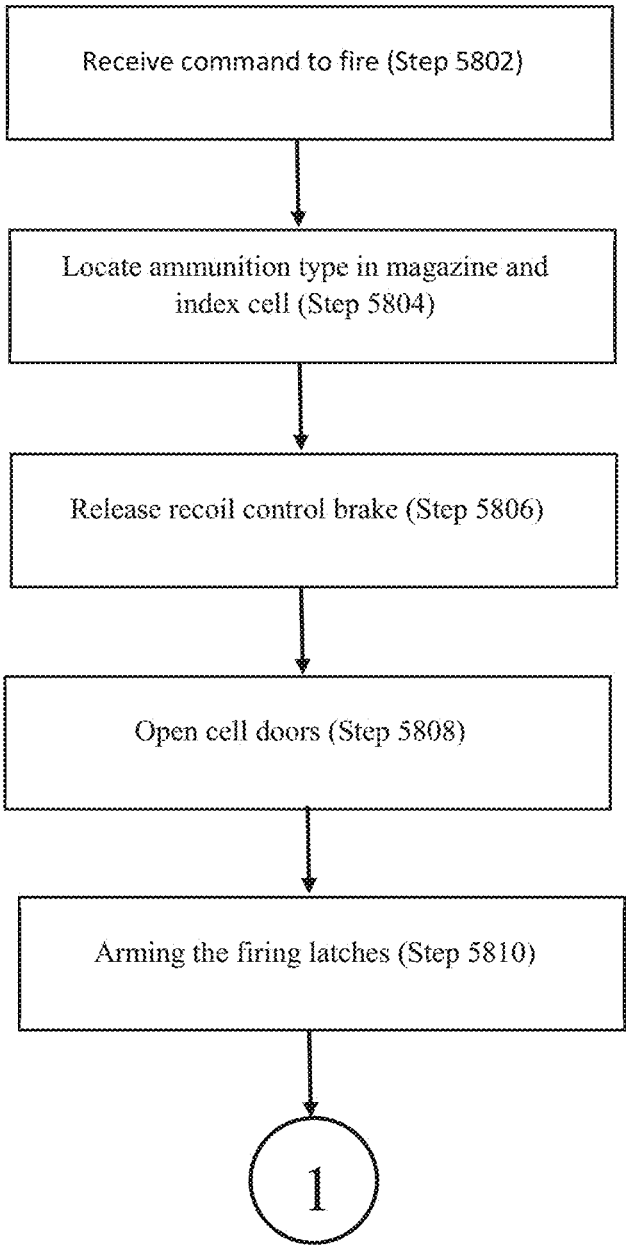
Figure 56B:
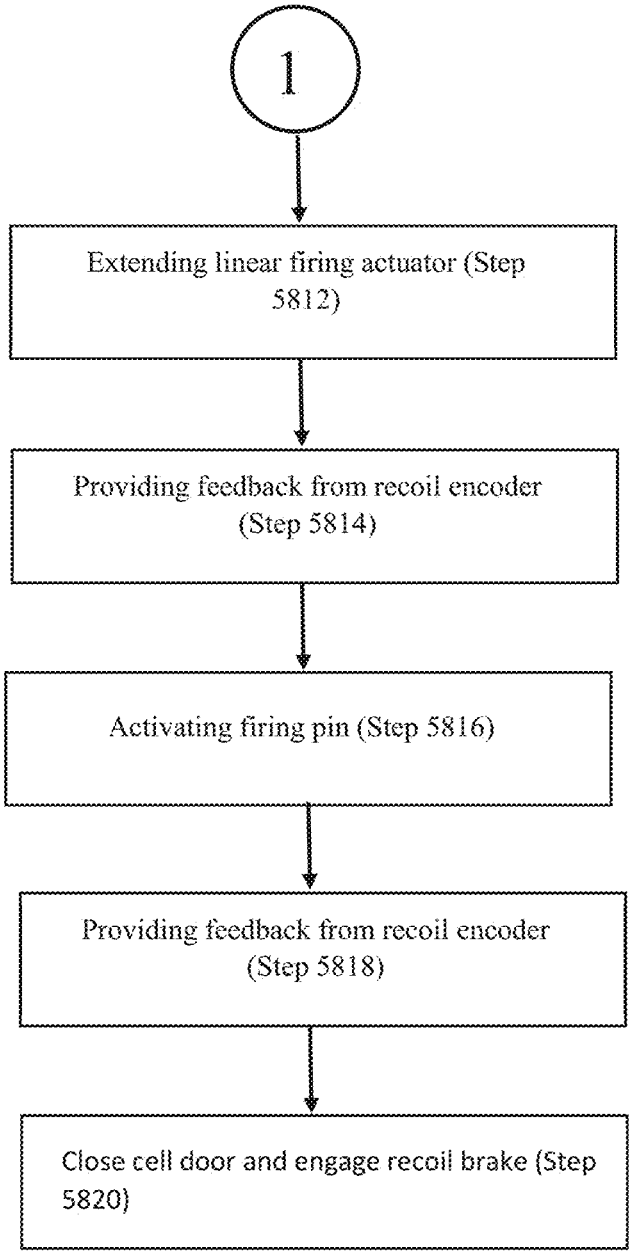

FIG. 56 includes FIGS. 56A and 56B, is a flowchart illustrating a method for firing the automated weapon system of FIG. 2, in accordance with an illustrative embodiment.

DETAILED DESCRIPTION

A large caliber indirect fire weapon system can be mounted on a mobile platform, such as a motor vehicle truck, thereby providing mobility and maneuverability on rough terrain battlefields. Further, automation of several features of the indirect fire weapon system permits emplacement, pointing and firing while soldiers are protected under cover, which greatly enhances responsiveness and reduces gun crew responsibility. Additionally, the indirect fire weapon system provides the ability to engage multiple targets simultaneously, with both direct and indirect fires, thereby allowing for a change in the way mortars, artillery and other large caliber weapons are currently deployed.

By mounting the weapon system on a lighter platform than is currently possible, the maneuverability of the weapon is greatly increased. Additionally, long emplacement and displacement times as well as the time required to accommodate limited firing azimuths are eliminated.

While the weapon system will be described throughout this specification as being mounted on a truck, such as a HMMWV (High Mobility Multipurpose Wheeled Vehicle), it will be appreciated that the weapon system is not limited to mounting on a HMMWV. The weapon system may be mounted to a water borne vessel such as a CCM MK1 or SOC-R.

As will be described in further detail below, the weapon system utilizes a combination of a soft recoil system and an automated magazine feed in conjunction with control electronics to achieve the benefits described above. The weapon system can be used in conjunction with cartridged ammunition of all types. However, as will be appreciated by those skilled in the art, the weapon system is not limited to firing these ammunition types.

With reference to FIGS. 1 and 2, they illustrate an exemplary automated weapon 5 that is provided with an active soft recoil control system 100, according to a preferred embodiment of the present invention. In this example, the automated weapon 5 includes an ammunition feeding mechanism 10, a gun tube 30, and a recoiling mass 20 that translates back and forth within a firing chamber 25.

While the ammunition feeding mechanism 10 is shown as including four rounds 11, 12, 13, and 14, it should be clear that the ammunition feeding mechanism 10 can be provided with a different number of rounds, wherein each round, i.e., 11, 12, may be respectively stored in a storage cell, i.e., 105, as described in further detail below in the section directed to Mortar Retention System.

Figures 1A, 1B, 1C, 1D:
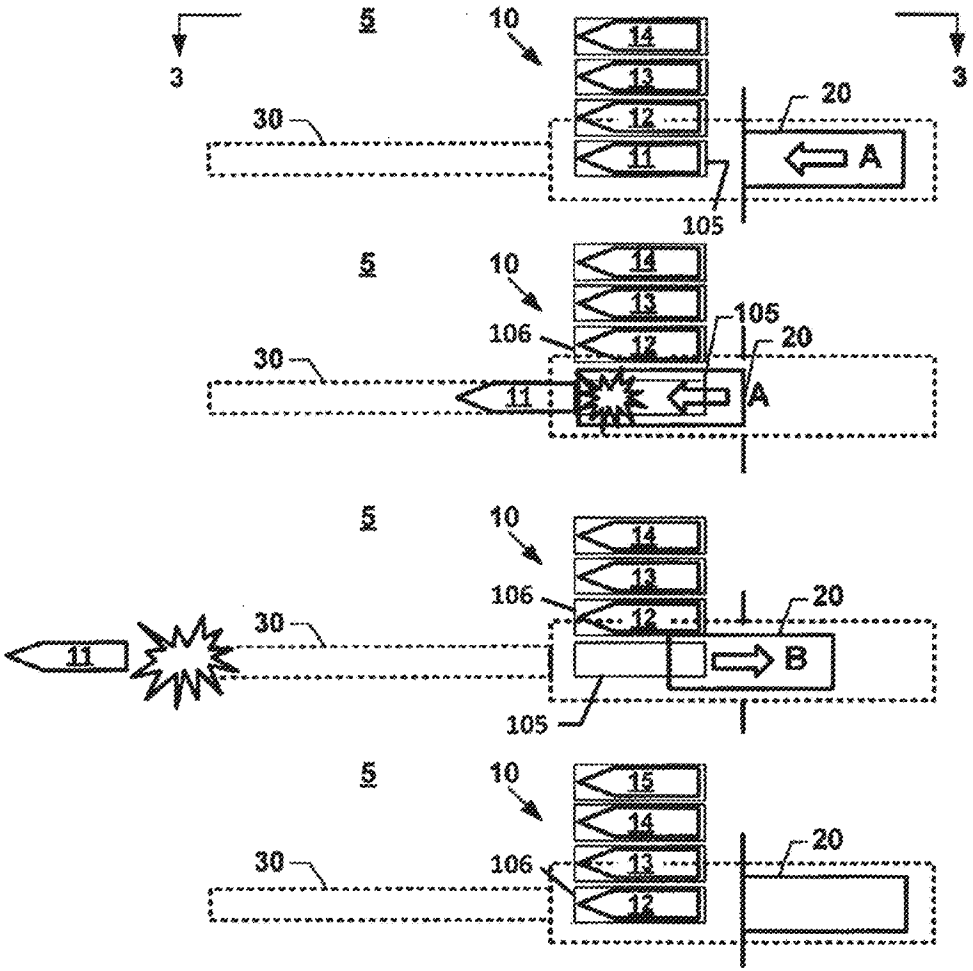
FIG. 1 includes FIGS. 1A, 1B, 1C, and 1D and represents a schematic view of the operation of an automated weapon that is provided with an active recoil control system, in accordance with an illustrative embodiment.

The general operation of the automated weapon 5 will now be described in connection with FIGS. 1A through 1D. FIG. 1A shows the first round 11 being advanced in line with the gun tube 30, and the recoiling mass 20 being cocked and latched. FIG. 1B shows the recoiling mass 20 unlatched and ramming the first round 11 forward, along the arrow A, causing the first round 11 to be fired through the gun tube 30. FIG. 1C shows the first round 11 exiting the gun tube 30, resulting in a soft recoil effect, wherein the reaction forces ensuing from the firing of the first round 11 cause the recoiling mass 20 to move back, along the arrow B, and to latch. It should be noted that the firing pin ignites the primer while the recoil is in motion, which is contrary to conventional recoil systems. FIG. 1D illustrates the recoiling mass 20 latched, with the ammunition feeding mechanism 10 indexed to the next round 12.

FIGS. 3-6 show a left side perspective view, a right side perspective view, a front perspective view and a back perspective view of an automated weapon system, in accordance with an illustrative embodiment. The pedestal assembly 1 supports the gun assembly 2 by means of a trunnion assembly 3 which provides a pivot point for weapon elevation. The pedestal assembly is also attached directly to the vehicle through a geared slewing bearing 4 which permits the weapon to traverse relative to the vehicle. A slip ring 5 interfaces with the pedestal assembly, which permits management of power and communications cables and allowing for infinite traverse. The elevation compensation/equilibration system 12 which serves to reduce elevation actuation loads and ensure consistent recoil forces over all elevations, also interfaces with the cradle assembly.

Traverse of the weapon is accomplished by a rotary electromechanical traverse actuator 6 whose output is geared directly to the geared slewing bearing 4. The weapon elevation is accomplished using a linear electromechanical elevation actuator 7. The elevation actuator is attached to the pedestal assembly 1 and the gun assembly 2 by means of clevis pins. The elevation actuator has adequate stroke to elevate or depress the weapon from −3 to +85 degrees. Each actuator is equipped with a manual override crank, in the event of a loss of electrical power.

The gun assembly 2 consists of numerous key components associated with the firing of the weapon. Its major structural element is the cradle assembly 8. The cradle assembly provides structural support for the trunnions 3; the cannon assembly 9; the magazine assembly 10; the recoil system 11; the trim brake assembly 13; the latch assembly 14; the firing mechanism 15; and the rammer actuator 16.

The cannon assembly 9 is attached directly to the cradle assembly 8. It is designed to accommodate the pressures and temperatures associated with firing the weapon at high rates of fire and to provide a sealing surface for the moving breech. It also accommodates the elevation bracket 17 which in turn interfaces with the elevation actuator 7 by means of a clevis pin. Finally, the cannon assembly incorporates a thermal warning device, which warns the operator if the cannon is approaching an unsafe temperature.

The magazine assembly 10 is attached directly to the cradle assembly 8. It consists of a 20 round carousel-type chain of ammunition cells; a rotary electrochemical magazine actuator assembly 18 which moves the ammunition chain; a magazine encoder assembly 19, which provides feedback regarding the position of the ammunition chain; a chain tensioning device 20, to assure smooth adjustable operation of the magazine chain; a load door assembly 21, which provides a means for the operator to load and unload ammunition into the magazine; and a loading solenoid assembly 22 which permits ammunition restraint doors to open and close.

The active recoil system 11 is normally held out of battery by a latch mechanism 14 against a series of compression springs. When the latch is released, the recoiling parts are accelerated forward by the compression springs. As the recoiling parts are moving forward, a safing came and a firing cam control protrusion of the firing pin. When the recoiling parts have reached the desirable firing position, the safing cam will rotate out of the way, allowing the firing cam to independently rotate, permitting the firing pin to protrude, thereby causing ignition of the mortar cartridge. The pressure created by the ignition of the propellant gases will launch the projectile forward and will launch the recoiling parts rearward, against the force created by the compression springs. During this rearward motion, the safing cam and firing cam will return to their initial positions. The recoiling parts are returned to their initial out-of-battery positions and the latch mechanism will capture the recoiling parts, preventing them from moving forward, and setting the weapon to fire a subsequent round. As the recoiling parts move rearward, the recoil system contacts the stationary weapon cradle 8 thereby compressing energy absorbing ring springs located inside the recoil system. After absorbing much (but not all) of the rearward momentum, the ring springs propel the recoiling parts forward, against the latch mechanism 14. The front of the recoil system contacts the latch, subsequently compressing the ring springs from the opposite direction, thereby absorbing the forward momentum and significantly reducing the forces experienced by the latch. This cycle oscillates until all residual energy has been absorbed.

The trim brake assembly 13 is mounted directly to the cradle assembly 8. It consists of a solenoid, a series of brake plates and spur gearing. The spur gear input interfaces with a straight spur gear rack mounted on the recoil system 11. The trim brake is a major component of the active recoil control system. The active recoil control uses multiple sensors in combination with the trim brake solenoid controlled multi-disc brake to adjust the system recoil. The control system uses an encoder 23 to provide recoil velocity, an infrared temperature sensor to measure round temperature prior to firing and an inertial navigation unit to determine weapon cant. Using these sensors, the control system is able to both predict and react to recoil system performance to apply the required braking force to compensate for anticipated or actual variations. Feedback from the sensors allows the system to adjust braking during the recoil stroke to optimize performance. As a package, this active recoil control system is able to eliminate the two major performance/design issues associated with soft recoil weapons: failure to latch and managing excess firing loads.

The latch assembly 14 and the firing mechanism 15 are directly attached to the cradle assembly 8 and control both the firing of the projectile and capturing the recoil system as it is propelled rearward. The latch assembly consists of a left latch mechanism 24, a right latch mechanism 25 and cross shaft which connects the two latch mechanisms and interfaces with the firing mechanism 15. The left and right latch mechanisms are similar in function, except that the right latch mechanism incorporates a solenoid-driven safing cam, which serves to prevent inadvertent firing or release. Each latch mechanism restrains the recoiling mass, preloaded by recoil springs, in the rearward position by means of an overcenter linkage arrangement. The firing mechanism 15 is an electromechanical linear actuator connected to the cradle assembly 8 and the latch assembly's cross shaft. To fire the weapon, the solenoid on the right latch mechanism 25 is activated, thereby removing the safety cam. When the actuator is extended, it causes rotation of a shaft within each latch mechanism, overcoming the spring-loaded overcenter linkage, thereby causing the recoiling parts to propel forward under recoil spring force. The spring-loaded overcenter latch returns to its overcenter position prior to the recoiling parts returning to the out-of-battery position, thereby allowing the latch assembly 14 to catch the recoiling parts, preventing it from being propelled forward again and setting the weapon to fire a subsequent round. The firing mechanism 15 is then retracted to its initial position, thereby returning the latch shafts to their initial position, and the safing cam solenoid is de-energized.

The rammer actuator 16 is a geared electromechanical linear actuator that is attached directly to the cradle assembly 8. The rammer actuator pushes against the spring-loaded recoil mechanism to perform several tasks: (1) to move the recoil system from a travel position (i.e. the recoil system is forward, relieving spring force) to its cocked position, (2) to cock the weapon in the event of a firing event in which the recoiling mass failed to latch, and (3) to return the recoiling mass from its cocked, firing position to its travel position.

Figure 7:
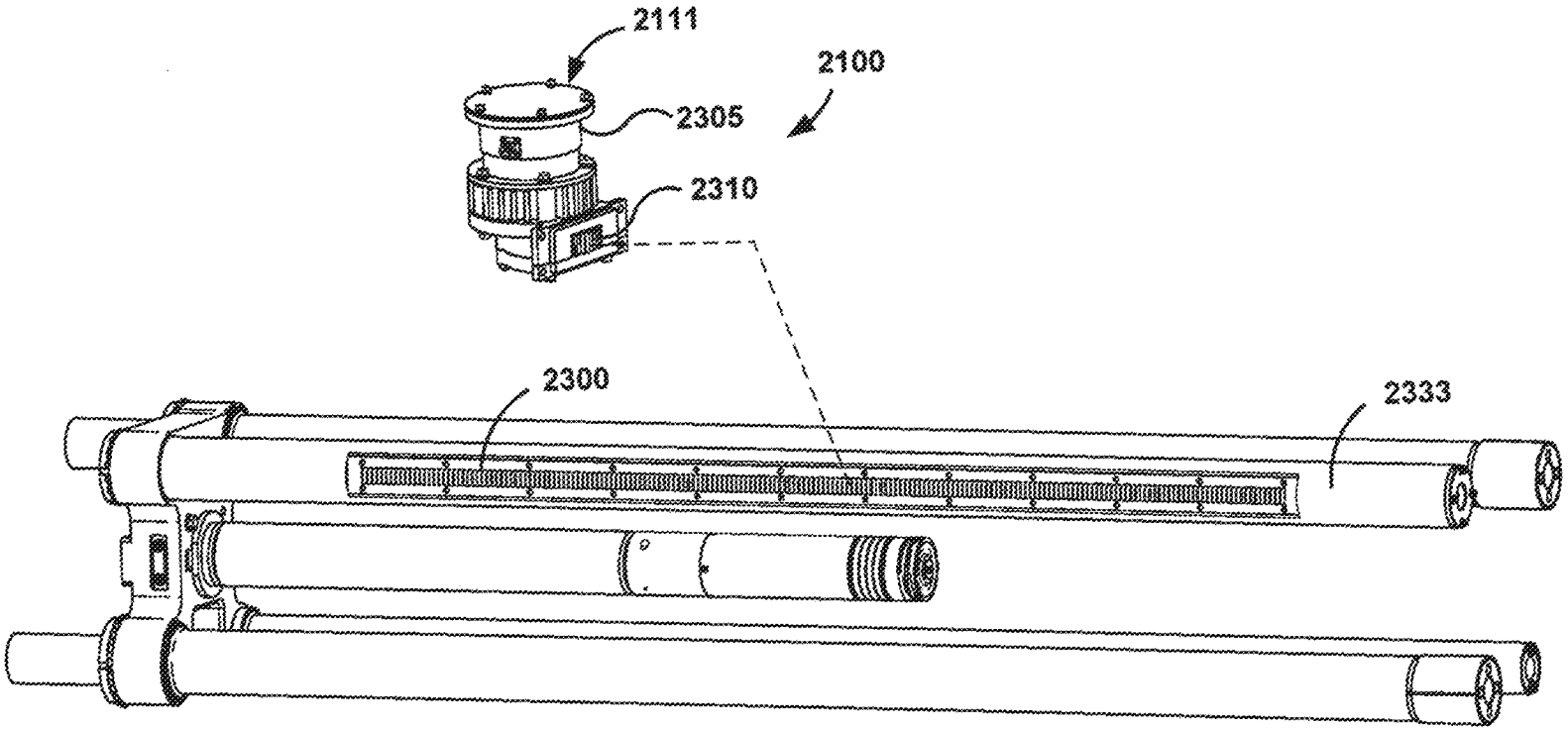
FIG. 7 is an isometric perspective view of the recoil brake that forms part of the active recoil control system of FIG. 2, further illustrating a rack gear that interfaces with the recoil brake and that is disposed on a recoiling mass of the weapon, in accordance with an illustrative embodiment of the invention.

FIG. 7 illustrates the active recoil control system 2100 of the present invention, with FIG. 2 illustrating the recoil brake 2111 mounted on the gun cradle, and interfacing with the recoiling mass 20. As further illustrated in FIG. 7, the active recoil control system 2100 is generally comprised of the recoil brake 2111 that interfaces with the recoiling mass 20, a controller 2200, and a plurality of sensors 2222. The operation of the active recoil control system 2100 will be described later in more details.

FIG. 7 further illustrates the recoil brake 2111 interfacing with the recoiling mass 20 by means of a rack gear 2300 that is formed on a recoil cylinder 2333 of the recoiling mass 20. The recoil cylinder 2333 is part of a specialized recoil system whose operation and functions are described in further detail below.

While FIG. 7 illustrates the recoiling mass 20 as being controlled by only one recoil brake 2111, it should be abundantly clear that more than one recoil brake 2111 may be used as part of the active recoil control system 2100. In addition, while the recoil brake 2111 is described in connection with a weapon for illustration purpose only, it should be amply clear that the present invention is not limited to soft recoil mechanisms or weapons, and that an exemplary soft recoil weapon is presented herein for illustration purpose and does not purport to be the exclusive embodiment covered by the present invention. The recoil brake 2111 may form part of a braking system in numerous other military and commercial applications, including but not limited to vehicular braking systems.

Furthermore, while the recoil brake 2111 is described as interfacing with the rack gear 2300 that is formed on the recoil cylinder 2333, it should be clear that the rack gear 2300 may be formed on, or secured to any suitable component of the recoiling mass 20. The main function of the rack gear 2300 is to enable the recoil brake 2111 to regulate or limit the linear recoil or counter-recoil strokes of the recoil cylinder 2333 and ultimately those of the recoiling mass 20. Consequently, the rack gear 2300 may be substituted with any suitable, known or available device that provides a similar or equivalent function.

In general, the recoil brake 2111 includes a housing assembly 2305 that provides the interface for mounting the recoil brake 2111 onto a stationary component of the weapon 5. An idler gear 2310 meshes with the rack gear 2300 for selectively transmitting a calibrated braking torque from the recoil brake 2111 to the recoiling mass 20.

In accordance with the present invention, the rack gear 2300, which is affixed to the recoiling mass 20, moves linearly when the weapon 5 is fired. The recoil brake 2111, which is secured to the weapon cradle, remains stationary. The effect is the motion of the recoil cylinder 2333 causes the idler gear 2310 to spin. The rotation of the idler gear 2310 causes a brake shaft 2565 to rotate as well. This is how the application of a torque on the brake shaft 2565 is translated into a linear force on the recoiling components. Under normal circumstances, when the weapon 5 is fired, the solenoid 2555 is activated, causing only the torque due to gravity of the disc assembly 2550 to be transmitted to the recoiling mass 20. This is achieved by activating the solenoid 2555, which opposes the wave spring 2540.

Under certain conditions, when the controller 2200 determines that the recoil velocity of the rack gear 2300 requires adjustment, it instructs the recoil brake 2111 to apply the appropriate recoil braking force onto the rack gear 2300 to resist excess recoil translation movement of the rack gear 2300.

Similarly, the controller 2200 is also capable of instructing the recoil brake 2111 to apply the appropriate counter recoil braking force onto the rack gear 2300.

Figure 8:
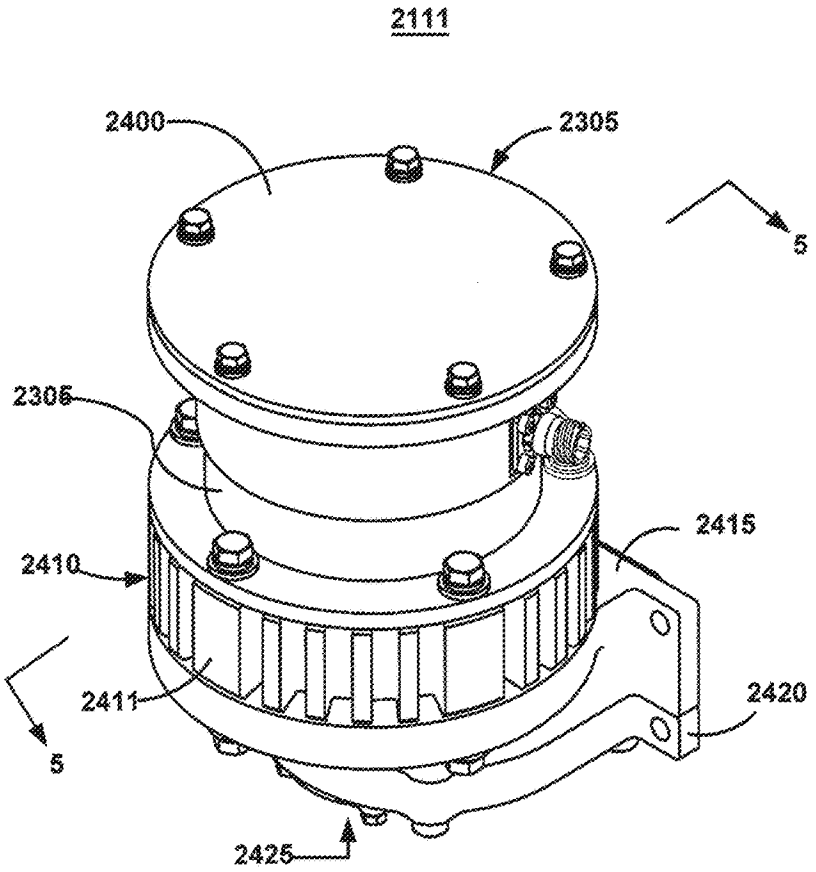
FIG. 8 is an enlarged, isometric perspective view of the recoil brake of FIG. 7, in accordance with an illustrative embodiment of the invention.
Figure 9:
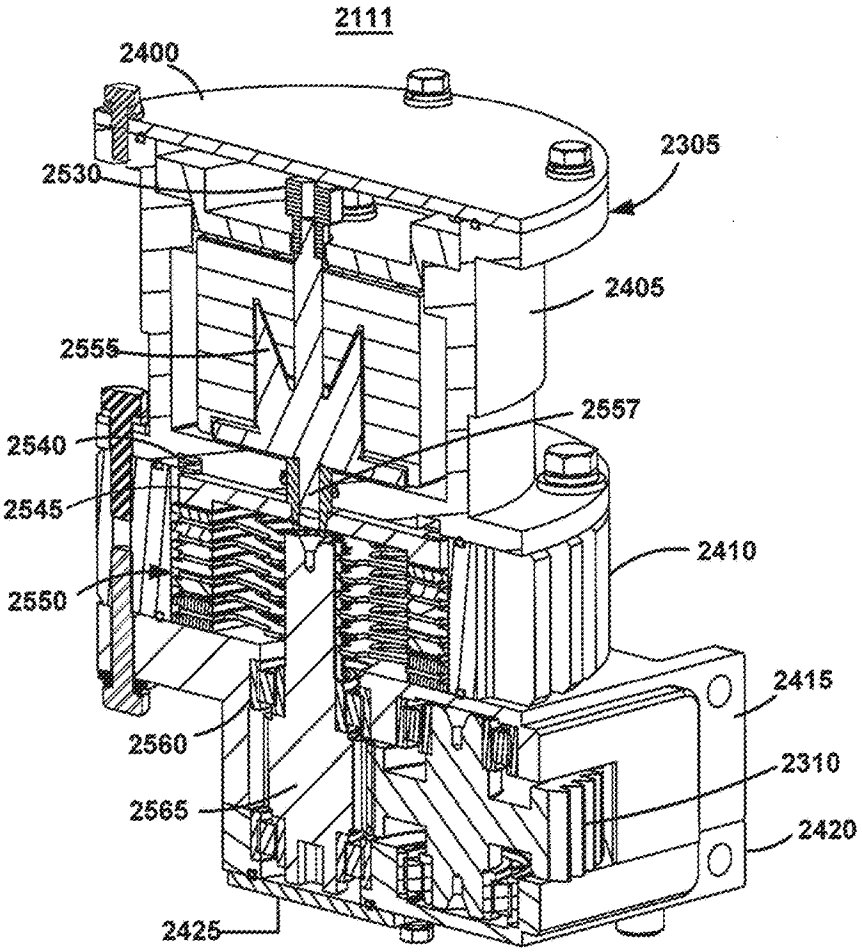
FIG. 9 is a cross sectional view of the recoil brake of FIG. 8, taken along line 5-5 thereof, in accordance with an illustrative embodiment of the invention.
Figure 10:
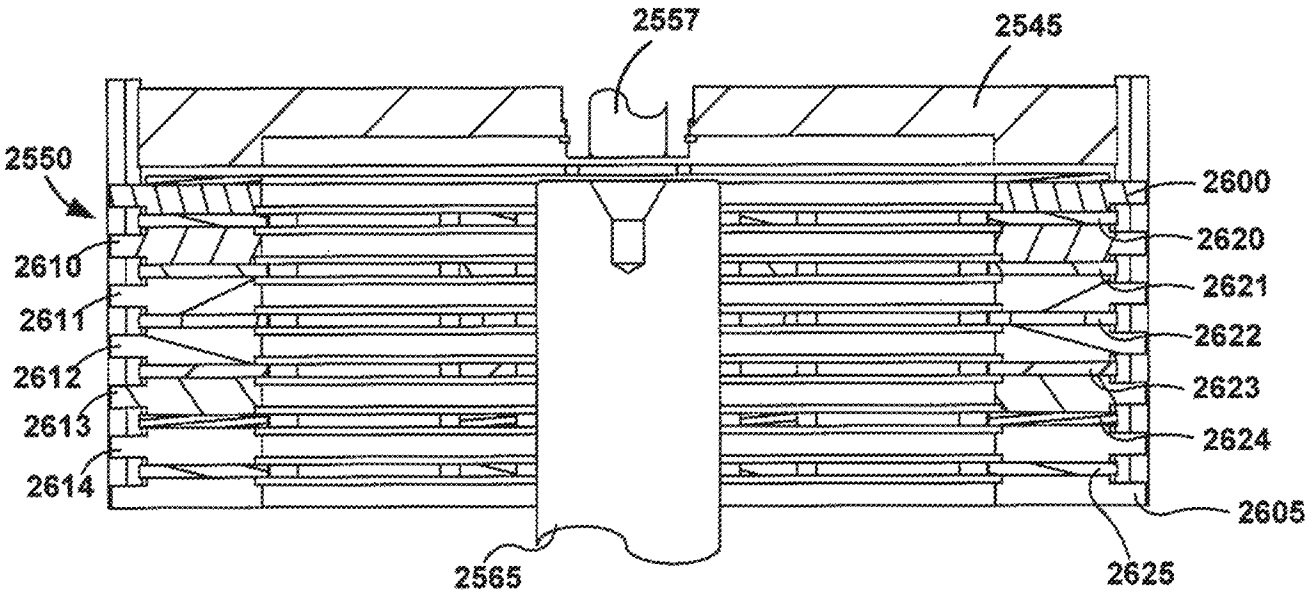
FIG. 10 is a greatly enlarged cross-sectional view of a friction disc assembly that forms part of the recoil brake of FIGS. 8 and 9, in accordance with an illustrative embodiment of the invention.

FIGS. 8, 9, and 10 illustrate the recoil brake 2111 in more detail. FIG. 8 illustrates the housing assembly 2305 as comprising: a housing cover 2400 that is secured to a solenoid housing 2405, which, in turn is secured to a disc housing 2410. An upper housing 2415 is secured to the disc housing 2410 at one end and to a lower housing 2420 at its other end. A torque access cover 2425 covers the lower housing 2420 and provides an access point to enable the use of a torque wrench to check the brake torque.

In general, the housing assembly 2305 provides environmental protection to the recoil brake 2111 and further provides means for securing the recoil brake 2111 to the weapon 5. The disc housing 2410 includes a heat dissipation element 2411 (FIG. 8).

As further illustrated in FIG. 9, the solenoid housing 2405 houses an override nut 2530 and a solenoid 2555. The disc housing 2410 houses a wave spring 2540, a pressure plate 2545, and a disc assembly 2550. The override nut 2530 enables the performance of maintenance on the recoil brake 2111. It provides manual override of the recoil brake 2111 by opposing a force generated by the wave spring 2540, without the use of the solenoid 2555.

One side of the wave spring 2540 engages and presses against the bottom side of the solenoid housing 2405, while its other side presses against the pressure plate 2545. In turn, the pressure plate 2545 engages a solenoid plunger 2557 and abuts against the disc assembly 2550.

The upper housing 2415 and the lower housing 2420 house bearings 2560, the idler gear 2310, and a brake shaft 2565. The upper and lower housings 2415, 2420 provide the interface for mounting the disc assembly 2550 to the weapon 5. As described earlier, the idler gear 2310 meshes with the rack gear 2300 on one of the recoil cylinder 2333 and transmits the braking torque from the brake shaft 2565 to the recoiling mass 20.

As further illustrated in FIG. 10, the disc assembly 2550 is formed of a plurality of interlaced discs that convert the axial force applied by the wave spring 2540 into a torque applied to the brake shaft 2565. The disc assembly includes two endors 2600, 2605; a plurality of stators (e.g., 5 stators) 2610, 2611, 2612, 2613, 2614; and a plurality of rotors (e.g., 6 rotors) 2620, 2621, 2622, 2623, 2624, 2625.

The endors 2600, 2605 and the stators 2610, 2611, 2612, 2613, 2614 are securely keyed to the disc housing 2410 and are stationary. The rotors 2620, 2621, 2622, 2623, 2624, 2625 are interlaced between the endors 2600, 2605 and the stators 2610, 2611, 2612, 2613, 2614, and rotate with the brake shaft 2565. Each rotor, e.g., 2620, is forced to rotate with the brake shaft 2565 via a spline connection. Braking is achieved by the interaction of the rotors 2620-2625 (that rotate with the brake shaft 2565) and the stators 2610-2614 (that are stationary and fixed to the housing 2305).

The wave spring 2540 applies a force to the pressure plate 2545. In the normal position, the pressure plate 2545 transmits the wave spring (2540) force directly to the disc assembly 2550, causing the multi-disc recoil brake 2111 to apply a braking (or damping) force to the recoiling mass 20. The solenoid 2555 is used to oppose the wave spring (2540) force on the pressure plate 2545 and to relieve the force transmitted to the disc assembly 2550. Consequently, activating the solenoid 2555 allows the brake shaft 2565 to spin freely except for the frictional forces due to gravity.

In summary, when the recoiling mass 20 is moving, it causes the rack gear 2300 to translate, which causes the idler gear 2310 and the brake shaft 2565 to rotate also. The spinning brake shaft 2565 causes the rotors 2620, 2621, 2622, 2623, 2624, 2625 to spin.

In a "free wheel" mode, where it is desired to remove the braking force from the disc assembly 550, an electrical current is applied to the solenoid 2555. The solenoid 2555 converts the electrical current into a mechanical linear force, which is demonstrated by the linear movement of the solenoid plunger 2557. The solenoid plunger 2557 acts upon the pressure plate 2545, which in turn acts on the wave spring 2540 to oppose it. This relieves the brake force and allows the idler gear 2310 to move freely. In this mode, the solenoid 2555 exerts a force that is equal to that of the wave spring 2540. Consequently, the wave spring force is not transmitted to the disc brake assembly 2550, allowing the rotors 2620-2625 to rotate freely.

In a "braking" mode, where it is desired to apply a braking force onto the disc assembly 2550, the solenoid 2555 is deactivated by removing the electrical current therefrom (in part or completely). As a result, the wave spring 2540 force passes through the pressure plate 2545 and compresses all the rotors 2620-2625 together against their corresponding stators 2610-2614, resulting in a braking action.

The wave spring 2540 always pushes against the pressure plate 2545. The difference between the two states is where the spring force ends up. In the "braking" mode, the spring force runs through all the brake discs of the brake disc assembly 2550. In the "free wheel" mode, the spring force ends up cancelled by the solenoid 2555. In both modes, the spring force is transmitted through the pressure plate 2545.

Figure 11:
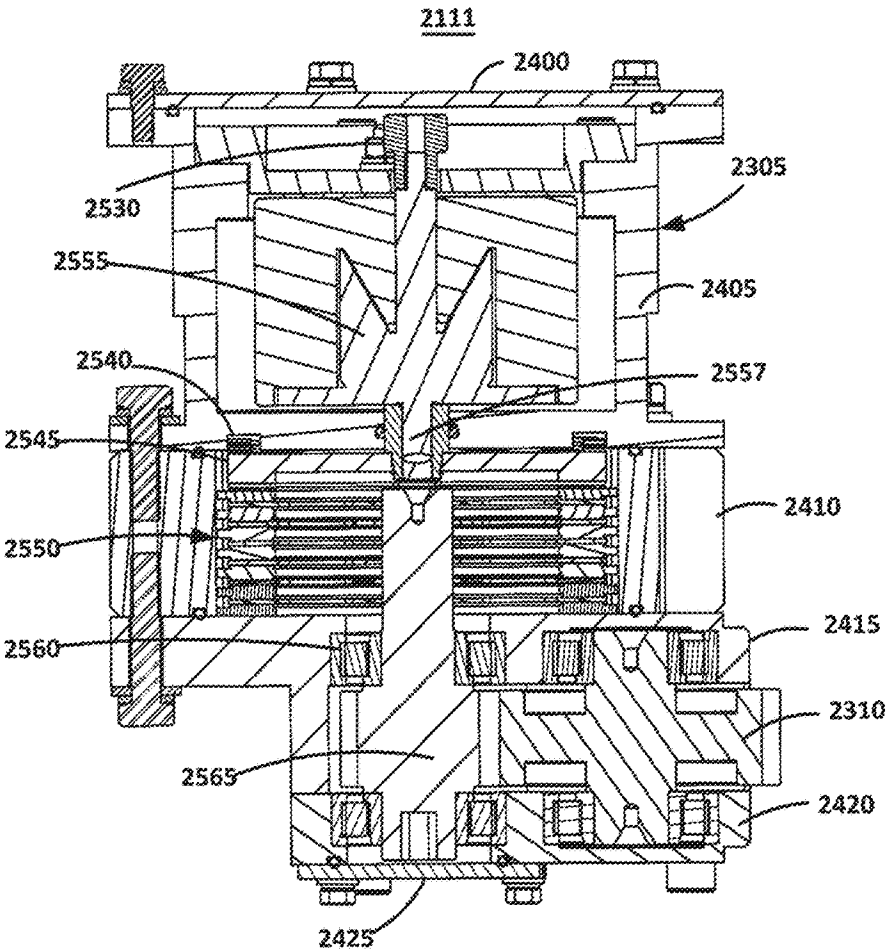
FIG. 11 is a front view of the recoil brake of FIG. 9, showing a solenoid in an activated state, in accordance with an illustrative embodiment of the invention.
Figure 12:
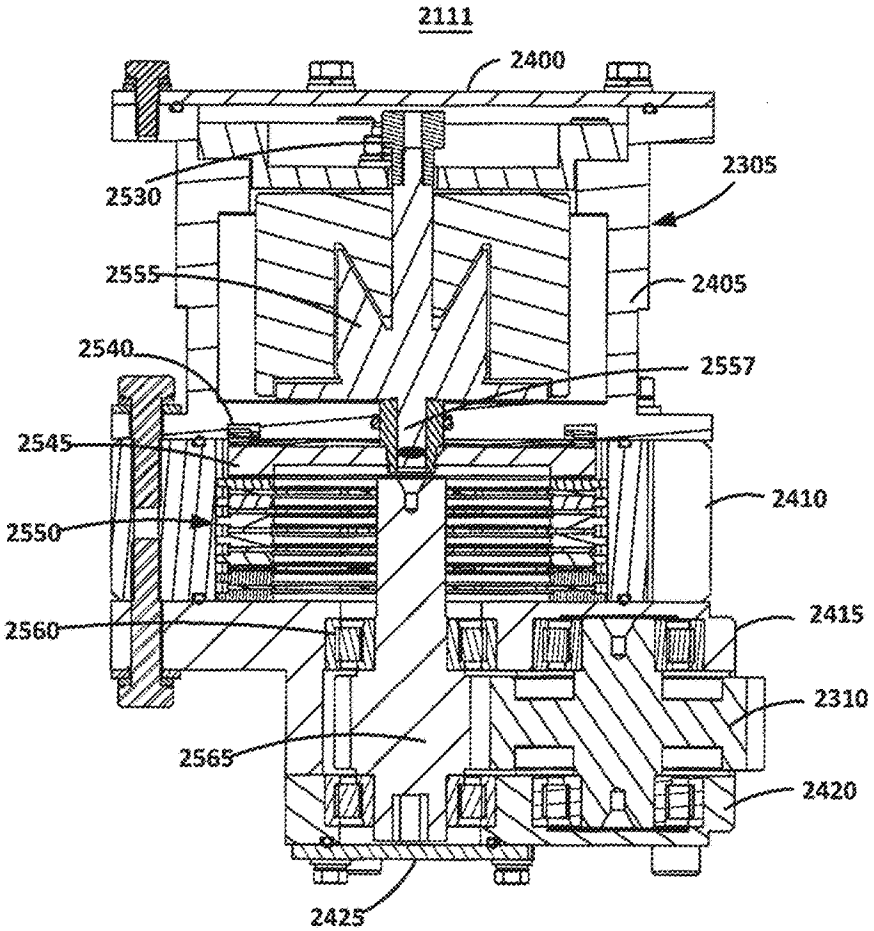
FIG. 12 is another view of the recoil brake of FIG. 11, showing the solenoid in a deactivated state, in accordance with an illustrative embodiment of the invention.

FIGS. 11 and 12 illustrate the operation of the recoil brake of FIGS. 8 and 9, showing the solenoid 2555 in an activated state and a deactivated state, respectively. When activated, the solenoid 2555 exerts a force on the pressure plate 2545, pulling it upward and cancelling the force exerted by the wave spring 2545.

With reference to FIG. 11, based upon the recoil velocity, projectile temperature, and the weapon (5) cant data, the controller will be able to determine the amount of braking required for the existing firing conditions. During normal firing conditions, where the recoil brake 2111 is not needed, the controller 2200 will fully activate the solenoid 2555, reducing the braking force close to zero. To this end, the activation of the solenoid 2555, causes the solenoid plunger 2557 to be pull the pressure plate 2545 upwardly, thus relieving the wave spring force from the disc assembly 2550. When firing is carried out in extreme conditions, such as a cold temperatures (e.g., −45° F.) and/or negative cant (e.g., −20 degrees), the controller 2200 will utilize tabulated data to apply the appropriate braking force during forward motion of the weapon 5, to ensure that the weapon 5 latches during the recoil system (200) rearward stroke. When a late ignition occurs, the controller 2200 will utilize a feedback control loop to slow the rearward motion of the recoiling mass 20, so as to prevent weapon damage from occurring. To this end, a proportionate current is fed to the solenoid 2555, so that the solenoid 2555 is deactivated (or de-energized), at least in part.

Consequently, by using the sensors data in real time with a variable recoil brake 2111, the active control recoil system 2100 is able to solve issues with situational firing conditions that have plagued soft-recoil weapons since their inception.

Figure 13:
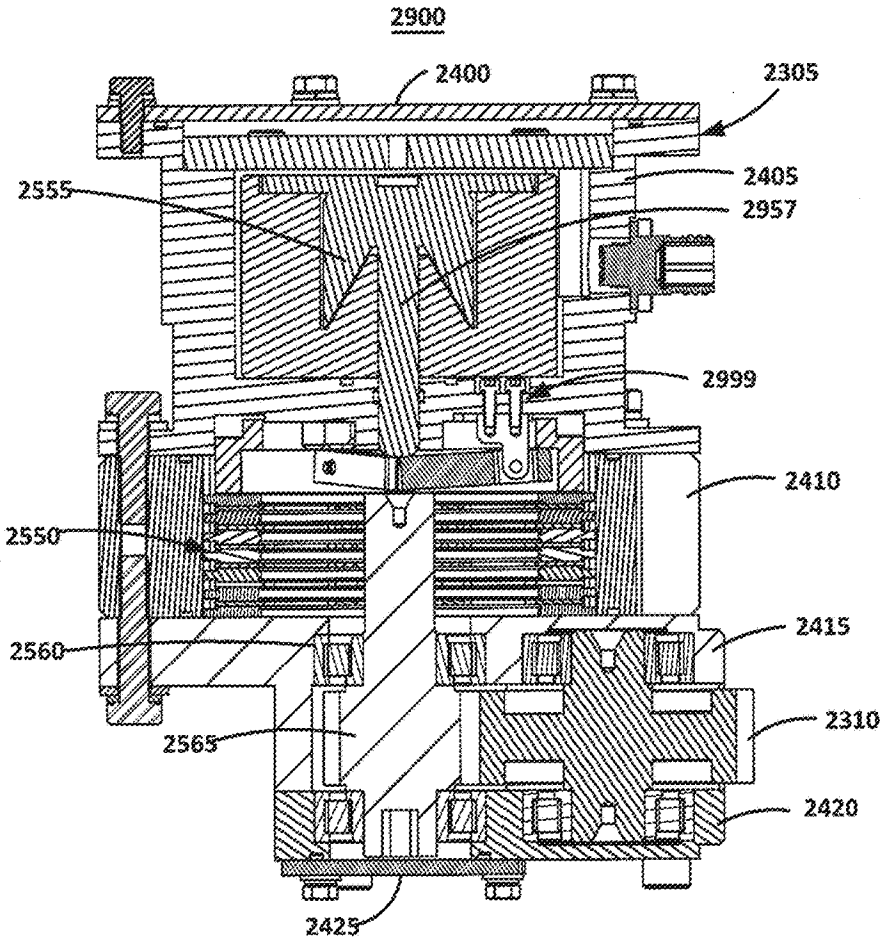
FIG. 13 is a front cross-sectional view of another embodiment of the recoil brake of FIG. 8, showing an inverted solenoid in an activated state, in accordance with an illustrative embodiment of the invention.
Figure 13A:
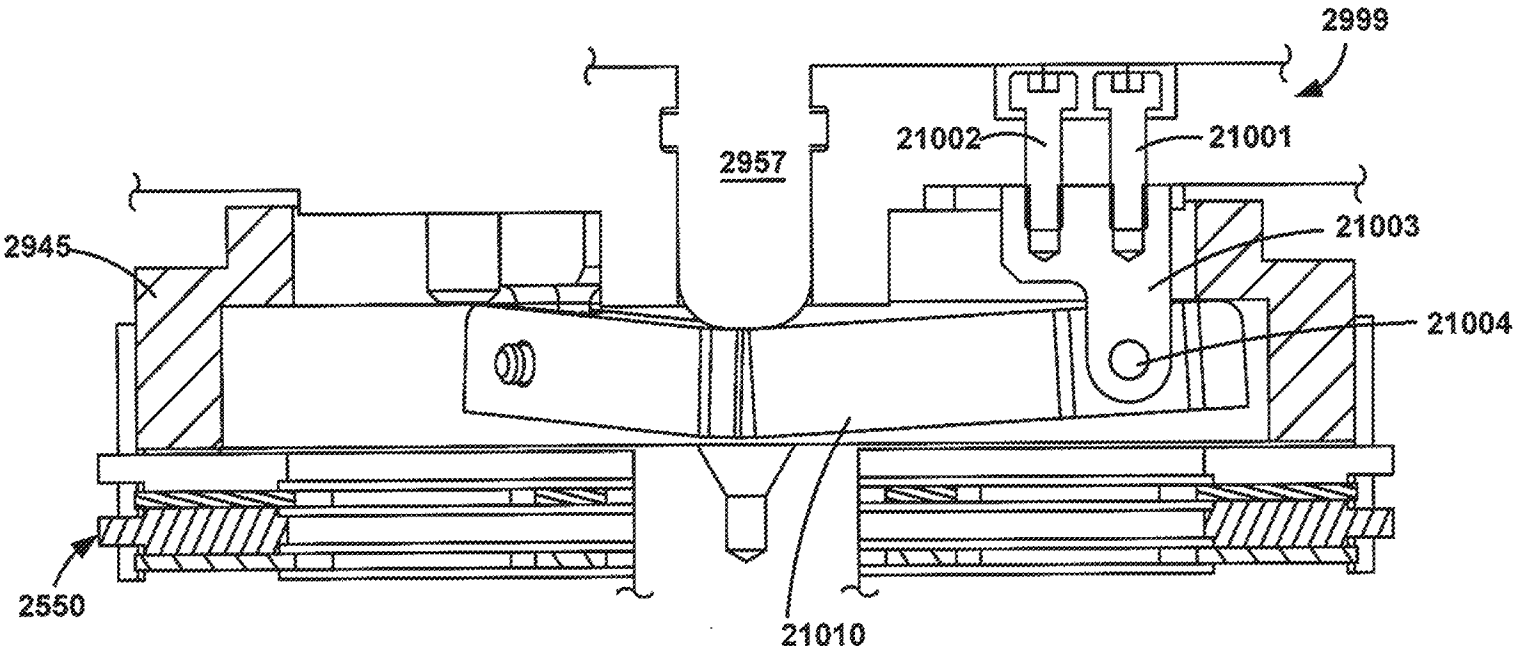
FIG. 13A is a greatly enlarged sectional view of a level assembly that forms part of the recoil brake of FIG. 13, in accordance with an illustrative embodiment of the invention.
Figure 14:
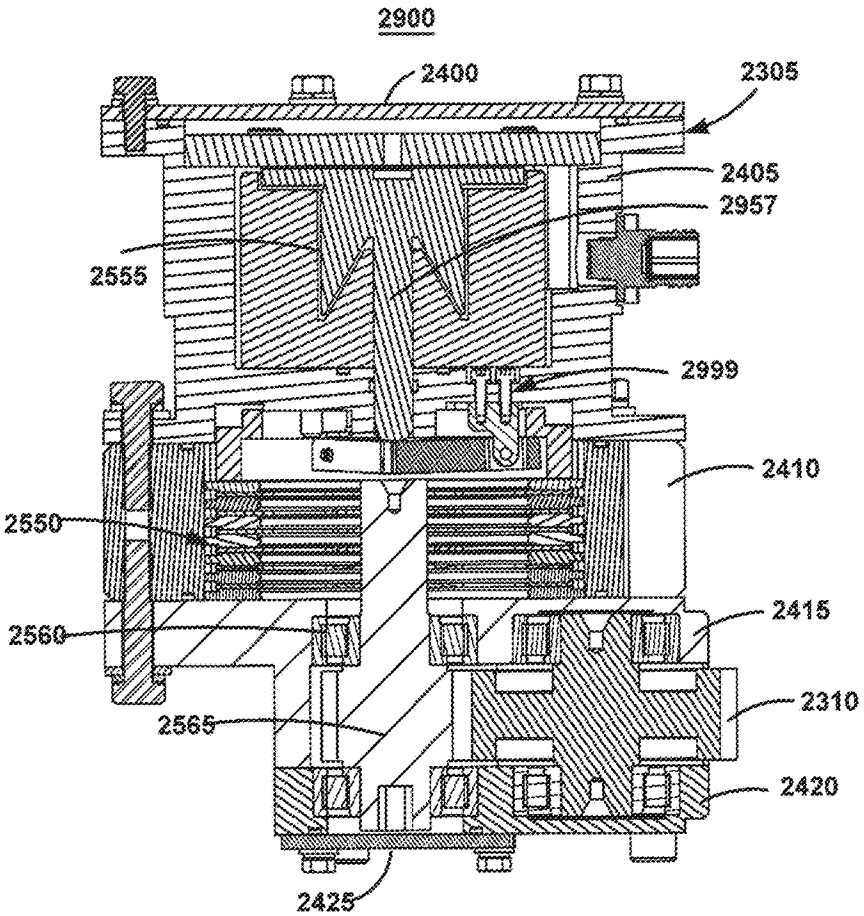
FIG. 14 is another view of the recoil brake of FIG. 13, showing the inverted solenoid in a deactivated state, in accordance with an illustrative embodiment of the invention.

FIGS. 13, 13A, and 14 represent another embodiment of the recoil brake 2111 of FIG. 8, showing an inverted solenoid in an activated state and a deactivate state, respectively. The recoil brake 2900 of FIGS. 13, 13A, and 14 includes several components that are similar to those of the recoil brake 2111. These common components are designated in FIGS. 13, 13A, and 14 by the same numeral references for ease of identification.

One of the main structural differences between the recoil brake 2900 and the recoil brake 2111 is that the solenoid 2555 is inverted in the recoil brake 2900. In the recoil brake 2111 when the solenoid 2555 is activated, the solenoid plunger 2557 moves along the upward direction. In the recoil brake 2900 when the solenoid 2555 is activated, its plunger 2957 moves along the downward direction, to engage a lever assembly 2999.

The lever assembly 2999 is generally formed of three levers 21010, three clevis eyes (21003) and three clevis pins (21004). The clevis eyes are fixed by two screws (21001 and 21002). The lever arm 21010 pivots about the pivot pin 21004 when it is pushed in the downward direction by the solenoid plunger 2957. When the solenoid 2555 is activated, it applies a force on the three levers 21010, which, in turn, push up on the pressure plate 2945 to relieve the disc assembly 2550, allowing the rotors 2620-2625 to rotate freely. When the levers 21010 move, they pivot about the pivot pin 21004, which is held in place by the clevis eye 21003. As a result, the spring force is opposed by the solenoid via the levers and pressure plate is removed from the friction discs.

When the solenoid 2555 is deactivated, the three levers 21010 stop opposing the wave spring 2540, and the wave spring load is transmitted to the brake disc assembly 2550 to generate the braking torque. Although the motion of the solenoid 2555 is reversed relative to the previous embodiment, it still functions the same way; activating the solenoid 2555 turns the brake off, while deactivating the solenoid 2555 turns the brake on.

Generally, a solenoid is limited in term of the amount of force it can apply, e.g., 170 pounds of force. In the setup of recoil brake 2111, the axial force applied to the disc assembly 2550 is limited to maximum output of the solenoid 2555. However, the recoil brake 2900 uses a lever assembly 2999 to provide a mechanical advantage to the solenoid 2555 opposing the wave spring 2540. As a result, the allowable wave spring force is the solenoid force multiplied by the mechanical advantage, e.g. 170 lbf*4. Consequently, the braking capacity is increased by the mechanical advantage of the lever assembly 2999 (minus any losses due to friction in the lever mechanism).

Figure 15:
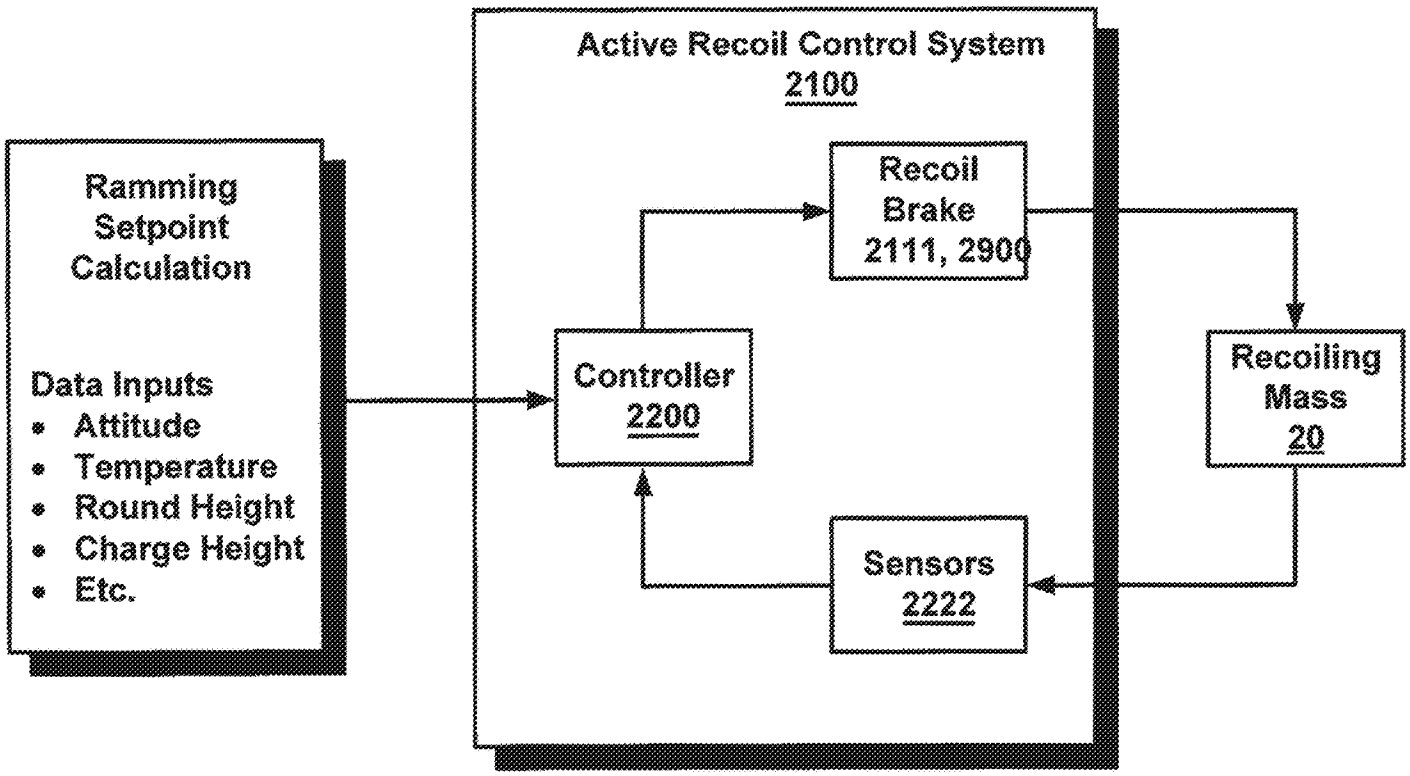
FIG. 15 is a high level block diagram of the operation of the active recoil control system of FIG. 8, in accordance with an illustrative embodiment of the invention.

FIG. 15 illustrates the operation of the active recoil control system 2100. The active recoil control system 2100 uses multiple sensors 2222 in combination with the solenoid controlled multi-disc brake 2111 or 2900, to adjust the weapon recoil. The sensors 2222 include for example, an encoder to provide the recoil velocity, an infrared temperature sensor to measure the round temperature prior to firing, and an Inertial Navigation Unit (INU) to determine the weapon cant.

Using outputs from these sensors 2222, the controller 2200 is able to both predict and react to the recoiling mass 20 performance, and to apply the required braking force, in order to compensate for anticipated or actual variations. Feedback from the sensors 2222 allows the active recoil control system 2100 to adjust braking during the recoil stroke in order to optimize the weapon performance. The active recoil control system 2100 is now able to eliminate the two major performance and design issues associated with soft recoil weapons, namely failure to latch and managing excess firing loads.

Figure 16:
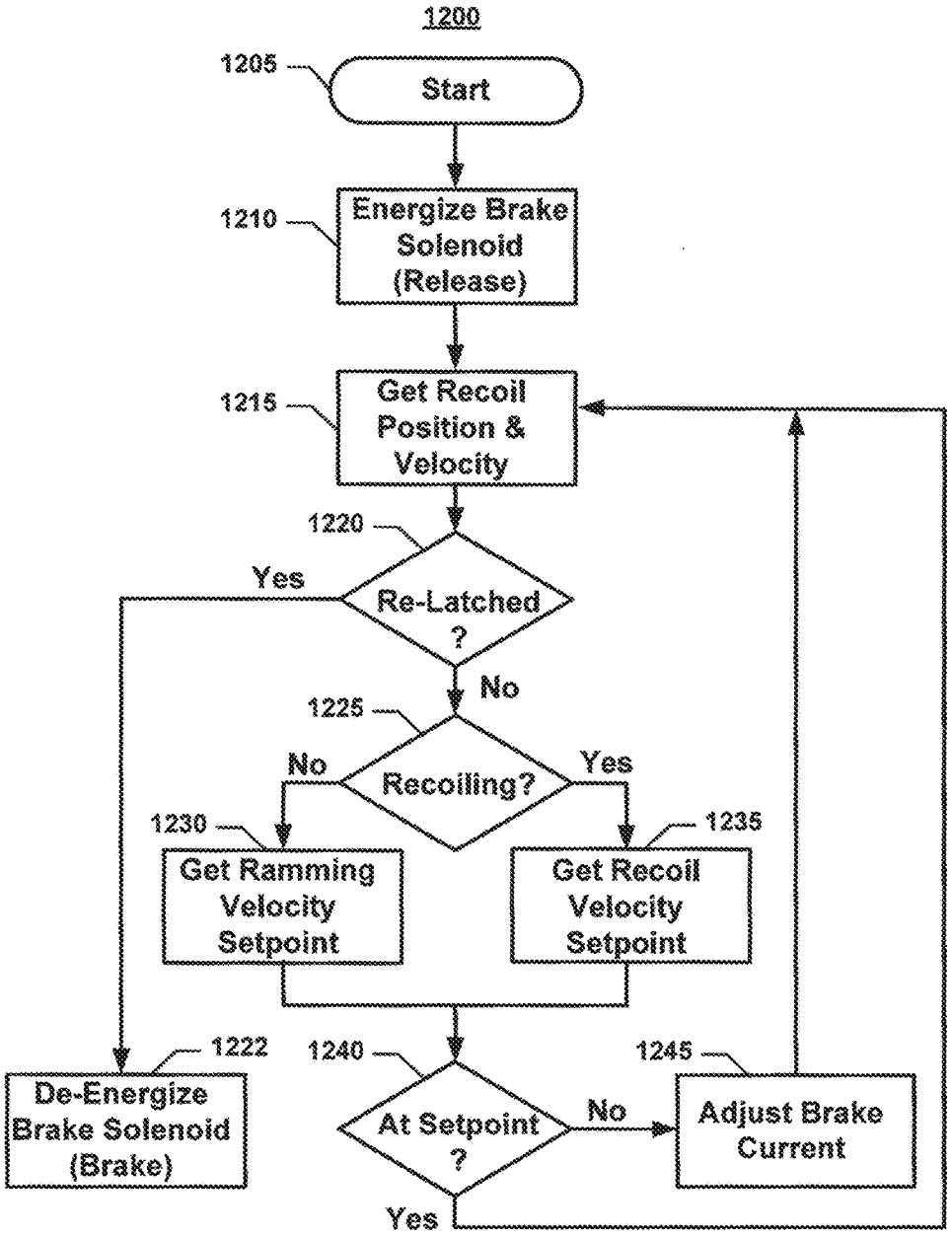
FIG. 16 is a flow chart illustrating the method of operation of a controller that forms part of the active recoil system of FIG. 15, in accordance with an illustrative embodiment of the invention.

FIG. 16 is a flow chart illustrating an exemplary method of operation 1200 of the controller 2200 of FIG. 11. The method 1200 starts at 1205 by initializing the weapon 5 for firing. At step 1205, the method energizes the solenoid 2555 to release the recoil brake 2111. At step 1210, after firing begins, the controller 2200 collects the recoil position and velocity of the recoiling mass 20.

At step 1220, the method 1200 inquires whether the recoiling mass 20 is relatched, that is if the gun 30 has returned to its starting position. If it has, then the controller 2200 deenergizes the solenoid 2555 causing it to apply a braking force. If, on the other hand, it is determined at step 1220 that the recoiling mass 20 has not relatched, then the process 1200 further inquires at step 1225 if the recoiling mass 20 is still recoiling.

If it is determined that the recoiling mass 20 is not recoiling, then the process 1200 calculates, at step 1230, the ramming velocity setpoint using for example, the round temperature, the round charge and the weapon cant weapon attitude, temperature, round height, the charge height, and other parameters. If, on the other hand, it is determined that the recoiling mass 20 is recoiling, then the controller 2200 calculates the recoil velocity setpoint, at step 1235.

The process 1200 then proceeds to step 1240 where it inquires if the recoiling mass 20 is at the proper setpoint. If it is, then the process 1200 loops back to step 1215 and follows the remaining steps as described earlier. If, however, it is determined that the recoiling mass 20 is not at the proper setpoint, then the controller 200 adjusts the brake current in order to cause the recoil brake 2111 to apply the desired appropriate braking force on the recoiling mass 20.

With reference to FIGS. 1 and 2, they illustrate an exemplary automated weapon 5 that is provided with an active soft recoil control system 100, according to a preferred embodiment of the present invention. In this example, the automated weapon 5 includes an ammunition feeding mechanism 10, a gun tube 30, and a recoiling mass 20 that translates back and forth within a firing chamber 25.

While the ammunition feeding mechanism 10 is shown as including four rounds 11, 12, 13, and 14, it should be clear that the ammunition feeding mechanism 10 can be provided with a different number of rounds, wherein each round, i.e., 11, 12, may be respectively stored in a storage cell, i.e., 105, as described below.

The general operation of the automated weapon 5 will now be described in connection with FIGS. 1A through 1D. FIG. 1A shows the first round 11 being advanced in line with the gun tube 30, and the recoiling mass 20 being cocked and latched. FIG. 1B shows the recoiling mass 20 unlatched and ramming the first round 11 forward, along the arrow A, causing the first round 11 to be fired through the gun tube 30. FIG. 1C shows the first round 11 exiting the gun tube 30, resulting in a soft recoil effect, wherein the reaction forces ensuing from the firing of the first round 11 cause the recoiling mass 20 to move back, along the arrow B, and to latch. It should be noted that the firing pin ignites the primer while the recoil is in motion, which is contrary to conventional recoil systems. FIG. 1D illustrates the recoiling mass 20 latched, with the ammunition feeding mechanism 10 indexed to the next round 12.

FIG. 2 illustrates the active soft recoil control system 2100 of the present invention mounted on the recoiling mass 20 of the weapon 5, for adjusting the damping force of a mechanical recoil brake 2111 during recoil and counter-recoil strokes, in order to enable efficient handling of extreme firing conditions and the firing of multiple charges without hardware change.

FIG. 2 further illustrates a bi-directional recoil mechanism (also interchangeably referred to herein as soft recoil system or soft recoil containment system) that is secured to both the recoiling mass 20 and the recoil brake 2111 for preventing double strike, improving recoil force management, and reducing the potential for "short" rounds. The bi-directional recoil mechanism also provides for a mechanism that enables safer firing pin retraction according to the teaching of the present invention.

Figure 17:
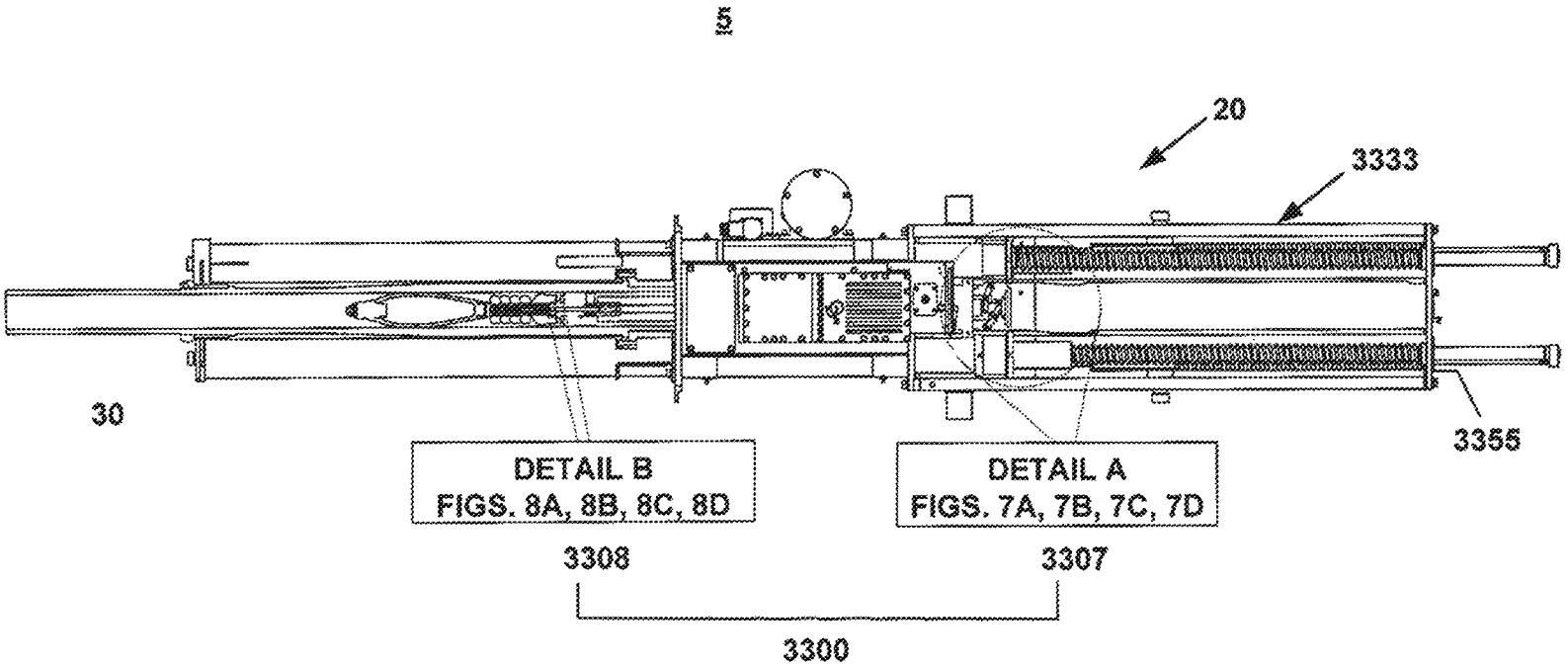
FIG. 17 is a partly cross-sectional view of the automated weapon of FIG. 1A, taken along line 3-3 thereof, showing a projectile inside a gun tube of the automated weapon, and further illustrating a bi-directional recoil mechanism, and a double strike prevention system comprised of a pin retraction mechanism (Detail A) and a firing pin assembly (Detail B), according to an exemplary embodiment of the present invention.

FIG. 17 is a cross-sectional view of the automated weapon 5 of FIG. 1A, taken along line 3-3 thereof, illustrating the bi-directional recoil mechanism 3333, and the projectile 11 inside the gun tube 30. As stated herein, the present invention can be used in systems that employ soft recoil, such as mortar systems, to reduce recoiling forces. In a soft recoil system, the rearward momentum of the weapon 5, as a result of firing, is partially cancelled by the forward momentum of the recoiling mass 20 at the time of firing.

Figure 18A:
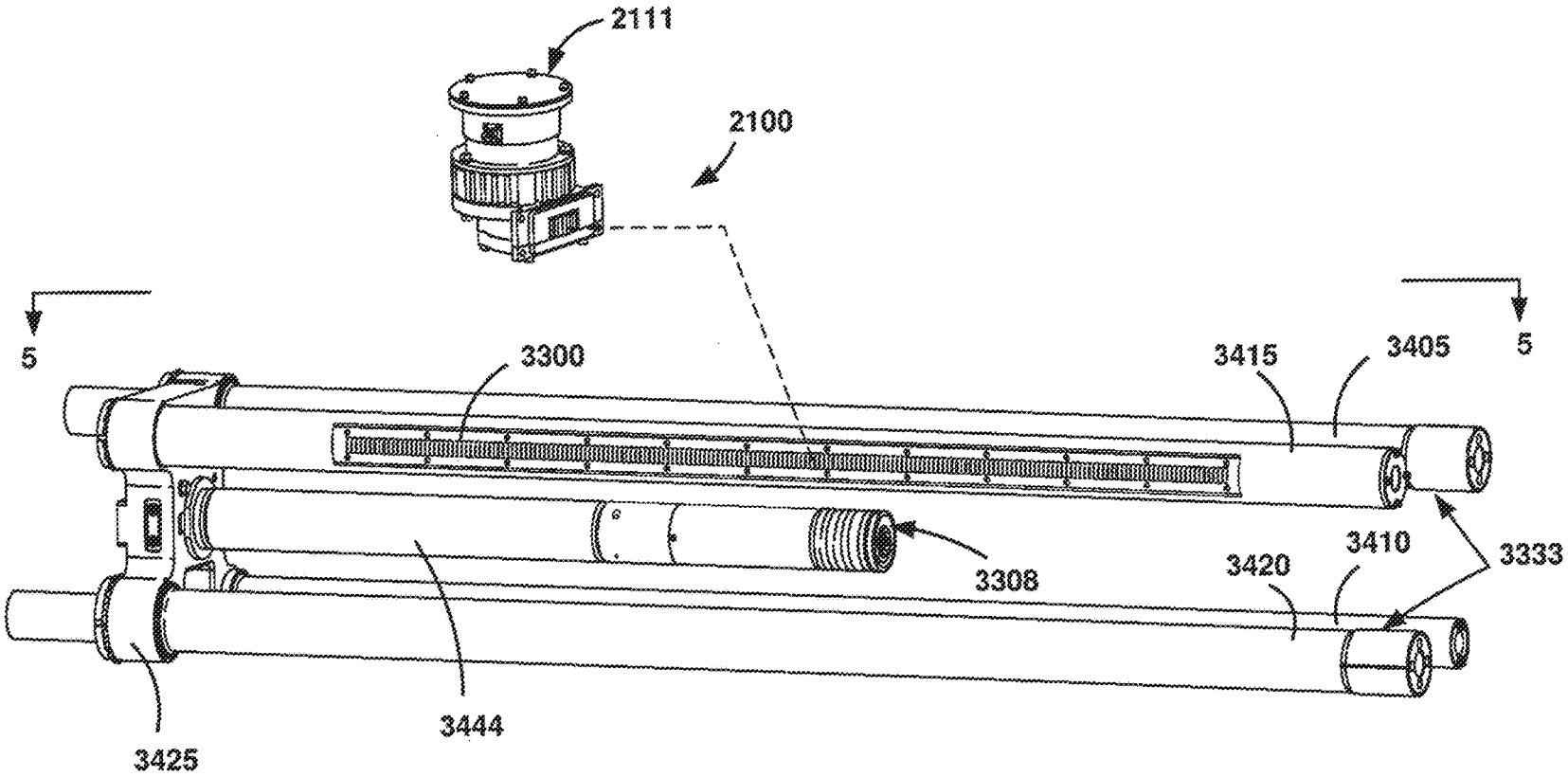
FIG. 18A is an enlarged, isometric, perspective view of the recoil mass of FIG. 17, illustrated as comprising four pistons that surround an axially disposed rammer (or breech), in accordance with an illustrative embodiment of the invention.
Figure 18B:
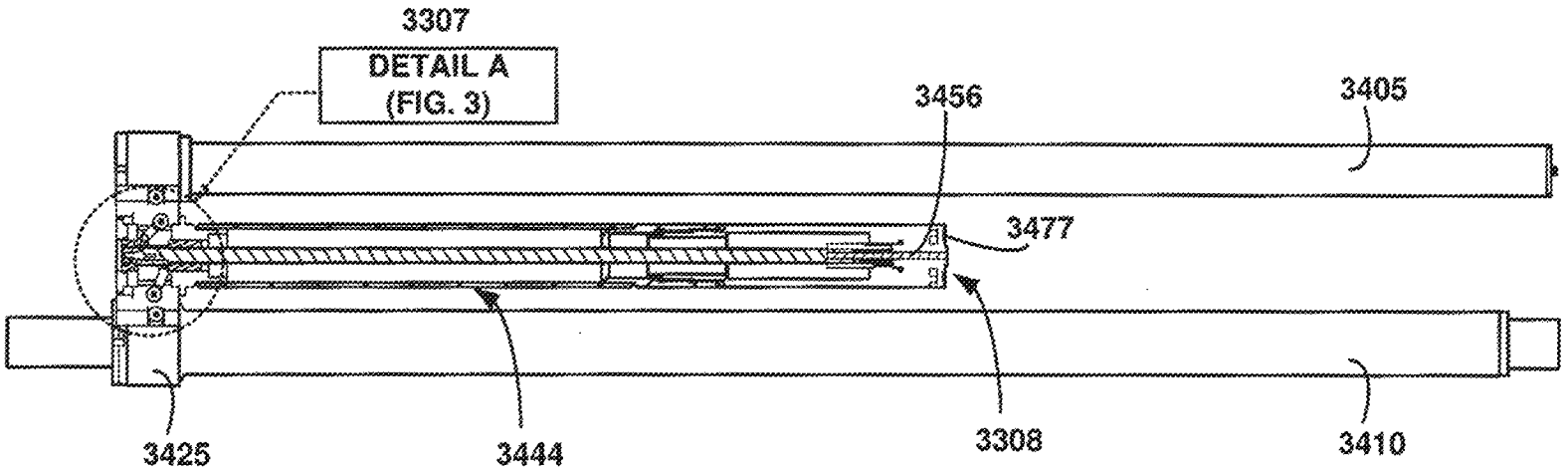
FIG. 18B is a partly cross-sectional view of the recoil mass of FIG. 18A, taken along line 5-5 thereof, in accordance with an illustrative embodiment of the invention.

FIGS. 18A and 18B illustrate the recoil mass 20 of FIG. 17 as comprising four pistons (or cylinders) that surround an axially disposed rammer (or breech) 3444, and a rear bracket 3425 that engages the rear ends of the four pistons 3405, 3410, 3415, 3420. The bi-directional recoil mechanism is contained within pistons 3405 and 3420. A gear track 3430 is formed on one of the pistons, i.e., 3415, for engaging a trim brake mechanism 2111

The recoil mass is normally held out of battery by a known or available latch mechanism (not shown) against a series of known or available compression springs (not shown). When the latch mechanism is released, the recoiling mass 20, including the bi-directional recoil mechanism 3333, is accelerated forward by the compression springs.

When designing the soft recoil system of the automated weapon 5, a balance is sought between the forward momentum of the recoiling mass 20 and the firing impulse, to ensure that the round 11 fires and that the weapon 5 re-latches, while minimizing recoil forces. Since the weapon 5 may perform under a variety of conditions, including variations in ambient temperatures and propellant performance as well as weapon orientations (quadrant elevations) and platform cants, and because if latching does not occur the weapon must be brought back into latch by a secondary charging mechanism and will result in reduced rate of fire, it is necessary to incorporate bi-directional recoil mechanism 3333 to compensate for these variations, in order to ensure latching, and to minimize the recoil loads.

Typically, hydro-pneumatic recoil systems are utilized on large-caliber weapons to accomplish this task, while some small caliber systems utilize ring springs. The present invention utilizes ring springs, i.e., 3501 (FIG. 19) that are arranged in a novel manner, so that they absorb energy bi-directionally, that is both in the forward and rearward directions.

Figure 19:
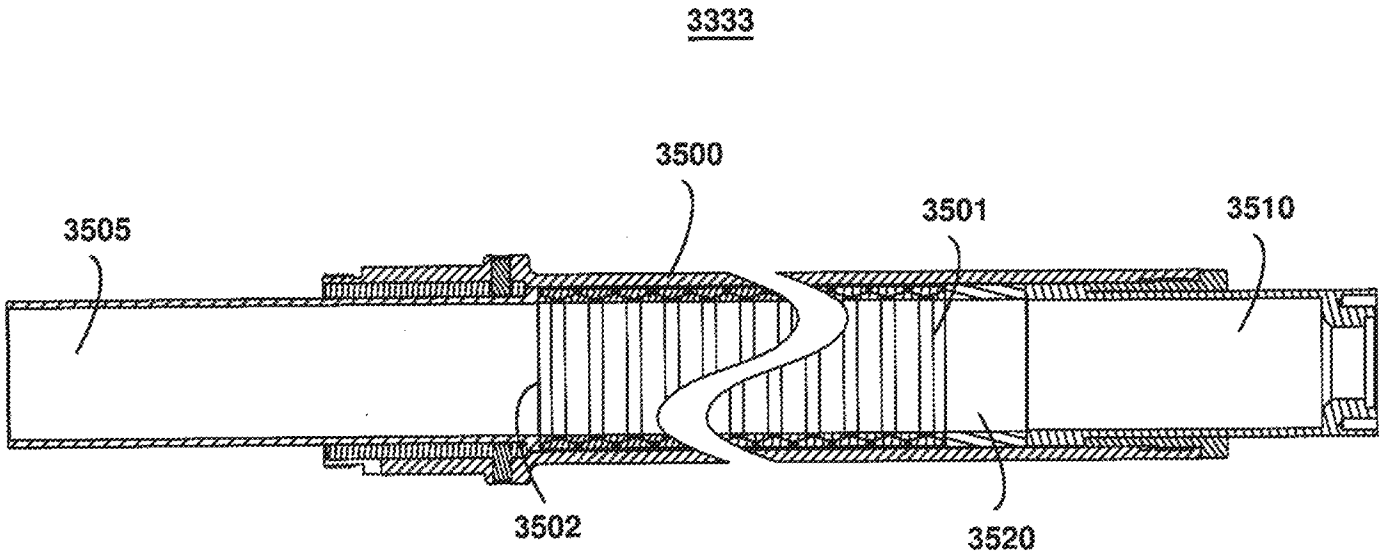
FIG. 19 is an enlarged, partly cross-sectional, fragmented view of the bi-directional recoil mechanism of FIG. 18A, taken along line 5-5 thereof, wherein two cylinders are used in this embodiment of the weapon system, in accordance with an illustrative embodiment of the invention.

FIG. 19 is an enlarged, partly cross-sectional, fragmented view of a representative piston 3405 of the bi-directional recoil mechanism 3333 of FIG. 18A, taken along line 5-5 thereof. The piston 3405 is generally formed of a hollow, tubular ring spring cylinder 3500, within which ring springs 3501 are allowed to be compressed, bi-directionally, between a forward end 3502 of a recoil piston 3505 and a ring spring preload spacer 3520 of a counter-recoil piston 3510. The forward end 3502 and the ring spring preload spacer 3520 act as compression walls for the ring springs 3501, to limit their bi-directional range of travel within the ring spring cylinder 3500, as further illustrated in FIG. 20.

Figures 20A, 20B, 20C:
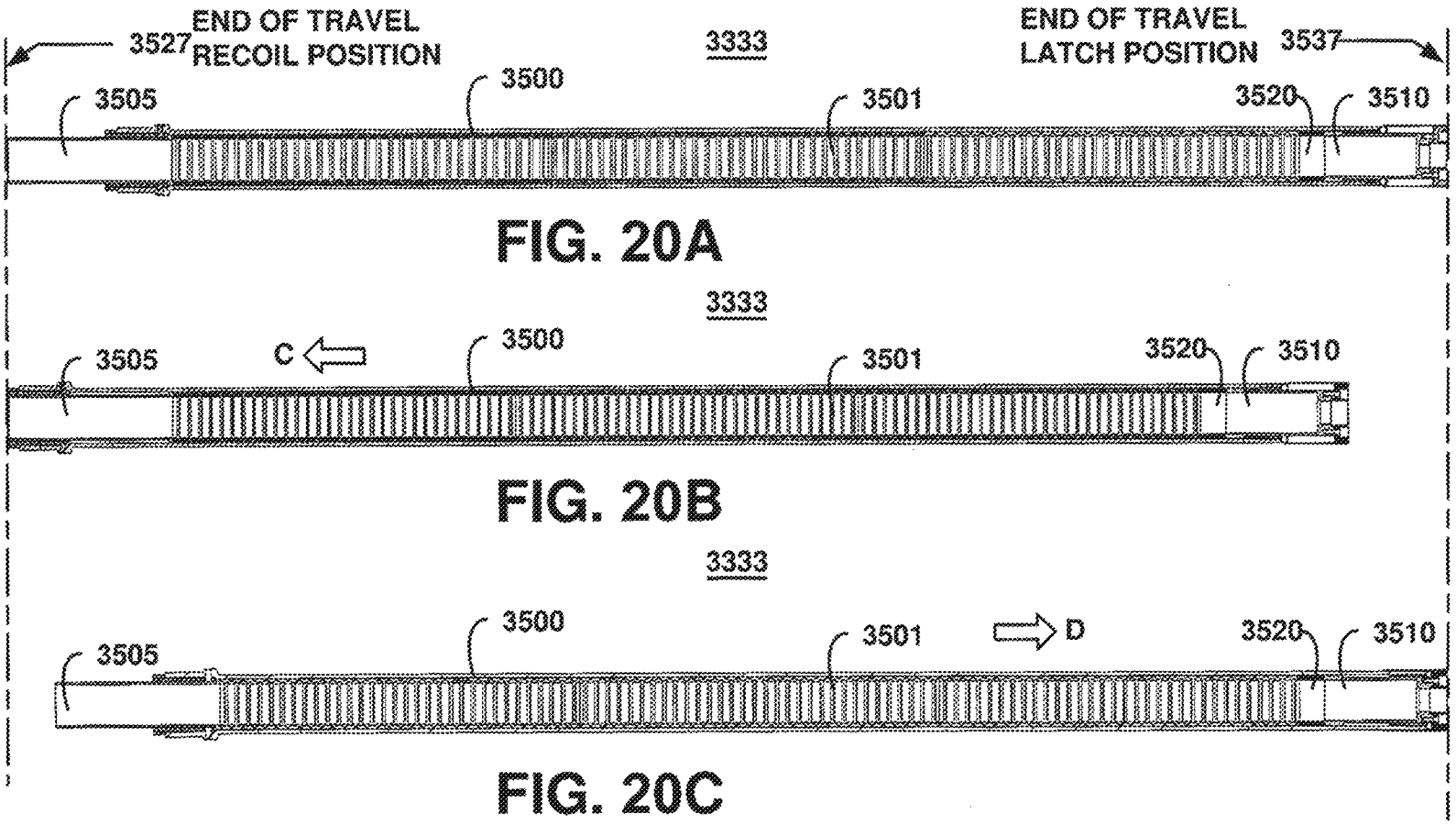
FIG. 20 includes FIGS. 20A, 20B, and 20C, and represents the piston of FIG. 19, in a free state (FIG. 20A), in a recoil state (FIG. 20B), and in a counter-recoil state (FIG. 20C), in accordance with an illustrative embodiment of the invention.

FIG. 20 includes FIGS. 20A, 20B, and 20C, and represents the bi-directional recoil system used in pistons 3405 and 3420 of FIG. 18A in an uncompressed state (FIG. 20A), in a recoil state (FIG. 20B), and in a counter-recoil state (FIG. 20C). In the uncompressed state of FIG. 20A, the uncompressed ring springs 3501 are unbiased and extend axially, within the ring spring cylinder 3500, with the farthest extremity 3507 of the recoil piston 3505 resting (or pressing) against a wall 3527 that marks the end of travel of the recoil position, and a latch mechanism that is represented by a wall 3537 that marks the end of travel of the latch (or counter-recoil) position.

With reference to FIG. 20B, as the recoiling mass 20, including the bi-directional recoil mechanism 3333, moves rearward along the arrow C, the piston 3405 contacts the stationary weapon cradle (not shown), thereby compressing the energy-absorbing ring springs 3501 inside the recoil piston 3405.

With reference to FIG. 20C, After absorbing much (but not all) of the rearward momentum, the ring springs 3501 propel the recoiling mass 20 forward along the arrow D, against the latch mechanism 3537. The counter-recoil piston 3415 contacts the latch mechanism 3537, subsequently compressing the ring springs 3501 from the opposite direction, thereby absorbing the forward momentum and significantly reducing the forces experienced by the latch mechanism 3537.

The recoil state of FIG. 20B and the counter-recoil state of FIG. 20C of this cycle oscillate, thereby dampening the recoil and counter-recoil energy, until all residual energy has been absorbed, and the piston 3405 is returned to the free state of FIG. 20A.

While the recoil mass 20 has been described as comprising four pistons 3405, 3410, 3415, 3420, two of which are bi-directional recoil mechanism cylinders 3333, it should be understood that a different number of pistons may be selected, depending on the intended application for the force mitigation. In addition, while in this exemplary embodiment the bi-directional recoil mechanism 3333 is illustrated as including two similar pistons 3405, 3420, as comprising the bidirectional dampening feature as described in connection with FIG. 20, while the remaining two pistons 3405, 3410 are not provided with such feature, it should be understood that exemplary design has been provided for the sake of explanation and a different number of pistons may be provided with the bidirectional dampening feature.

The need to maintain relatively low recoiling loads, enables the weapon 5 in military applications, and other loads in commercial applications, to be mounted onto light mobile platforms. However, other factors still need to be considered for further improving the present invention. These factors include, without limitation: ignition delays, the ability to react to abnormally high impulses, the ability to perform at greater temperature extremes, and the ability to perform at greater weapon cant.

Ignition delays may, in extreme cases, defeat the advantages of soft recoil. As an example, by the time the mortar cartridge 11 ignites, the forward momentum of the recoiling mass 20 is reduced to zero. In this case, the recoil forces increase significantly, making the weapon 5 less practical for light mobile platforms. Prior weapons 5 have addressed this problem by allowing the combustion gases to vent past the breech seal, thereby reducing the rearward momentum. However, this arrangement may, under certain circumstances, reduce the muzzle velocity of the projectile 11, resulting in the projectile 11 falling unacceptably short of its intended target, and possibly endangering friendly troops or civilians in the vicinity.

To address the ignition delays and other related concerns, the present invention provides a novel double strike prevention system 3300 illustrated in FIGS. 17, 18A, 18B, and 21 through 27.

FIG. 17 further illustrates the automated weapon 5 of FIG. 1A as including the pin retraction mechanism 3307. The pin retraction mechanism 3307 is generally comprised of a firing pin assembly 3900 (FIG. 27) that extends through the recoil mass 20, to a firing pin 3456 (FIG. 18B). The firing pin assembly 3308 extends to the aft section of the projectile 11.

In general, the pin retraction mechanism 3307 enables safer and automatic retraction of the firing pin 3456 (FIGS. 18B, 8) and reduces the potential for unintentionally striking a primer 31110 (shown in dashed lines in FIG. 27) and unintentional initiation of the round 11 during misfire operations. More specifically, the pin retraction mechanism 3307 is designed to perform at least two main functions.

The first function is to render the firing pin 3456 easily accessible and removable, in order to introduce an added degree of safety. This function is useful for transport, misfire procedure, maintenance, and in general, to render the weapon 5 safer to operate because of the inability of the firing pin 3456 to strike the primer 31110.

The second function is the automatic, self-retraction feature of the firing pin 3456, according to which the firing pin 3456 automatically retracts within the firing pin assembly 3900 and thus becomes unable to initiate the primer 31110.

An exemplary situation in which the firing pin of a conventional weapon presents a danger of double striking the round, is where the round is fired at a steep elevation, e.g., around 80 degrees above horizontal. In the event that the firing pin 3456 does not ignite the propellant and the round 11 travels upward, not ignited, within the gun tube 30, the firing pin remains extended from the firing pin assembly. As the round 11 falls back under gravity, it is bound to strike the extended firing pin 3456. The danger emanates from the fact that the forward velocity of the breech 3444 significantly dissipates, causing the round 11 to exit the gun tube 30 while sending the breech 3444 rearward at higher velocities than normal. In general, the rearward velocity of the breech 3444 is the difference between its forward velocity prior to igniting the round 11, and the velocity obtained with no soft recoil effect in traditional recoil systems.

Essentially, the firing pin 3456 of the present invention automatically starts to extend from the recoil mass 20 after the round 11 enters the gun tube 30. Upon completion of the firing pin 3456 striking the round 11, the firing pin 3456 automatically starts to retract within the recoil mass 20.

Considering now the double strike prevention system 3300 in more detail, in connection with FIGS. 18B, and 21 through 25, it forms part of the rammer 3444. FIG. 21 illustrates the pin retraction mechanism 3307 as including a cam profile that regulates the operation of a firing cam 3709 and a safing cam 3705, by means of a firing cam path 3701 and a safing cam path 3702, respectively. The firing cam rocker 3709 pivots about pin 3716, which is attached to rear bracket 3425, and employs a firing cam roller 3706 to roll along the firing cam path 3701. Similarly, the safing cam rocker 3705 pivots about pin 3717, which is attached to rear bracket 3425, and employs a safing cam roller 3711 to roll along the safing cam path 3702.

The pin retraction mechanism 3307 is disposed at the rear section of the recoil mass 20. It is held by a rear bracket 3425, and forms part of the rammer 3444.

To further explain the details of the operation of the double strike prevention system 3300, the operations of the double strike prevention system 3300 and the firing pin assembly 3900 will now be described in connection with the following sets of drawings, {FIGS. 21, 23-25} and {FIG. 22}, respectively.

FIG. 21 illustrates the progression of the four cam stages of the weapon firing cycle, and FIG. 22 illustrates the four stages of the firing pin stroke that respectively correspond to the four stages of the pin retraction mechanism 3307.

Figure 21A:
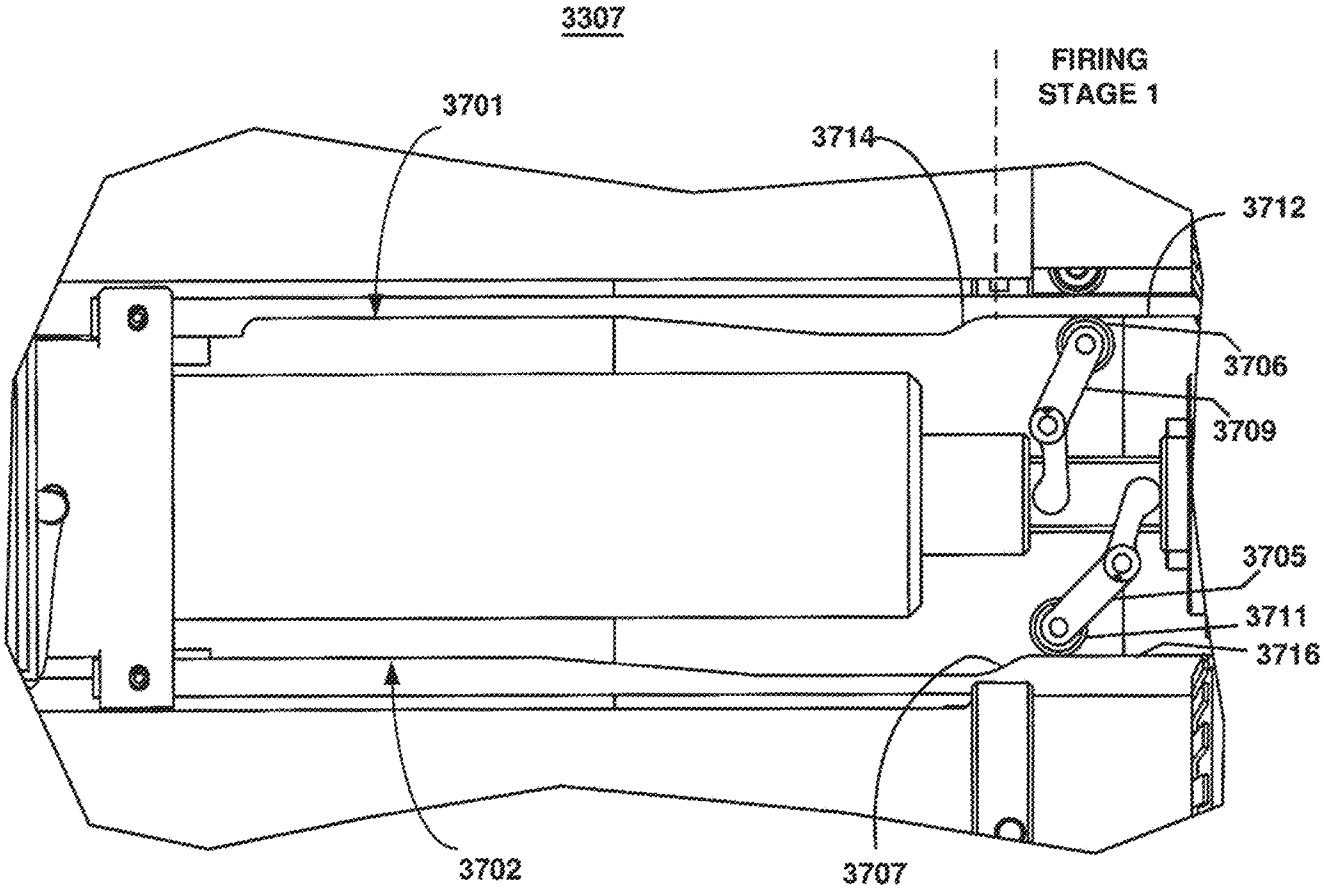
FIG. 21 includes FIGS. 21A, 21B, 21C, and 21D that illustrate the four stages of the pin retraction mechanism (Detail A of FIG. 17), in accordance with an illustrative embodiment of the invention.

FIG. 21A illustrates the double strike prevention system 3300 in a safe state (or position), which further corresponds to FIGS. 1A and 20A. In this first stage, the pin retraction mechanism 3307 is stationary relative to the rammer 3444 and the firing pin 3456 is retracted inwardly from the forward face 3477 of the rammer 3444 (FIGS. 18B, 26A). The safing cam roller 3711 is shown riding a first high profile 3716 of the safing cam path 3702, while the firing cam roller 3706 is shown riding a first low profile 3712 of the firing cam path 3701.

Figure 21B:
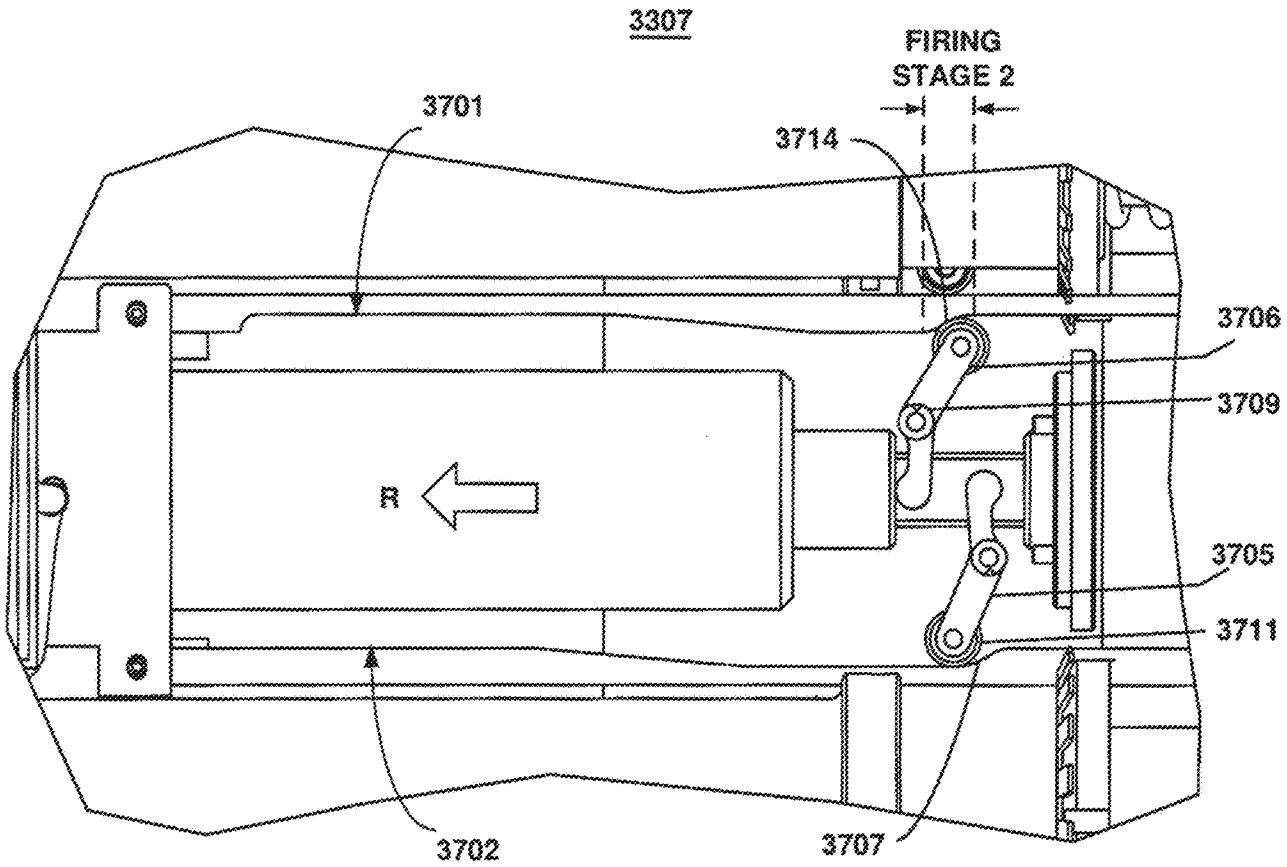
Figure 22A:
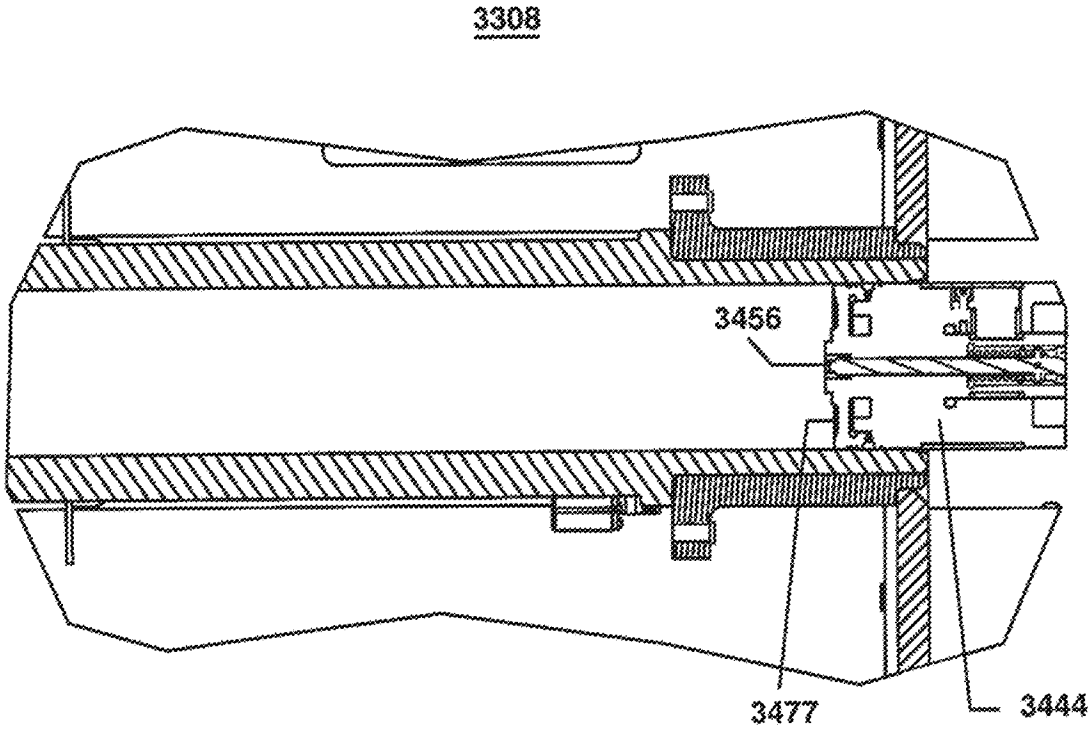
FIG. 22 includes FIGS. 22A, 22B, 22C, and 22D that illustrate the four stages of the firing pin stroke (Detail B of FIG. 17), it being understood that the four stages of FIG. 22 respectively correspond to the four stages of FIGS. 1 and 21, in accordance with an illustrative embodiment of the invention.
Figure 22B:
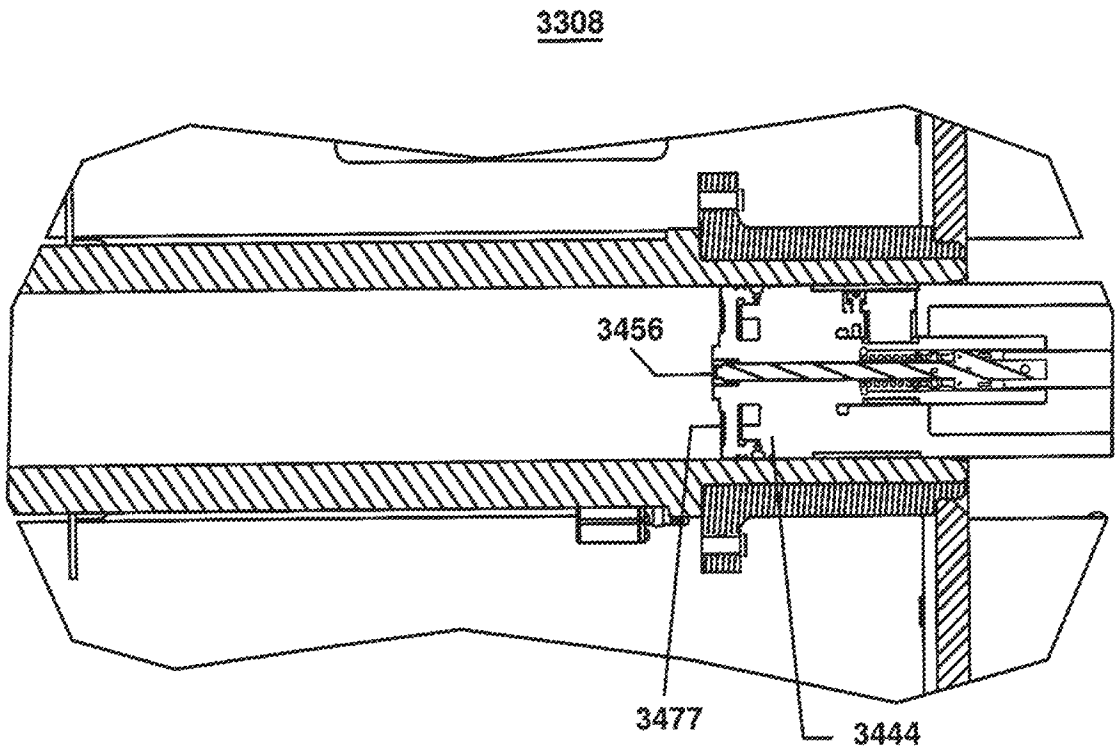

FIGS. 21B and 22B illustrate the second firing stage, namely the pre-recoil stage (or the initial firing pin activation position). In this state, the firing pin guide 3999 is forced to travel in the direction of the arrow R by means of contact between the firing pin guide 3999 and the firing cam rocker 3709, entrailing the firing cam roller 3714 and the safing cam rocker 3705 along its cam path 3701.

Accordingly, the safing cam roller 3711 reaches a low profile section 3707 of the safing cam path 3702, and the firing cam roller 3706 reaches a high profile section 3714 of the firing cam path 3701. At this stage, the firing pin (3456) safety is removed and the firing pin 3456 starts to protrude from the rammer 3444 (FIG. 18B). The contact between the firing cam path 3701 and the firing cam roller 3706 causes the firing cam rocker 3709 to rotate clockwise. This rotation creates contact pressure on the firing pin guide 3999, causing it to translate axially toward the gun tube 30 relative to rammer 3444. The fining pin assembly 3900 is contained within the firing pin guide 3999, allowing for co-axial translation.

Figure 21C:
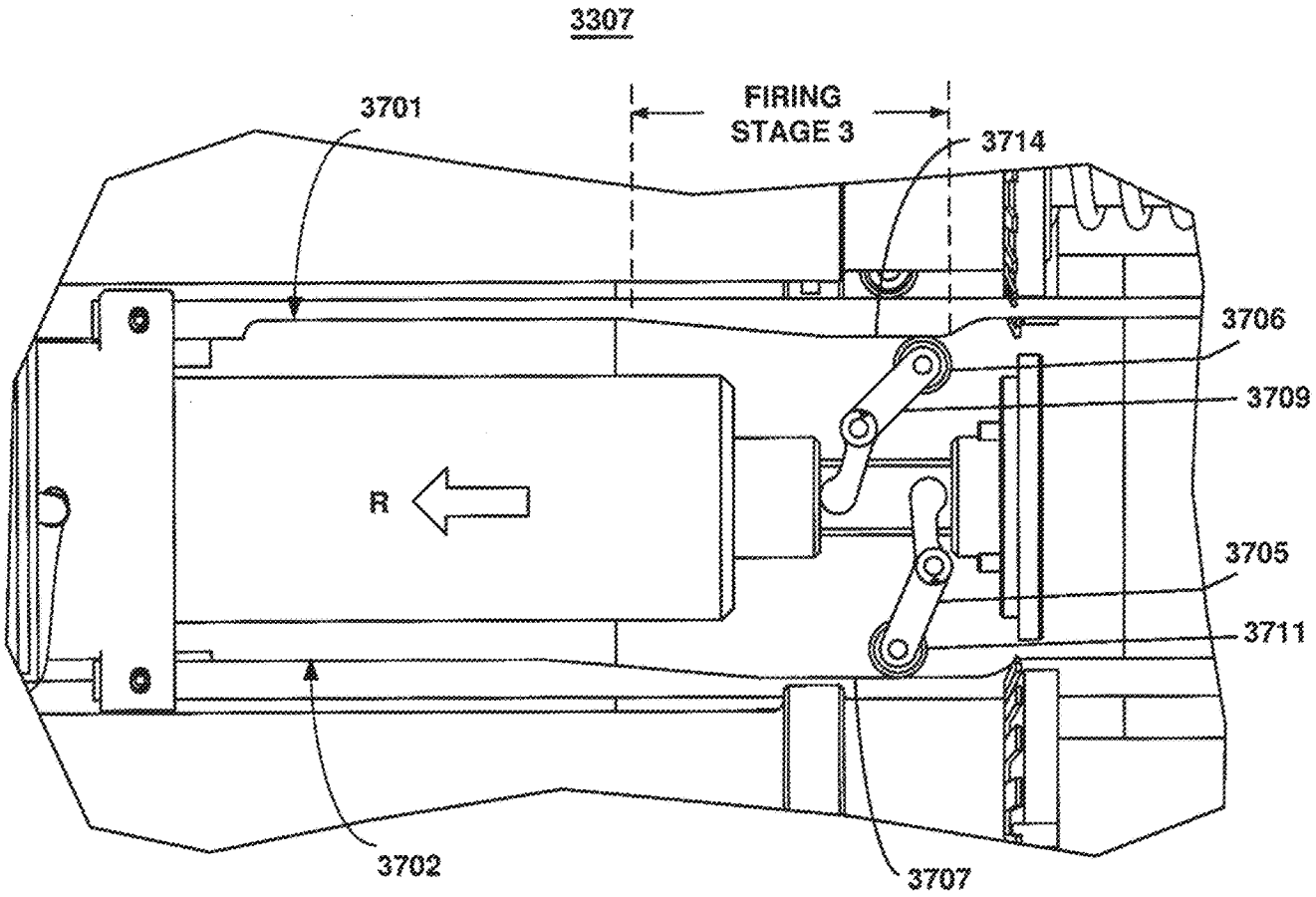
Figure 22C:
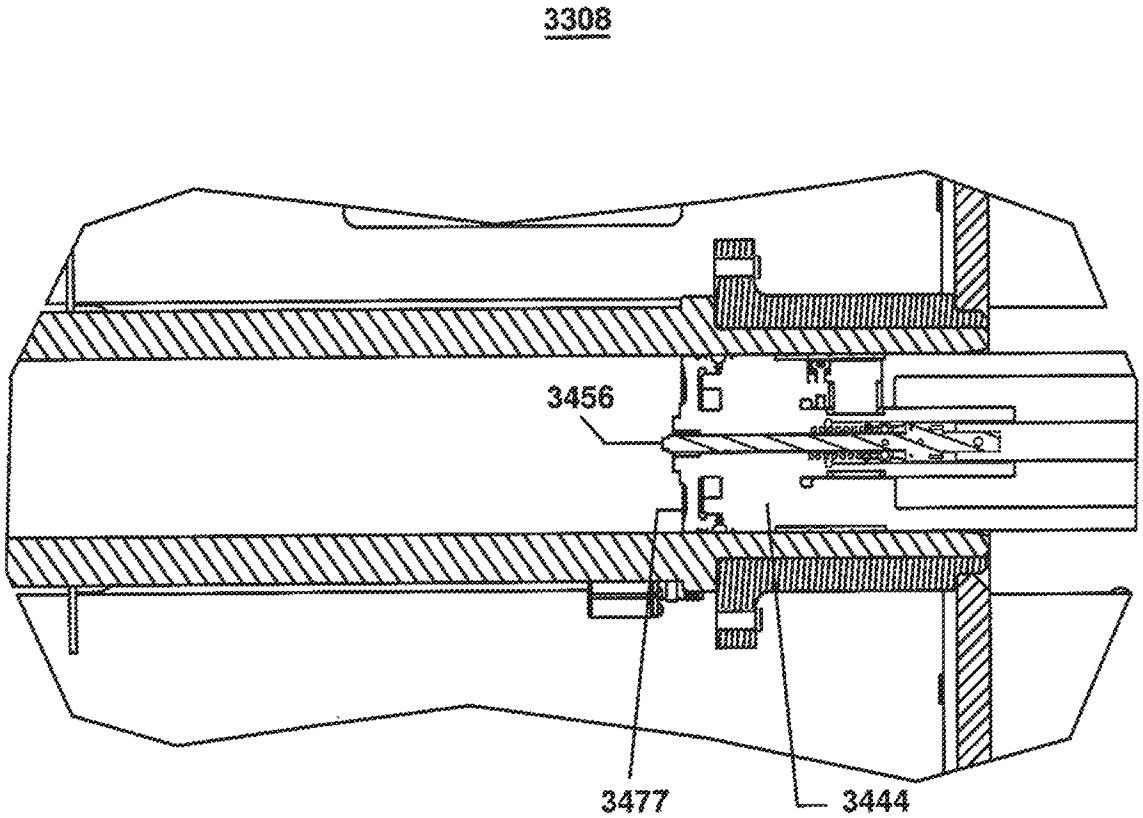

FIGS. 21C and 22C illustrate the third firing stage, namely the recoil stage (or the firing pin fully activated position), which further corresponds to the recoil stages shown in FIGS. 1B, and 20A. At this stage, the pin retraction mechanism 3307 is forced to further travel in the direction of the arrow R, further entrailing the firing cam rocker 3709 and the safing cam rocker 3705 along their respective cam paths 3702, 3701.

Accordingly, the safing cam roller 3711 travels along the low profile section 3707 of the safing cam path 3702, and the firing cam roller 3706 travels along the high profile 3714 of the firing cam path 3701. At this stage, the firing pin 3456 is fully extended from the firing pin assembly 3900 (FIG. 27), and striking the primer 31110. The contact between the safing cam path 3701 and the safing cam roller 3706 causes the safing cam rocker 3705 to rotate clockwise. This rotation creates contact pressure on the firing pin guide 3999, causing it to translate axially toward the gun tube 30 relative to rammer 3444. Under normal operating conditions, the ignition of the propellant in the round, will create enough force to stop the recoil mass and reverse its direction prior to entering into the fourth stage.

Figure 21D:
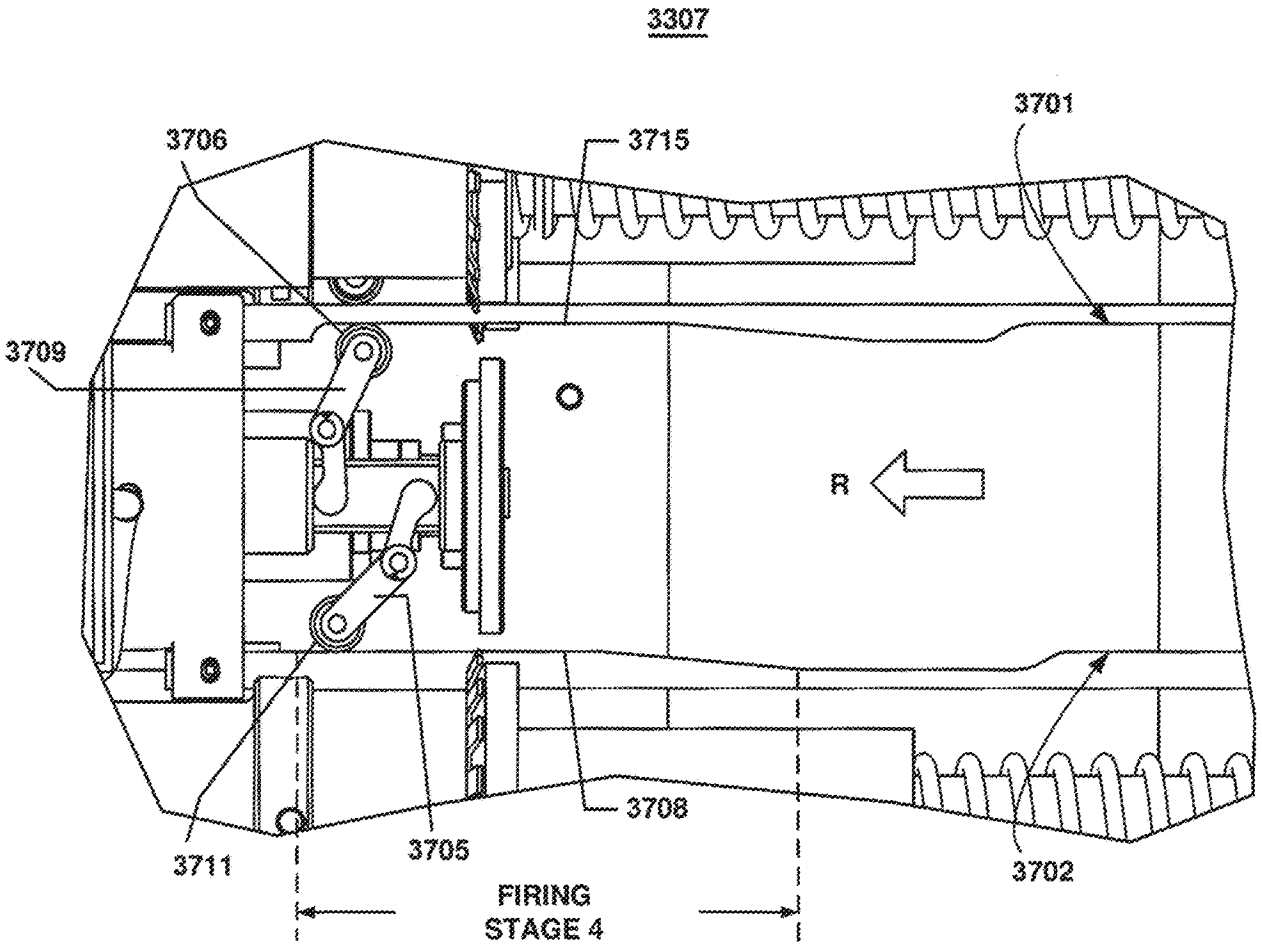
Figure 22D:
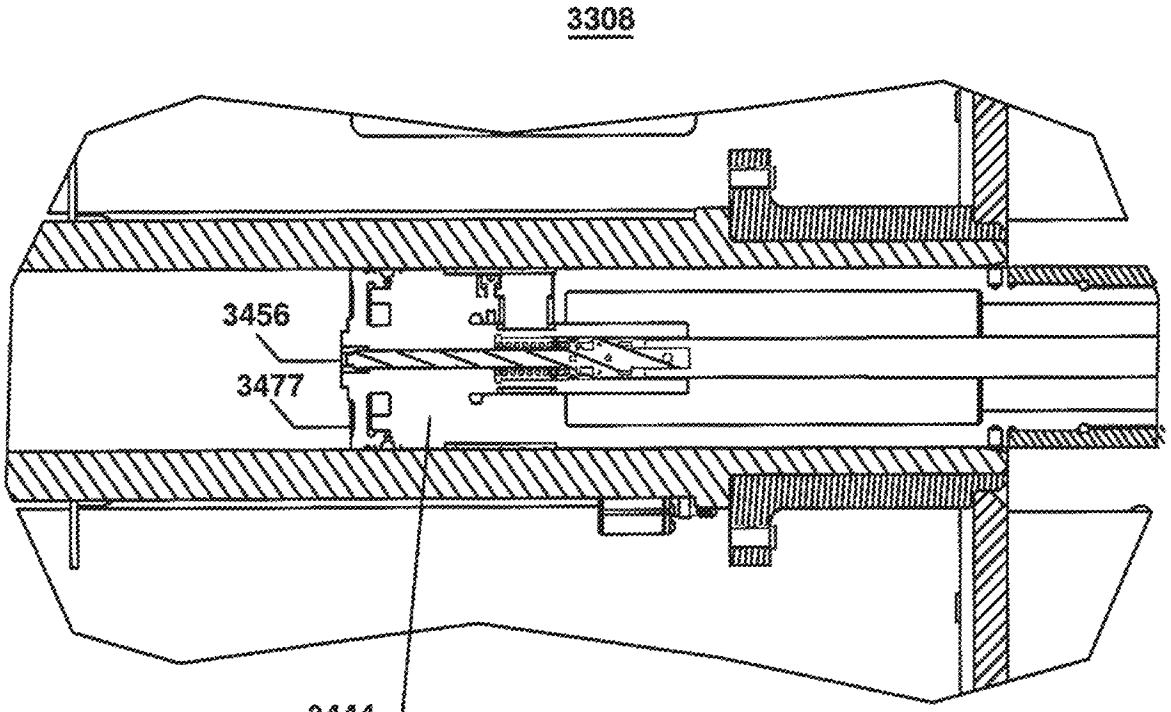
Figure 23:
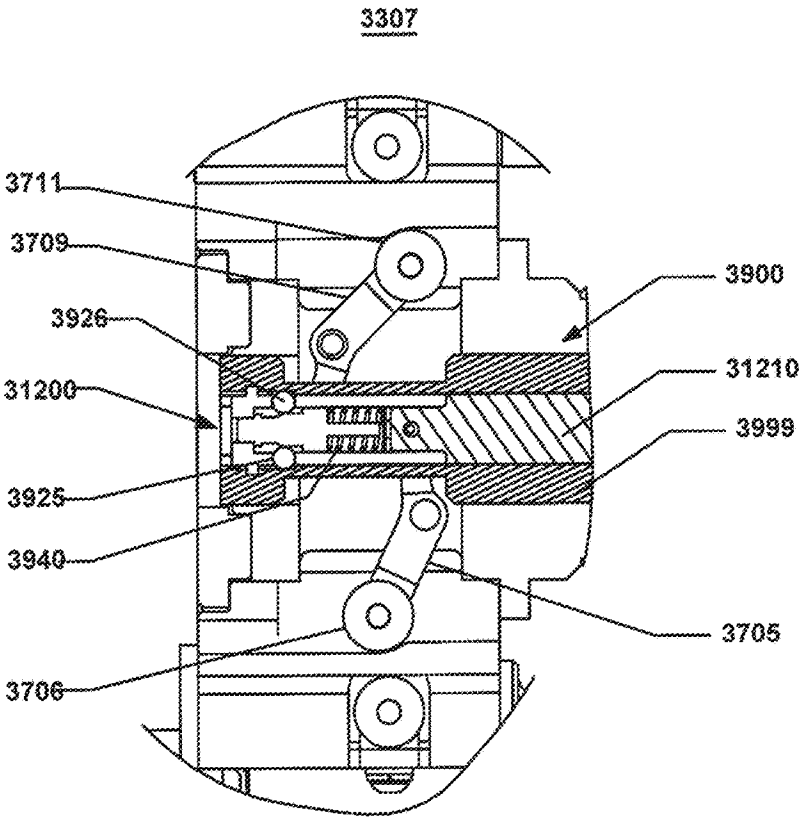
FIG. 23 is an enlarged, partly cross-sectional view of the pin retraction mechanism (Detail A of FIG. 17), further illustrating a firing pin locking assembly that includes a cam assembly, in accordance with an illustrative embodiment of the invention.
Figure 24A:
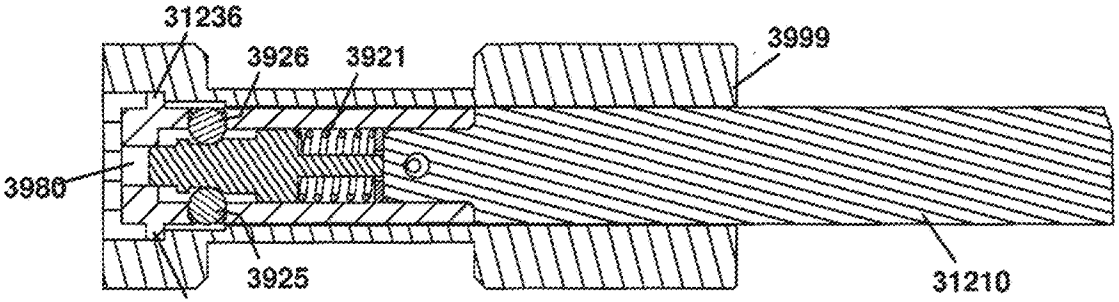
Figure 24B:
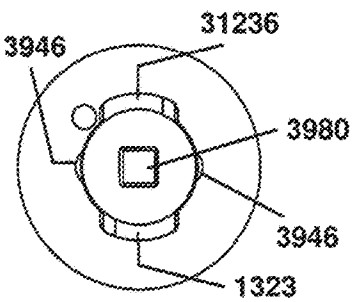
FIG. 24B is a rear view of the firing pin locking assembly of FIG. 24A, in accordance with an illustrative embodiment of the invention.
Figure 25A:
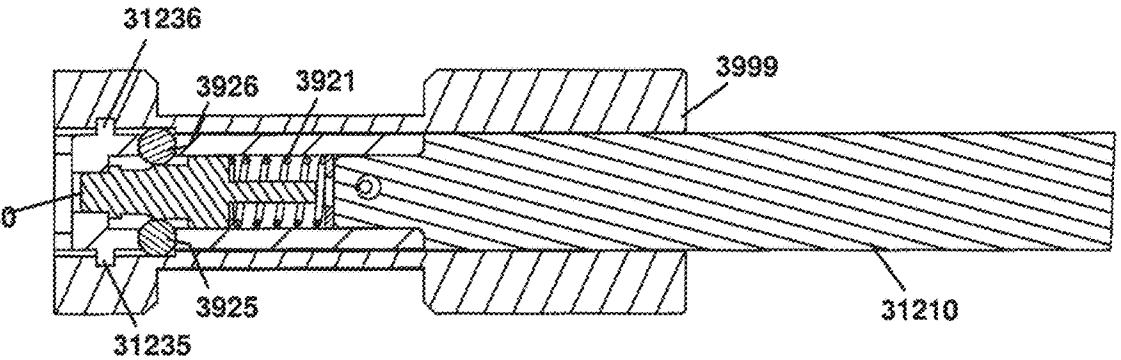
Figure 25B:
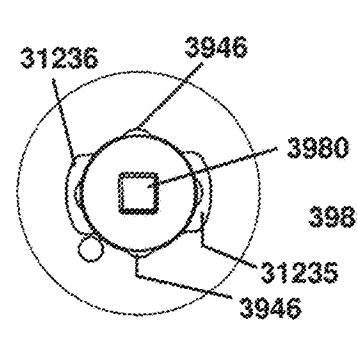
FIG. 25B is a rear elevational view of the firing pin locking assembly of FIG. 25A, in accordance with an illustrative embodiment of the invention.
Figure 26:
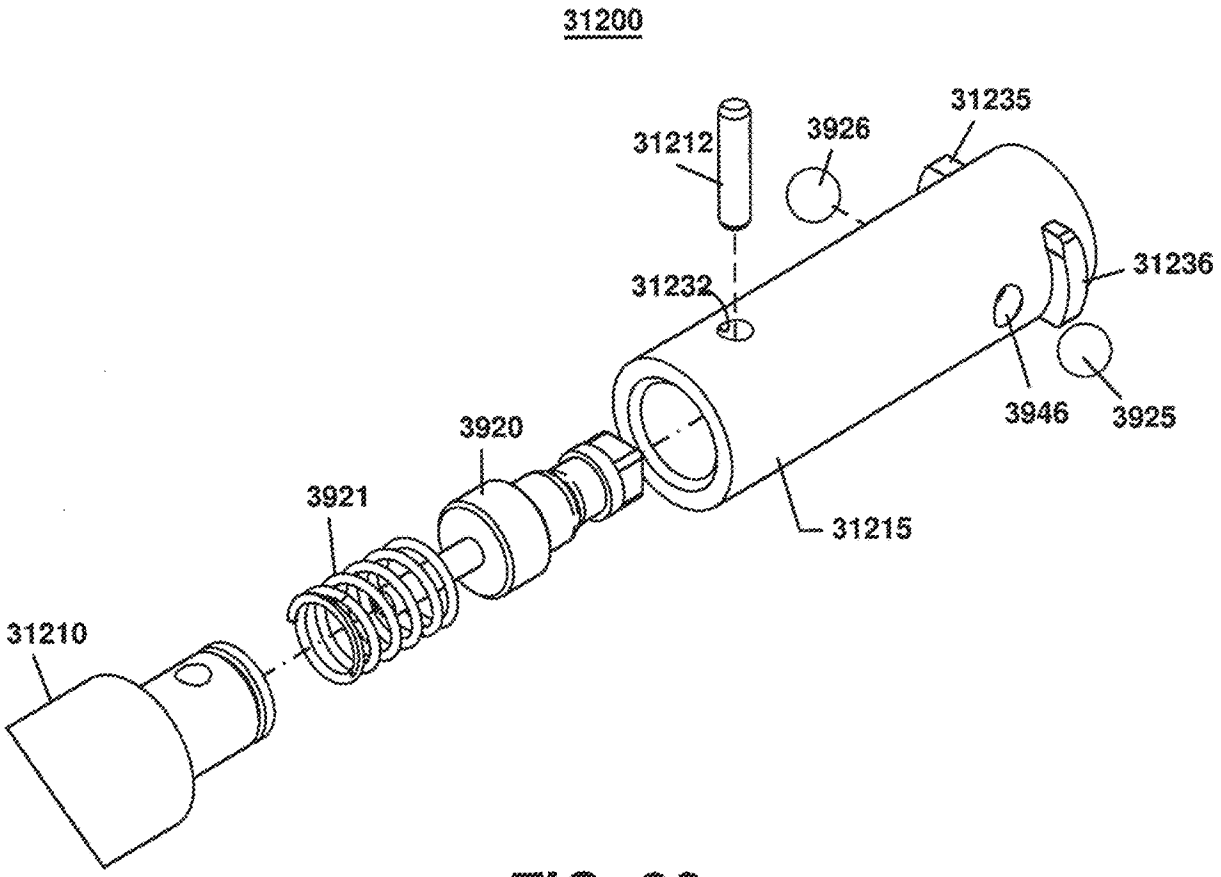
FIG. 26 is an exploded, isometric view of the cam assembly of the firing pin locking assembly of FIGS. 23 through 25, in accordance with an illustrative embodiment of the invention.
Figure 27:
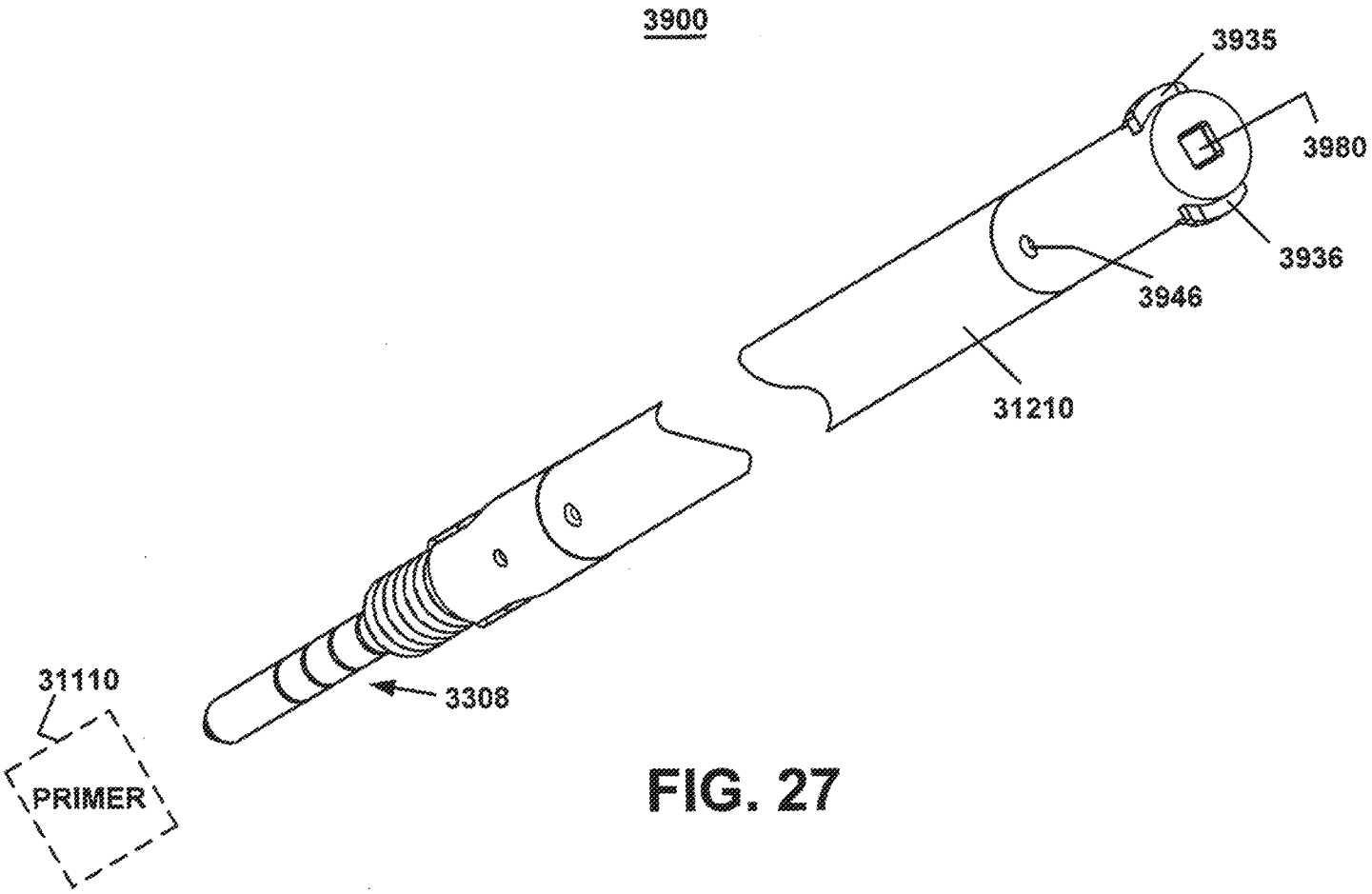
FIG. 27 is a fully assembled, fragmented, isometric view of the firing pin locking assembly of FIGS. 23 and 26, further illustrating the firing pin assembly, in accordance with an illustrative embodiment of the invention.

FIGS. 21D and 22D illustrate the fourth firing stage, namely the safety state (or position). This stage is only activated if there is in sufficient propelling force generated from stage three, i.e. a misfire or extremely late ignition. In the fourth stage, the recoiling mass 20 is forced to travel farther in the direction of the arrow R, further entrailing the firing cam rocker 3709 and the safing cam rocker 3705 along their respective cam paths 3701, 3702.

Accordingly, the safing cam rocker 3705 reaches and continues to travel on a second high profile section 3708 of the safing cam path 3702, and the firing cam rocker 3709 reaches and continues to travels on a second low profile section 3715 of the firing cam path 3701. In this state, the firing pin 3456 is fully retracted back inside the rammer 3444 (FIG. 22D), preventing the firing pin 3456 from striking the primer 31110. The contact between the safing cam roller 3711 and the safing cam path 3702 causes the safing cam rocker 3705 to rotate clockwise. This create contact pressure between the firing pin guide 3999 and the safing cam rocker 3705, which causes the firing pin guide 3999 to translate axially relative to rammer 3444 entrailing the firing pin assembly 3900 away from the gun muzzle.

During the recoil operation of the weapon 5 (FIG. 1C), the above four stages are reversed so that they follow the order: Stages 4, 3, 2, and then 1.

In summary, as the recoiling mass 20 is moving forward, the firing cam rocker 3709 and the safing cam rocker 3705 travel along their respective stationary cam paths 3702, 3701, by means of rollers 3706, 3711. The cam paths 3701, 3702 control the motion of the firing cam rocker 3709 and the safing cam rocker 3705 during the forward and subsequent backward motion of the recoiling mass 20. The motion of the safing cam rocker 3705 prevents the firing pin 3456 from protruding until the recoiling mass 20 has moved to a position where pin protrusion (and subsequent mortar cartridge ignition) is desirable. When the recoiling mass 20 has reached the desirable firing position, the safing cam rocker 3705 will rotate out of the way, allowing the firing cam rocker 3709 to independently rotate, permitting the firing pin 3456 to protrude, thereby causing ignition of the round 11.

In the event of a misfire, in which the round 11 does not ignite as expected, the recoiling mass 20 will subsequently translate further forward than during normal cartridge ignition. In this event, the firing cam rocker 3709 will rotate back, allowing the safing cam rocker 3705 to pull the firing pin 3456 to its retracted position. This is a significant safety improvement over prior fielded systems. First, it guarantees that the firing pin 3456 is safely retracted, preventing an inadvertent ignition. Second, when firing at high quadrant elevation, it protects the weapon 5 from experiencing high recoil forces (after forward motion of the recoil system has stopped) as a result of the round 11 dropping back onto the firing pin 3456 and initiating.

The pressure created by the ignition of the propellant gases will launch the round 11 forward and will launch the recoiling mass 20 rearward, against the force created by the compression springs. During this rearward motion, the safing cam rocker 3705 and firing cam rocker 3709 will return to their initial positions. The recoiling mass 20 is returned to its initial out-of-battery position, and the latch mechanism will capture the recoiling mass 20, preventing it from moving forward, and setting the weapon 5 to fire a subsequent round, i.e., 12.

Figure 28A:
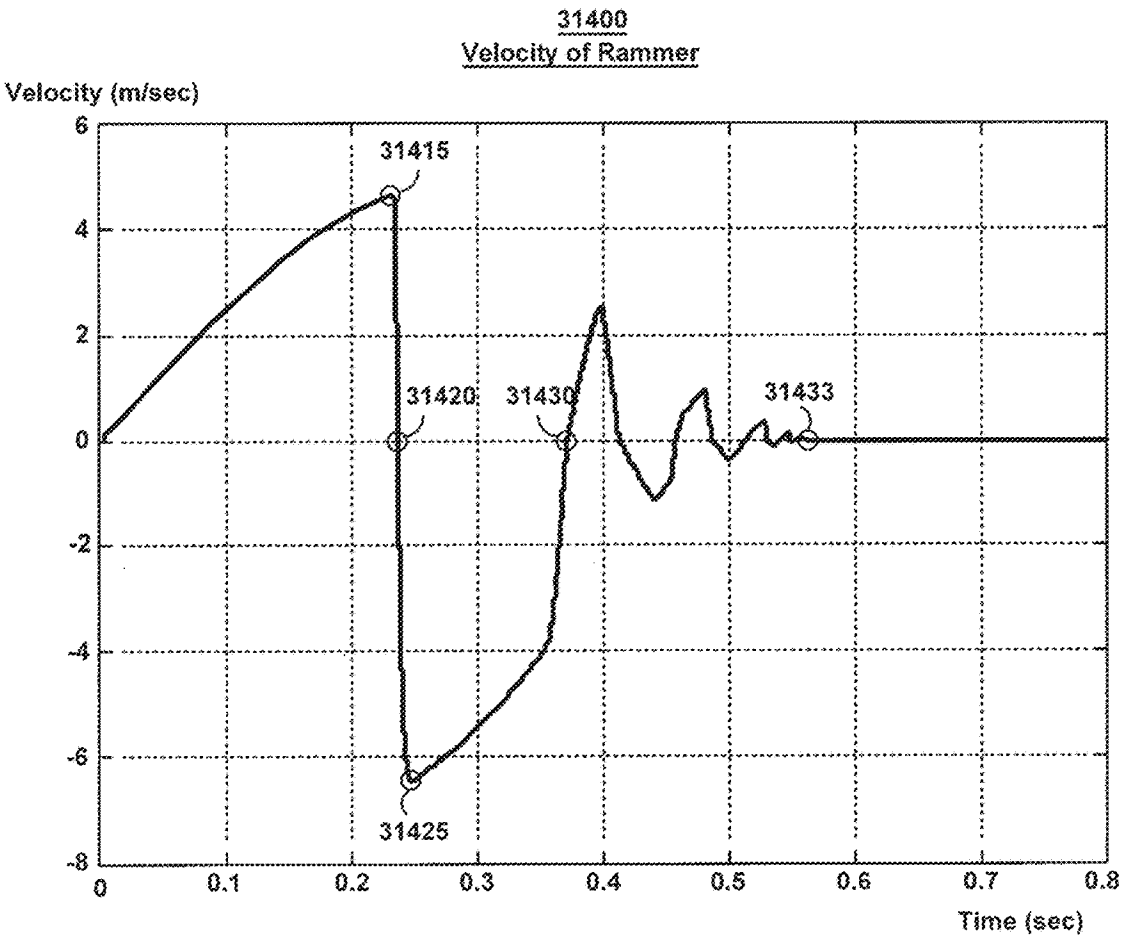
FIG. 28 includes FIGS. 28A and 28B and is a graph that illustrates the velocity of the rammer with respect to time during the firing cycle of the weapon and a graph that illustrates the motion of the firing pin during the firing cycle of the weapon, in accordance with an illustrative embodiment of the invention.

With reference to FIGS. 23 through 26, the pin retraction mechanism 3307 of the present invention additionally incorporates a firing pin locking assembly 3900 that enables the manual removal of the firing pin 3456, for safety, maintenance, and inspection purposes. The firing pin retraction mechanism 3307 is generally disposed within the rear bracket 3425 (FIG. 28A), in proximity to the firing cam path 3701 and the safing cam path 3702 (FIG. 21).

The firing pin assembly 3900 generally includes a cam assembly 31200 (FIG. 26) that is housed within a firing pin guide 3999, and a firing pin twist lock 31215 that has a hollow, cylindrical shape. The cam assembly 31200 can be locked to the housing 3999 by means of two quarter-turn tabs 31235, 31236. Two similar, externally protruding quarter-turn threads 31235, 31236 are disposed diametrically opposed to each other on the firing pin twist lock 31215 of the cam assembly 31200. The two tabs 31235, 31236 are capable of rotating 90 degrees to engage two corresponding slots in the firing pin guide 3999, for retaining the firing pin locking assembly 3900 within the housing 3999.

The cam assembly 31200 further includes two detente balls 3925, 3926 that engage two diametrically opposed cavities 3946 in the wall of the housing 3999. A spring tension pin 31212 inserts vertically through two diametrically opposed holes 31232 formed through the wall of the firing pin twist lock 31215 and into the hole in the extension bar 31210, so that when the firing pin locking assembly 3900 is assembled, the spring tension pin 31212 holds the entire assembly 3900 together.

A firing pin removal (or anti-rotation) cam 3920 provides a caming surface for the detente balls 3925, 3926, and provides a convenient means to access to the firing pin locking assembly 3900, by means of a square socket port 3980 (FIGS. 10B, 11B). The firing pin removal cam 3920 is located within the firing pin twist lock 31215 and rotates with the cam assembly 31200 relative to the firing pin guide 3999.

When it is desired to remove the firing pin 3456, a square shaped socket is inserted in the socket port 3980 and rotated ninety degrees counterclockwise. The axial force on the firing pin removal cam 3920 compresses a compression spring 3921, which, in turn, acts against an extension bar 31210. The compression of the spring 3921 causes the firing pin removal cam 3920 to translate axial towards the muzzle, and the two detente balls 3925, 3926 to roll along the profile of the firing pin removal cam 3920.

When the firing pin removal cam 3920 is pushed forward against the preload of the compression spring 3921, the two detente balls 3925, 3926 are permitted to fall inward, thereby permitting the rotation of the firing pin locking assembly 3900 relative to the firing pin guide 3999. A compression spring attached to firing pin assembly 3308 forces axial motion rearward to allow an operator to grab the firing pin locking assembly 3900 and to remove it. The removal of the firing mechanism is typically required when transporting the weapon 5, for inspection of the firing pin 3456, or for safety purposes in the event of a misfire.

Figure 28B:
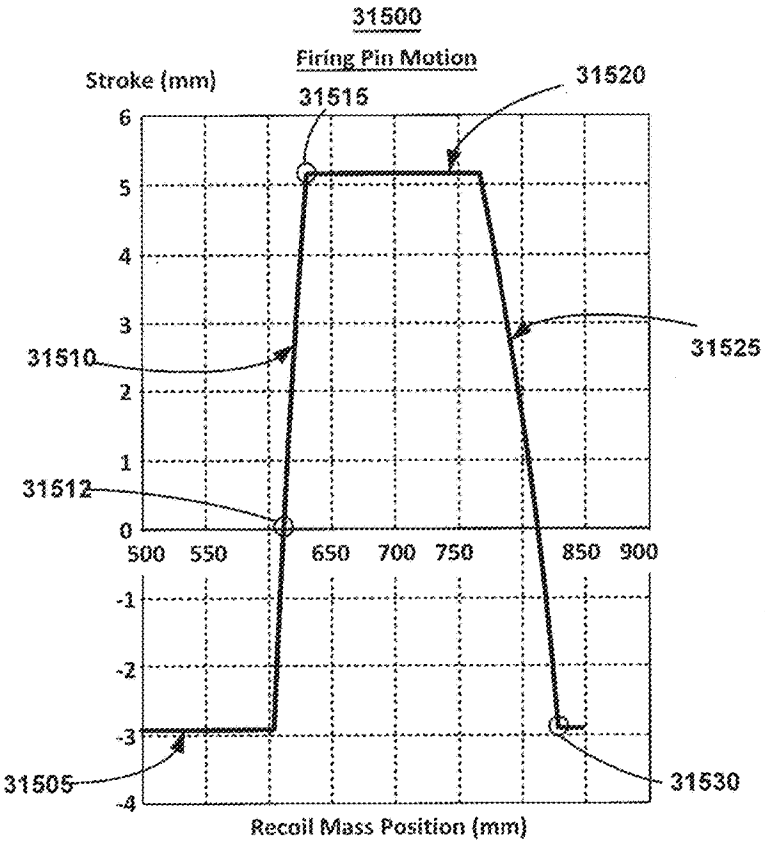

FIG. 28 is a graph 31400 that illustrates the velocity of the recoil mass 20 with respect to time. The recoil mass 20 starts at the initial latched position, which is the zero position (0, 0), at which position, the recoil mass 20 has zero velocity at time t=0. As time progresses, the latch is released, and the recoil mass 20 is propelled forward, gaining velocity as it accelerates. The rammer 3444 with attached moving breach moves a fixed amount into the gun tube. It is at this moment that the firing pin locking assembly 3900 is forced to extend from recoiling mass 20 and ignite the round. Pressure builds which first slows the forward motion of the recoil mass 20, and eventually change its travel direction. This deflection point is referred to by the numeral reference 31415.

At the inflection point 31415, the rammer velocity starts to decrease very quickly (almost instantaneously), and it passes through the zero velocity point (31420), at which the rammer 3444 is said to have made an instantaneous stop. The rammer 3444 then gains acceleration rearward, acquiring a negative velocity, until it reaches a point of maximum speed (31425). The rammer velocity then decreases in absolute value until it stops at the zero position (31430), and then continues to move in the forward direction. The bi-directional recoil mechanism 3333 then travels back and forth from the recoil position to the counter recoil position, slowly damping out any residual energy until the recoil mass 20 comes to a complete stop (31433), at around 0.55 seconds. At this time, the second round will be advanced in line with the gun tube 30 and ready for firing.

FIG. 29 is a graph 31500 that illustrates the motion of the firing pin 3456, in connection with the four firing stages of FIGS. 21 and 22, described earlier. The horizontal segment 31505 represents the first stage of the firing cycle, wherein the negative value of the stroke means that the firing pin 3456 is retracted within the rammer 3444.

The positively sloping segment 31510 relates to the second stage of the firing cycle, wherein the firing pin 3444 starts to extend outwardly at the recoiling mass position of 612.5 mm (31512), until the firing pin 3456 extends fully beyond the forward face 3477 of the rammer 3444 (FIGS. 18B, 22A) at 31515.

The horizontal segment 31520 relates to the third stage of the firing cycle, wherein the firing pin 3456 remains extended until the completion of the propellant ignition stage.

The negatively sloping segment 31525 relates to the fourth stage of the firing cycle, wherein the firing pin 3456 begins to retract, and continues retracting until it is completely retracted beneath the face 3477 of the rammer 3444 at 31530. This stage only occurs in the event of a failed propellant ignition or an attempt to fire without a round 11 inline with the rammer 3444.

Weapons must also be designed to withstand the largest expected chamber pressure for safe operation under the most extreme operating conditions. This pressure, known as the PMP (permissible individual maximum pressure) may be typically as high as 50% greater than ambient temperature firing pressures. Statistically, these conditions may arise 3 times per 10,000 rounds fired, but result in greatly increased recoil forces. The traditional method of addressing this concern is to either increase the recoil distance to keep the forces to an acceptable level, or to design larger, more durable components. Neither solution is entirely acceptable for light mobile platforms.

Additionally, mobile platforms must be able to engage a variety of targets under various environmental extremes, with increased quadrant elevation ranges, and be able to fire at a variety of platform orientations and cants. These factors tend to require reducing the forward momentum of the recoiling parts in order to guarantee latching, which in turn results in higher recoiling forces.

Another aspect of the present invention is the incorporation of a trim brake mechanism or recoil brake 3111, as stated herein. The trim brake mechanism 3111 is added to address the problems associated with extreme operation conditions of the weapon 5. Briefly, the trim brake mechanism 3111 is an energy absorption mechanism that controls the forward and rearward velocities of the recoiling mass 20, regardless of the firing conditions. If the forward velocity were higher than normal (due perhaps to firing with the platform facing down a hill), the trim brake mechanism 3111 senses the velocity deviation resulting from such incline, and retards it to an acceptable level. If on the other hand, the rearward velocity is too high due to PMP pressure, low forward velocity, or an ignition delay, the trim brake mechanism 3111 can retard it, effectively absorbing the recoil energy.

The trim brake mechanism 3111 can be used both in a reactive and predictive fashion. For example, if a cant and quadrant elevation combination are known to cause increased forward velocity, a preplanned trim-braking amount can be applied. Associatively, if an increased velocity is detected, an estimated trim brake amount can be applied to negate the effect.

The incorporation of the trim brake mechanism 3111 makes it possible to eliminate the need to vent propellant gases or to incorporate bulky structures to withstand higher recoil forces.

The trim brake mechanism 3111 is mounted onto the weapon cradle and interfaces with the recoil mechanism by means of a straight gear rack 3430 (FIG. 18A). The translational motion of the recoil system during firing, imparts rotational motion to the trim brake. A solenoid (not shown) controls the amount of force applied to the trim brake mechanism 3111, thereby controlling the recoil velocity.

FIG. 29 is an isometric perspective view of the ammunition feeding mechanism shown in FIG. 1, such as a rotating, continuous belt-type magazine of the automated weapon, wherein the ammunition feeding mechanism is formed of a plurality of interconnected storage cells, each of which embodies a retention system according to an embodiment of the present invention, and one gun tube clearance cell which ensures that that the gun tube of the automated weapon is clear and unobstructed, in accordance with an illustrative embodiment.

As further illustrated in FIG. 29, the ammunition feeding mechanism 10, can be, for example, a rotating, continuous belt-type magazine of the automated weapon 5. The ammunition feeding mechanism (or magazine) 10 of this particular example, is formed of a plurality of generally similar interconnected storage cells (i.e., 4105, 4106) each of which embodies a retention system 4100 according to a preferred embodiment of the present invention. The ammunition feeding mechanism 10 is also comprised of one (or more) gun tube clearance cell 4200, which ensures that the gun tube 30 of the automated weapon 5 is clear and unobstructed.

The general operation of the automated weapon 5 will now be described in connection with FIGS. 1A through 1D. FIG. 1A shows the first round 11 being chambered, and the recoiling mass 20 being cocked and latched. FIG. 1B shows the recoiling mass 20 unlatched and ramming the first round 11 forward, along the arrow A, causing the first round 11 to be fired through the gun tube 30.

FIG. 1C shows the first round 11 exiting the gun tube 30, resulting in a soft recoil effect, wherein the reaction forces ensuing from the firing of the first round 11 cause the recoiling mass 20 to move back, along the arrow B, and to latch. FIG. 1D illustrates the recoiling mass 20 latched, with the ammunition feeding mechanism 10 indexed to the next round 12. While the preferred embodiment is described in terms of a soft recoil effect, it should be amply clear that the present invention is not limited to soft recoil mechanisms, and that an exemplary soft recoil mechanism is presented herein for illustration purpose and does not purport to be the exclusive embodiment covered by the present invention.

FIG. 30 is a partly exploded view of the storage cell 4105 that forms part of the ammunition feeding mechanism 10 of FIG. 29. The storage cell 4105 is characterized by the retention system 4100 according to a preferred embodiment of the present invention. The storage cell 4105 includes a generally cylindrically shaped, hollow canister 4300, and the retention system 4100 that is mounted onto the canister 4300 for securing and protecting the round, i.e., 11, within the ammunition feeding mechanism 10 of the automated weapon 5, and for further selectively and safely ejecting the round, i.e., 11, from its corresponding storage cell, i.e., 4105. In this embodiment, the canister 4300 is open at both its front end 4250 and its rear end 4251.

The retention system 4100 is generally formed of a front door assembly 4301, a rear door assembly 4303, a central support collar 4379, and a clamping spring 4370. The front door assembly 4301 and the rear door assembly 4303 are generally similar in design and function, and thus only the front door assembly 4301 will be described in greater detail.

Considering now the front door assembly 4301, it generally includes a front door shaft 4356, a front rotating door 4380, a front door release lever 4350, a front door return spring 4357, a first front door shaft support 4358, and a second front door shaft support 4308.

The front door shaft 4356 is preferably, but not necessarily, a metallic rod whose length is approximately equal to half the length of the canister 4300 plus the thickness of the assembled front door linking collars 4375, 4376 and the front rotating door 4380.

The front rotating door 4380 is made of a crescent-shaped metallic sheet. It is secured to forward end of the front door shaft 4356, so that it selectively opens and closes the front open end 4250 of the canister 4300. In this illustration, the front door shaft 4356 can be rotated by approximately fifty-five (55) degrees. Concurrently, and as further illustrated in FIG. 29, the closed front rotating door 4380 provides support to a nose 41205 (FIG. 39) of the round 11.

Figure 35A:
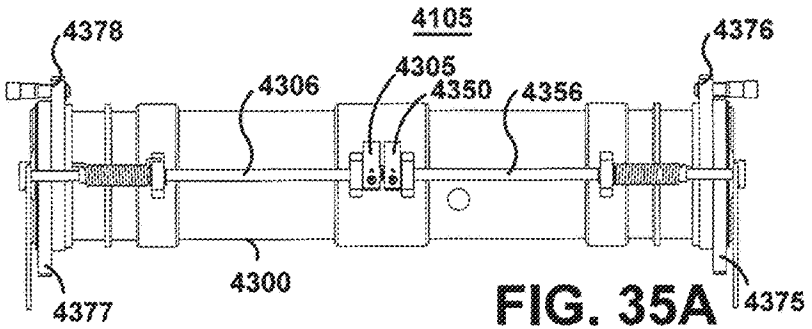
Figure 35B:
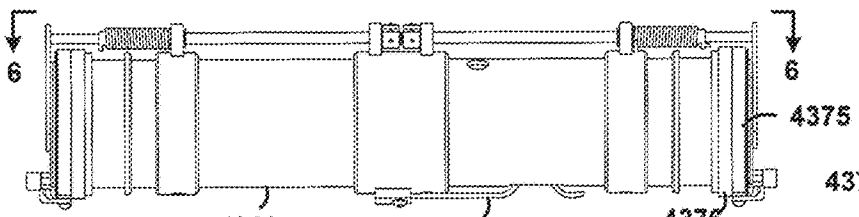
Figure 35C:
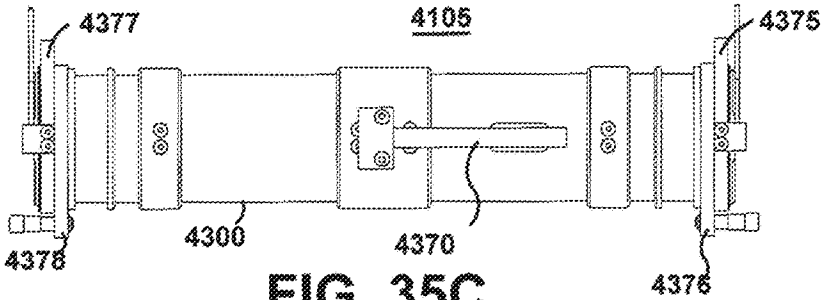
Figure 35D:
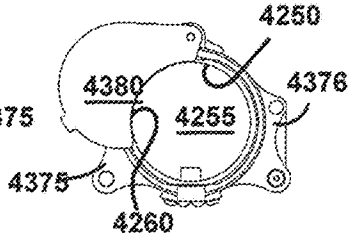
Figure 35E:
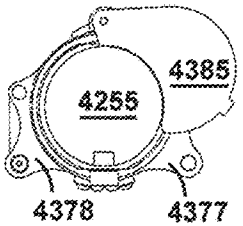

In addition, as further illustrated in FIGS. 34 and 35D, the front rotating door 4380 includes a circularly shaped inner contour 4260 that has a generally similar diameter as that of the front end 4250 of the canister 4300. As a result, when the front rotating door 4380 is in an open position, the inner chamber 4255 of the canister is fully opened and exposed, to allow unhindered expulsion of the round 11.

With reference to FIGS. 30 and 31, the front door return spring 4357 is firmly secured to the forward end of the front door shaft 4356. The other, or rearward, end of the front door return spring 4357 presses against the forward side of the first front door shaft support 4358, in order to keep the front rotating door 4380 in a closed position when the storage cell 4105 is assembled. The front rotating door 4380 includes a lip 4382 that engages a lock 4387 (FIG. 30), which is mounted on the front end 4250 of the canister 4300 (FIG. 31).

With further reference to FIGS. 31 and 34, when the storage cell 4105 is assembled, the front door release lever 4350 is firmly secured to the rearward end of the front door shaft 4356 and rests against the rearward end of the second front door shaft support 4308. As a result of this configuration, when the front door release lever 4350 is in a default (i.e., not pressed) state, it rests in an upward position (FIG. 31). However, as illustrated in FIG. 34, when it is desired to open the front rotating door 4380 and the rear rotating door 4385, the front door release lever 4350 is pressed downward to cause the front door shaft 4356 to rotate clockwise (as viewed from the front end of the storage cell 4105).

In the embodiment illustrated in FIGS. 30 and 31, the first front door shaft support 4358 is secured to a collar 4358C, which in turn, is securely mounted on the outer periphery of the collar 4300. Similarly, the second front door shaft support 4308 is secured to the central support collar 4379, which in turn, is securely mounted onto the collar 4300.

The front door linking collars 4375, 4376 are generally similar in design and construction, and therefore only the collar 4375 will be described in more detail. The collar 4375 is formed of a cylindrical ring 4415 (FIG. 30) having a circular cross-section. The inner diameter of the ring 4415 is selected so that the collar 4375 can be securely fitted on the front end 4250 of the canister 4300.

With reference to FIG. 31, the collar 4375 further includes a shoulder 4420 that is provided with two holes 4425, 4430. The shoulder 4420 protrudes outwardly to enable the engagement of the collar 4375 to another storage cell on one side, i.e., left side, of the storage cell 4105, in a chain configuration, as shown in FIG. 29, by means of two pins 4372, 4373. Pins 4372 and 4373 allow for connection to a subsequent magazine cell, while pin 4373 also incorporates a roller, which ensures the smooth operation of the magazine 10 as it revolves within its housing. The ring 4415 includes an inner, flat shoulder 4371 that engages a groove or cutout 4391 in cell 4300, thereby axially restraining collar 4375 (and similarly collar 4376).

Figure 32D:
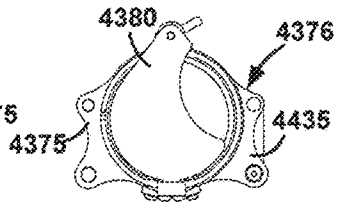
Figure 32E:
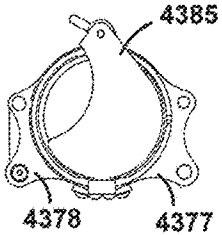

As illustrated in FIG. 32D, the collar 4376 includes a shoulder 4435 that is similar in design and function to the shoulder 4420, and that protrudes outwardly to enable the engagement of the collar 4376 to another storage cell another side, i.e., right side, of the storage cell 105, in a chain configuration.

Considering now the rear door assembly 4303 in connection with FIGS. 30 and 31, it is generally similar in design and function to the front door assembly 4301, and includes a rear door shaft 4306, a rear rotating door 4385, a rear door release lever 4305, a rear door return spring 4307, a first rear door shaft support 4359, and a second rear door shaft support 4360.

FIG. 30 further illustrates the clamping spring 4370 as being formed of a base 4390 secured to a preformed spring 4392 that is formed of a flat linear arm 4377 and a raised head 4374. The base 4390 is secured to the bottom of the central support collar 4379 by known or available means, such as screws or bolts.

In operation, and with further reference to FIG. 33, if the storage cell 4105 does not contain a round 11, then the arm 4377 of the clamping spring 4370 extends generally parallel to the canister 4300, with its head 4374 extending through an opening 4395 to the inner chamber 4255. The retention system 4100 further includes a proximity sensor 4600 that is disposed in the vicinity of the clamping spring 4370, and is mounted of the magazine housing so that when the head 4374 of the central spring 4370 is unbiased by the round 11, then the head 4374 will fall out of the range of the proximity sensor 4600, to indicate that the storage cell 4105 does not house the round 11.

If the storage cell 4105 contains a round 11, then, as shown in FIG. 39, the head 4374 pushes against the round 11 to provide it with lateral support, causing the arm 4377 to bend downward away from the canister 4300, and the head 4374 to fall into the range of the proximity sensor 4600, to indicate the presence of the round 11, thus providing an expeditious inventory of the rounds within the ammunition feeding mechanism 10.

As shown in FIG. 40, the retention system 4100 includes a clamp release cam 41310 that interfaces with a farthermost end 41320 of the head 4374, as the storage cell 4105 is advanced to the firing position, in order to depress the clamping spring 4370 and to retain it in a depressed state, in order to completely release the round 11.

FIGS. 31 through 42 illustrate various stages of the operation of the storage cell 4105. FIGS. 31, 32, and 33 represent various views of the storage cell 4105 with both the front rotating door 4380 and the rear rotating door 4385 closed. FIGS. 34 and 35 represent various views of the storage cell 4105 with both the front rotating door 4380 and the rear rotating door 4385 open.

As further illustrated in FIGS. 40 through 42, the retention system 4100 includes an actuator 41300 that is disposed at a short distance from the front door release lever 4350 and the rear door release lever 4305. The actuator 41300 generally includes two solenoids 41400, each with a plunger 41410 (only one solenoid 41400 and one plunger 41410 are illustrated in FIGS. 41, 42). Both solenoids and plungers are similar in design and function, and therefore only one plunger 41410 will be described herein in more detail. The plunger 41410 is disposed atop the front door release lever 4350 and the other plunger (not shown) is disposed atop the rear door release lever 4305.

When the plunger 41410 is retracted, as is illustrated in FIG. 41, the front door release lever 4350 is in an upward position, causing the front rotating door 4380 to remain closed. In the illustration shown in FIG. 42, the solenoid 41400 is activated so that only the plunger 41410 is extended downward to push down on the front door release lever 4350, causing both the front rotating door 4380 and the rear rotating door 4385 to be opened.

Similarly, when it is desired to open the rear rotating door 4385, as illustrated in FIGS. 34, 35, 36, and 37, the solenoid 41400 is activated so that the plunger (not shown) associated with the rear door release lever 4305 is extended downward to push down on the rear rotating door 4385.

As a result of this design, the firing position is distinct from the loading position. One solenoid plunger 41410 is located above the firing position that is aligned with the front door release lever 4350. The other solenoid plunger (not shown) is located above the rear door release lever 4305 in the loading position. The firing solenoid does actuate the rear door release lever 4305 and the loading solenoid does not actuate the front door release lever 4350.

FIGS. 38 and 39 illustrate various views of the storage cell 4105 in a loaded state, with both the front rotating door 4380 and the rear rotating door 4385 closed, and the front door release lever 4350 and the rear door release lever 4305 in an upward unbiased position.

FIGS. 43 through 46 illustrate various views of the gun tube clearance cell 41600 of FIG. 29. While the present exemplary embodiment is described as including a single gun tube clearance cell 41600, it should be clear that a different number of gun tube clearance cells may be used, without departing from the teaching of the present invention.

The gun tube clearance cell 41600 is generally similar in design construction to the storage cell 4105, but is functionally different therefrom. The gun tube clearance cell 41600 is primarily designed to ascertain that the gun tube 30 is clear and unobstructed and to provide a safe transport position for the recoiling system. The gun tube clearance cell 41600 is different than the other storage cells (i.e., 4105) because it is not meant to store a round.

In a preferred embodiment, the gun tube clearance cell 41600 is open at both ends, so that the recoiling mass 20 of the automated weapon 5 can be stored in the forward position for safety (i.e., not cocked back), as shown in FIG. 47. The gun tube clearance cell 41600 includes a generally cylindrically shaped, hollow canister 41605, an optical (or ultrasonic) release assembly 41610, an ultrasonic source 41650, and a chain link assembly 41675.

Considering now the canister 41605, it is generally similar in design and construction to the canister 4300 as described earlier. The chain link assembly 41675 includes two front end linking collars 41677, 41679 that are secured to the front end of the canister 41605, and that are similar in design, construction, and function to the linking collars 4375, 4376.

The chain link assembly 41675 further includes two rear end linking collars 41682, 41684 that are secured to the rear end of the canister 41605, and that are similar in design, construction, and function to the linking collars 4377, 4378. In this particular embodiment, the gun tube clearance cell 41600 does not include neither a front door nor a rear door, with the understanding that other embodiments of the present invention might selectively include a fixed rear door and/or a rotatable front door that is actuated similarly to the front rotating door 4380, as described earlier.

The ultrasonic source 41650 selectively generates and emanates an ultrasonic wave, as it will be explained later, in more detail, in connection with FIG. 45. The optical release assembly 41610 is generally formed of a collar 41611 that is mounted on the outer surface of the canister 41605. A rotatable reflective surface 41612 selectively rotates along an axis that is transverse to the axial direction of the canister 41605.

A lever 41655 is also mounted on the collar 41611, and is retained by a spring 41656. The lever 41655 and the rotatable reflective surface 41612 engage each other by means of meshing gears 41657 (FIGS. 44, 46).

In operation, when the gun tube clearance cell 41600 is not functional, a spring 41656 retains the lever 41655 in an unbiased position and the rotatable reflective surface 41612 is stowed against the inner surface of the canister 41605 (FIGS. 43, 44). In use, a solenoid that is similar to the solenoid 41400 (FIGS. 41, 42), actuates the lever 41655, which engages the rotatable reflective surface 41612 and causes it to be lowered from a stowed position (FIG. 44) to an extended position, at for example 45° relative to the longitudinal axis of the canister 41605.

The ultrasonic source 41650 generates an ultrasonic wave 41800 that travels through the opening 41620 in the canister 41605, to be reflected by the rotatable reflective surface 41612, parallel to the longitudinal axis of the canister 41605. The ultrasonic source optical source 41650 further includes a sensor that evaluates the echo of the ultrasonic wave laser beam 41800 that is received back at the sensor. If no echo is received, the gun tube 30 is assumed to be free from obstruction.

FIG. 48 is a interconnect diagram representing the control electronics system of the automated weapon of FIG. 2, in accordance with an illustrative embodiment. The interconnect diagram illustrates the control electronic system housed in a vehicle cab, pedestal, cradle and magazine housing and enabling the loading, positioning, aiming and firing of the weapon system including active recoil control of both the recoil and counter-recoil strokes and automated loading of the weapon system.

As described above, the weapon system may advantageously be mounted onto a mobile platform such as a HMMWV. The pedestal serves as an interface for power and electric signals between the weapon system and the vehicle platform. Housed within/on the vehicle cab are a power control unit (PCU) 487, a vehicle console assembly 481, a joystick 485 and an emergency switch unit 483.

The power control unit 487 is mounted to the rear of the vehicle cab. The power control unit 487 receives 24V DC power from a power supply and converts to 28V DC for system power and 45V DC required for actuator power. It will be understood that the power control unit 487 may be modified to receive and convert power of various voltage.

The vehicle console assembly 481 mounts to the roof of the vehicle cab between the driver and the commander. The vehicle console assembly 481 comprises control switches for powering on the weapon system and indicator lights. The vehicle console assembly 481 routes power and communication lines to the fire control computer and the joystick.

The vehicle console assembly 481 further comprises an interface to a computing device executing fire control software. Fire control software is responsible for accepting and processing firing missions. Fire control software provides the human interface for controlling the loading and unloading of ammunition, emplacing, aiming and firing the weapon. The fire control software interfaces with an inertial navigation unit 505 of the weapon system and global positioning receiver of the weapon system to enable weapon emplacement and eliminate the long setup and reset times associated with traditional surveying and aiming stake methods.

The joystick 485 provides an interface for manual weapon control to the operator. Through actuation of the joystick 485, an operator may manually control the actuators of the weapon system including the elevation actuator and traverse actuator 6. The joystick 485 may alternatively be connected directly to the power control unit 487.

The emergency stop switch unit 483 provides an override means for quickly stopping the motion of the system in an emergency situation by breaking an electrical circuit that loops through the system. Emergency stop switch units 483 may be mounted in the cab, vehicle bed and pedestal. If an emergency stop switch unit 483 is not required in a particular location, a shorting cap may be connected.

The vehicle cab interfaces with the weapon pedestal via a cable connected to the power control unit 487. The weapon pedestal comprises a slip ring 5, a power distribution unit (PDU) 519, an actuator control unit (ACU) 491, a traverse actuator 6, a traverse encoder 489, an elevation actuator 7 and an elevation encoder 493.

The slip ring 5 mounts between the vehicle frame and the pedestal and allows for the transmission of power and communication signals from the stationary vehicle frame to the rotating pedestal.

The power distribution unit 519 contains capacitive energy storage components to provide peak power needs of the electric actuators and recapture their regenerative energy.

The actuator control unit 491 contains an embedded computer running the actuator control system software. The actuator control unit 491 controls the operation of the actuators of the weapon system including the elevation actuator assembly, traverse actuator assembly 6, and via the weapon data hub 517, the weapon control unit 497 and magazine control unit 509. In addition, the actuator control unit 491 monitors feedback from various sensors of the weapon system including the elevation encoder 493, traverse encoder 489, inertial navigation unit 505, front cell door sensor 501, rear cell door sensor 499, rammer encoder assembly 23 and barrel temperature sensor 503.

The actuator control unit 491 comprises a plurality of communication interfaces for communicating with the various subsystems of the weapon system including Ethernet, CAN Bus and serial EIA-422 communication interfaces The actuator control unit 491 comprises a single board computing device running a real time operating system which executes the actuator control system software. The actuator control software employs data received from the inertial navigation unit 505 to lay on targets in Earth reference frame using coordinate transformation algorithms.

FIG. 49 is a data flow diagram representing the flow of data between software components of the automated weapon system of FIG. 2, in accordance with an illustrative embodiment. The actuator control unit software is architected in a hierarchical fashion with lower level processes providing well-defined services to higher level processes. This simplifies testing and allows for lower risk software updates as well as more insightful debugging and monitoring tools.

The traverse actuator assembly 6 comprises a brushless motor and rotary actuator providing servo control of traversing rotation of the pedestal rotation relative to the platform. The traverse encoder assembly 489 includes an absolute encoder mounted to the pedestal and interfacing with the bearing. The traverse encoder assembly 489 provides the angle of pedestal rotation relative to the platform to the actuator control unit 491.

The elevation actuator 7 comprises a brushless motor and linear actuator providing servo control of the elevation rotation of the weapon cradle relative to the pedestal. The elevation encoder assembly 493 includes an absolute encoder mounted to the pedestal and interfacing with the weapon trunnion provides an angle of weapon cradle rotation relative to the pedestal to the actuator control unit 491.

The weapon cradle houses a weapon data hub 517, a global positioning system (GPS) antenna 495, an inertial navigation unit (INU) 505, a weapon control unit (WCU) 497, front cell door sensor 501, rear cell door sensor 499, a trim brake assembly 13, a rammer encoder assembly 23, a right latch assembly 25, a barrel temperature sensor 503, a firing mechanism assembly 15, a weapon drive unit (WDU) 507 and a rammer actuator assembly 16.

The weapon cradle interfaces with the pedestal via the weapon data hub 517. The weapon data hub 517 routes power and information (CAN bus communications) to a magazine control unit (MCU) 509 and weapon control unit 497. Additionally, the weapon data hub 517 contains an embedded global positioning system (GPS) module which provides location information to the inertial navigation unit 505. In addition, the weapon data hub 517 routes inertial navigation unit 505 data back to the actuator control unit 491 and fire control computer via Ethernet communications.

The GPS antenna 495 is mounted to the top of the cradle for receiving a GPS signal and feeding the received GPS signal to the GPS module embedded in the weapon data hub 517.

The inertial navigation unit 505 provides location and attitude information of the weapon system to the actuator control unit 491 and fire control computer. The inertial navigation unit 505 is employed for navigation and orientation of the weapon. The inertial navigation unit 505 may comprise one or more gyroscopes or accelerometers to track the position and orientation of the weapon system.

The weapon control unit 497 operates and monitors the weapon system firing operations. More specifically, the weapon control unit 497 interfaces with the trim brake assembly 13, the front cell door sensor 501, the rear cell door sensor 499, the rammer encoder assembly 23, the barrel temperature sensor 503, the firing mechanism 15 and the weapon drive unit 507. An embedded microcontroller performs actions and accepts commands from the actuator control unit 491.

Internal to the weapon control unit 497 is a solenoid that when energized causes the front and rear doors of the magazine cell directly beneath the weapon control unit 497 to open.

The front cell door sensor 501 and rear cell door sensor 499 are proximity sensors that detect when a magazine cell door is fully opened. The state of the front cell door sensor 501 and rear cell door sensor 499 is monitored by the weapon control unit 497 during firing to ensure that the recoil system can push the ammunition into the chamber of the cannon.

As described above in greater detail, the trim brake assembly 13 (also referred to as recoil brake assembly) is an electrically controlled friction brake that allows dynamic braking of the recoil components. The trim brake assembly 13 comprises a solenoid which selectively applies a braking force to the recoiling mass 20 during recoil and counter-recoil strokes to control the velocity of the recoiling mass 20 in response to commands received from the weapon control unit 497.

The rammer encoder assembly is an incremental encoder that provides position of the recoiling mass. The rammer encoder assembly is used as feedback for the operation of the trim brake control system. In situations in which the position of the recoiling mass is not at an expected position, the weapon control unit 497 may selectively engage or disengage the trim brake to compensate.

FIG. 50 is a block diagram illustrating a control loop of the active recoil control system, in accordance with an illustrative embodiment of the invention. The weapon control unit 497 executes firmware to maintain state information of the active recoil system and implement control loops. The control loop implemented by the weapon control unit 497 utilizes position feedback of the recoiling mass as provided by the rammer encoder assembly along with velocity feedback calculated from the position feedback to dynamically control the recoil braking force applied by the trim brake assembly 13.

The rammer encoder assembly provides position data of the recoiling mass from which a velocity of the recoil mass is differentiated by the weapon control unit 497. The weapon control unit 497 stores recoil mass velocity verses position functions as lookup tables for various firing conditions of the weapon system. The weapon control unit 497 interpolates the lookup tables during control execution to determine whether to engage or disengage the trim brake via delivering electrical current to the trim brake solenoid.

The right latch assembly 25 is one of two latches that release the recoiling mass for firing the weapon. A left latch assembly is mechanically linked to the right latch assembly 25 and its operation mirrors that of the right latch assembly 25. The right latch assembly 25 includes a rotary solenoid which acts as a safety mechanism. When the safety mechanism is in an energized (i.e. disengaged) state the weapon system is in an "armed state" and the linear firing actuator may release the latches causing the recoiling mass to push ammunition into the chamber of the cannon. The right latch assembly 25 further comprises two proximity sensors which detects the state of the arming switch (safe vs. armed).

The barrel temperature sensor is a resistive temperature detector which measures the temperature of the weapon barrel. Feedback from the barrel temperature sensor is provided to the weapon control unit 497 and eventually to Fire Control for display to the operator. The operator may adjust operation of the weapon system based on this temperature and the current environment.

The firing mechanism assembly 15 is a linear actuator which actuates the latch assemblies. Extension of the linear actuator assembly releases the left and right latch assemblies 25 thereby allowing the recoiling mass 20 to forcibly engage the ammunition and push it from its ammunition cell into the chamber of the cannon.

The weapon drive unit is a servo amplifier mounted to the front of the weapon system. The weapon drive unit provides motor control to the rammer and firing actuator assemblies. The weapon drive unit is controlled by the weapon control unit 497.

The rammer actuator assembly 16 is a linear actuator used to charge the weapon in preparation for fire by pushing the recoiling mass against the one or more spring packs until the recoiling mass is held in place by the latch assemblies. The recoil mass is held out of battery by the right and left latch assemblies against compression springs. When the latch mechanism is released, the recoiling mass 20, including the bi-directional recoil mechanism 333, is accelerated forward by the compression springs.

The magazine of the weapon system including the mortar retention system, advantageously interfaces with the weapon data hub 517 to provide automated operation of the weapon system. The magazine comprises a magazine control unit (MCU) 509, a magazine actuator assembly 18, a magazine encoder assembly 19, an operator control unit 513, a loading solenoid assembly 22, a loading cell door sensor 511 and a round sensor 515.

The magazine control unit 509 controls the operation of and monitors the magazine system. The magazine control unit 509 comprises a microcontroller, servo controller, CAN bus interface to the weapon data hub 517, serial interface to the operator control unit 513 and magazine encoder assembly 19. The magazine control unit 509 interfaces with the magazine actuator assembly 18, loading cell door sensor 511, loading solenoid assembly 22, operator control unit 513, round sensor 515 and magazine encoder assembly 19 to accommodate loading of the ammunition, assigning operation information to the loaded ammunition, indexing to the required ammunition and chambering and firing of the ammunition.

The magazine actuator assembly 18 comprises a brushless motor and rotary actuator driving a magazine drive shaft for providing servo control of magazine rotation within the weapon system. During loading operations, the magazine is advanced by the magazine actuator assembly 18 such that empty ammunition cells of the magazine are aligned with the loading door to facilitate loading. The rammer actuator assembly 16 must be in an extended state to allow motion of magazine actuator assembly 18. During firing operation, the magazine actuator assembly 18 advances the magazine to a cell containing the desired ammunition for firing.

The magazine encoder assembly 19 is an absolute encoder mounted to the magazine and interfacing with a magazine drive shaft of the magazine actuator assembly 18. The magazine encoder assembly 19 provides to the magazine control unit 509, an angle of magazine relative to a calibrated start position. The assembly connects to the drive shaft through a gearbox having a 3.5:1 gear ratio which ultimately results in a 1:1 ratio between the encoder and the magazine chain.

The operator control unit 513 comprises a number keypad and LCD display which provides an operator with a visual interface to the weapon system. The operator control unit 513 may be used to initialize the system, reload ammunition, check system functions and clear misfires.

The loading solenoid assembly 22 is a solenoid of the same type employed in the weapon control unit 497. When energized, the loading solenoid 22 causes the rear door of the magazine cell currently aligned with the loading door to open. The loading solenoid assembly 22 further comprises a proximity sensor that detects when the solenoid is extended.

The loading cell door sensor 511 is a proximity sensor that detects when the rear cell door currently aligned with the loading port is open.

The round sensor 515 is a proximity sensor located within the magazine that detects a round is present within a cell by detecting a feature that is displaced by a loaded round.

FIG. 51 is a flowchart illustrating a method for operating the automated weapon system of FIG. 2, in accordance with an illustrative embodiment. The method illustrated in FIG. 51 comprises the steps of: configuring a weapon system 502, loading the weapon system 504, preparing the weapon system for operation 506; aiming the weapon system 508, and firing the weapon system 510.

FIG. 52 is a flowchart illustrating a method for configuring the automated weapon system of FIG. 2, in accordance with an illustrative embodiment. The method for configuring the weapon system illustrated in FIG. 52 comprises the steps of defining the ammunition types with associated data 5022, receiving the associated data at the weapon system 5024, and assigning a unique identifier 5026.

At step 5022, fire control software defines ammunition types with associated data and assigns a unique identifier. For example, the associated data may include round type, charge increment, fuze setting and lot number.

At step 5024, the associated data and unique identifier is provided by the fire control software to the actuator control unit 491 of the weapon system. The unique identifier is used on all subsequent operations which include the ammunition type.

FIG. 53 is a flowchart illustrating a method for loading the automated weapon system of FIG. 2, in accordance with an illustrative embodiment. The method for loading the automated weapon system comprises the steps of: placing the weapon in a loaded state 5042; receive load ammunition command 5044; advancing the magazine chain to align the nearest empty cell with the loading door 5046; displaying the ammunition data 5048; confirming the ammunition has been loaded 5048; and closing the cell door 5050.

At step 5042, the weapon is placed in a loading state. Fire Control transmits a command to the actuator control unit 491 directing it to go to a "reload state". The traverse actuator 6 and elevation actuator 7 in response to control signals from the actuator control unit 491 position the weapon system at the specified orientation. The specified orientation is configurable to each platform to allow for optimal loading of ammunition for that platform. In one embodiment, the specified orientation is for the gun barrel to point out of the left side of the vehicle. The recoil brake is disengaged by the weapon control unit 497 which allows for the weapon drive to extend the ram actuator in response to controls received from the weapon control unit 497.

At step 5044, the actuator control unit 491 receives a command via Fire Control to load ammunition of a given type into the magazine. The actuator control unit 491 then relays the command to the magazine control unit 509. The ammunition type is identified via the unique identifier assigned by the weapon system. The magazine is comprised of ammunition cells as described in further detail above.

At step 5046, the magazine actuator assembly 18 advances the magazine chain to align the nearest empty cell with the loading door in response to control signals received from the magazine control unit 509. The loading solenoid assembly 22 then energizes a solenoid in response to a control signal received from the magazine control unit 509 to open the rear magazine cell door.

At step 5048, the ammunition data associated with the given type is displayed on a screen of the operator control unit 513 to inform an operator of the ammunition type to load into the weapon.

At step 5050, once the operator has loaded the ammunition, the operator confirms loading via the operator control unit 513.

At step 5052, the loading solenoid assembly 22 is de-energized thereby closing the rear magazine cell door. If more ammunition is to be loaded, the magazine control unit 509 will commanded the magazine actuator assembly 18 to rotate to the next available cell and the loading process will repeat beginning at step 5046. The weapon system tracks which ammunition type is loaded in which cells by storing the ammunition type in a database on the Actuator control unit 491.

FIG. 54 is a flowchart illustrating a method for preparing the automated weapon system of FIG. 2, in accordance with an illustrative embodiment. The method for preparing the automated weapon system comprises the steps of: releasing the recoil control brake 5602; extending the rammer actuator 5604; retracting the rammer actuator 5606; and de-energizing the recoil control brake 5608.

At step 5602, the recoil brake is released in response to a control signal from the weapon control unit 497. The weapon control unit 497 supplies an electric current to energize a solenoid of the recoil brake thereby putting the recoil brake in a disengaged position.

At step 5604, once the recoil brake has been released, the weapon control unit 497 extends the rammer actuator assembly 16.

At step 5606, after the recoil mass has been cocked, the weapon control unit 497 calibrates its recoil position feedback and then retracts the rammer actuator assembly 16.

At step 5608, the solenoid of the recoil control brake is de-energized by the weapon control unit 497 thereby engaging the recoil brake.

FIG. 55 is a flowchart illustrating a method for aiming the automated weapon system of FIG. 2, in accordance with an illustrative embodiment. The method for aiming the automated weapon system comprises the steps of: receiving a command to lay on a target 5702; and pointing to the required azimuth and elevation to hit the target 5704.

At step 5702, a command to lay on a target is received by the weapon system. To lay on a target is to align the axis of the gun barrel on an Earth referenced azimuth and elevation. For example, the weapon operators may receive a call for fire and target coordinates from a forward observer or fire direction center. The target coordinates and weapon location are used by Fire Control software to calculate a firing solution. That solution is sent to the Actuator control unit 491 in the form of a Lay Command.

At step 5704, the weapon points to the required azimuth and elevation required to hit the target. To point to the correct azimuth and elevation, the traverse actuation system and elevation actuation system utilize feedback from several sensors including an inertial navigation system, as well as the elevation encoder assembly and traverse encoder assembly. The inertial navigation unit 505 is bore-sighted to the weapon and outputs the relationship between the cannon and the earth coordinate system. The elevation encoder assembly and the traverse encoder assembly output the relationship between the cannon and the weapon platform coordinate system.

FIG. 56 is a flowchart illustrating a method for firing the automated weapon system of FIG. 2, in accordance with an illustrative embodiment. The method for firing the weapon comprises the steps of: receiving a command to fire the weapon system 5802; indexing magazine to align the round in the gun tube 5804; releasing the recoil brake 5806; opening the cell doors 5808; arming the firing latches 5810; extending the linear firing actuator 5812; processing feedback from the rammer encoder assembly 23 to control the active recoil system 5814; activating the firing pin 5816; processing feedback from the rammer encoder assembly 23 to control the active recoil system 5818, the cell doors are closed and the recoil brake is engaged 5820.

At step 5802, a fire command is received at the actuator control unit 491 of the weapon system directing the actuator control unit 491 to fire the weapon system. The fire command further comprises an ammunition type.

At step 5804, the actuator control unit 491 directs the magazine control unit 509 to locate the ammunition type commanded to fire in the magazine and the magazine control unit 509 indexes the selected cell to align it with the gun tube via the magazine actuator assembly 18.

At step 5806, the weapon control unit 497 energizes the solenoid of the recoil control brake thereby releasing the recoil control brake.

At step 5808, the solenoid internal to the weapon control unit 497 is energized thereby opening the cell doors of the ammunition cell aligned with the gun tube.

At step 5810, the rotary solenoid of the right latch assembly 25 is energized by the weapon control unit 497, thereby disengaging the safety mechanism of the latch assembly and arming the weapon.

At step 5812, the linear firing actuator is extended by the weapon control unit 497 thereby releasing the latches and causing the recoil system to push the ammunition into the chamber of the cannon.

At step 5814, a rammer encoder assembly 23 provides feedback of the recoil mass position to control the active recoil control system such that the ramming velocity of the recoil mass is within proper predictive limits based on round type, ambient temperature and charge increment. The weapon control unit 497 determines based on the feedback from the rammer encoder assembly 23 to adjust the recoil control brake to control the velocity of the recoil mass.

At step 5816, when the recoiling mass and ammunition has been rammed into the cannon and while the recoil mass is still moving forward, a mechanical roller and cam arrangement in the recoil system activates the firing pin. The firing pin ignites the primer charge, which in turn ignites the propelling charge increments thereby propelling the ammunition out of the cannon.

At step 5818, the rammer encoder assembly 23 provides feedback to control the active recoil control system such that the recoil velocity is within proper predictive limits based on round type, ambient temperature and charge increment. This control assures that the recoil system will properly latch without excessive loads transferred to the weapon platform. The weapon control unit 497 determines based on the feedback from the rammer encoder assembly 23 to adjust the recoil control brake to control the velocity of the recoil mass.

While the invention has been described with reference to certain embodiments, numerous changes, alterations and modifications to the described embodiments are possible without departing from the spirit and scope of the invention as defined in the appended claims, and equivalents thereof.

What is claimed is:

1. A weapon system with an active recoil control system for adjusting a weapon recoil, wherein the weapon system is provided a recoiling mass comprising:

a multi-disc brake that generates a braking load, wherein the multi-disc brake further comprises a brake shaft, a disc assembly comprised of stators and rotors, wherein as the disc assembly is subjected to an axial load, a torque is applied on the brake shaft, and a spring that applies a force to a pressure plate wherein the pressure plate selectively transmits the spring force to the disc assembly, causing the brake to apply a damping force to the recoiling mass;

a solenoid that controls operation of the multi-disc brake for adjusting the weapon recoil wherein the solenoid selectively opposes the spring force via the pressure plate, to relieve the spring force transmitted to the disc assembly, in order to allow the brake shaft to spin freely;

a rack gear is mounted on the recoiling mass, to permit the braking load to be transmitted to be transmitted to the recoiling mass;

a recoiling mass position encoder for providing a measured position of the recoiling mass to a weapon control unit; and the weapon control unit for determining a determined velocity of the recoiling mass based on the measured position of the recoiling mass, comparing the measured position of the recoiling mass and the determined velocity of the recoiling mass with a predicted position and a predicted velocity and selectively providing a power signal to the solenoid based on the difference between the measured position and determined velocity of the recoiling mass and the predicted position and predicted velocity.

2. The weapon system of claim 1 wherein the predicted position and the predicted velocity are based on a firing factor selected from the group consisting of: cant angle, round type, ambient temperature and charge increment.

3. The weapon system of claim 1 wherein the recoiling mass position encoder provides a measured position of the recoiling mass to a weapon control unit during a recoil stroke of the recoiling mass.

4. The weapon system of claim 1 wherein the recoiling mass position encoder provides a measured position of the recoiling mass to a weapon control unit during a counter-recoil stroke of the recoiling mass.

* * * * *